US009247599B2

(12) United States Patent
Lee

(10) Patent No.: US 9,247,599 B2
(45) Date of Patent: Jan. 26, 2016

(54) LED DRIVING DEVICE AND METHOD FOR DRIVING AN LED BY USING SAME

(76) Inventor: Dong-Il Lee, Yongon-si (KR)

( * ) Notice: Subject to any disclaimer, the term of this patent is extended or adjusted under 35 U.S.C. 154(b) by 0 days.

(21) Appl. No.: 14/115,766

(22) PCT Filed: May 4, 2012

(86) PCT No.: PCT/KR2012/003522

§ 371 (c)(1),
(2), (4) Date: Nov. 5, 2013

(87) PCT Pub. No.: WO2012/153947

PCT Pub. Date: Nov. 15, 2012

(65) Prior Publication Data

US 2014/0062317 A1 Mar. 6, 2014

(30) Foreign Application Priority Data

May 6, 2011 (KR) ..... 10-2011-0042866
Jun. 15, 2011 (KR) ..... 10-2011-0057798
Sep. 1, 2011 (KR) ..... 10-2011-0088439

(51) Int. Cl.
*H05B 37/00* (2006.01)
*H05B 33/08* (2006.01)
*H05B 37/02* (2006.01)

(52) U.S. Cl.
CPC ..... *H05B 33/0842* (2013.01); *H05B 33/083* (2013.01); *H05B 37/02* (2013.01)

(58) Field of Classification Search
CPC ..... H05B 33/0815; H05B 33/0818; H05B 33/083; H05B 37/02
USPC ..... 315/122, 185 R, 186, 192, 193, 291, 315/294, 307, 360
See application file for complete search history.

(56) References Cited

U.S. PATENT DOCUMENTS

| | | | | |
|---|---|---|---|---|
| 7,986,107 | B2 * | 7/2011 | Weaver | H05B 33/0812 315/121 |
| 8,018,170 | B2 * | 9/2011 | Chen et al. | 315/192 |
| 8,686,651 | B2 * | 4/2014 | Lynch et al. | 315/192 |
| 2006/0208669 | A1 * | 9/2006 | Huynh et al. | 315/312 |
| 2007/0145914 | A1 | 6/2007 | Hong et al. | |

(Continued)

FOREIGN PATENT DOCUMENTS

| | | |
|---|---|---|
| JP | 2011-009474(A) | 1/2001 |
| KR | 10-2006-0081902(A) | 7/2006 |

(Continued)

OTHER PUBLICATIONS

PCT-Notification PCT/KR2012/003522.
PCT/KR2012/003522—Written Opinion.
PCT/KR2012/003522—Search Report.

*Primary Examiner* — Tung X Le
(74) *Attorney, Agent, or Firm* — Dority & Manning, P.A.

(57) ABSTRACT

The present invention relates to an LED driving device and a method for driving an LED by using the same. According to one aspect of the present invention, an LED driving device includes: a light source unit including first to nth LED groups sequentially connected in series; and a driving control unit having first to nth input terminals respectively connected to output terminals of the first to nth LED groups for controlling each of first to nth input currents which are inputted to the first to nth input terminals through first to nth current sensing signals generated by reflecting the first to nth input currents at predetermined ratios.

20 Claims, 24 Drawing Sheets

(56) References Cited

U.S. PATENT DOCUMENTS

| | | | | |
|---|---|---|---|---|
| 2010/0194298 | A1* | 8/2010 | Kuwabara | 315/186 |
| 2011/0068700 | A1* | 3/2011 | Fan | 315/185 R |
| 2011/0273103 | A1 | 11/2011 | Hong | |
| 2012/0146524 | A1* | 6/2012 | Jeong | 315/193 |

FOREIGN PATENT DOCUMENTS

| | | |
|---|---|---|
| KR | 10-2007-0000963(A) | 1/2007 |
| KR | 20-2010-0006345(U) | 6/2010 |
| KR | 10-2010-021816(A) | 11/2010 |
| KR | 10-0997050(B1) | 11/2010 |

* cited by examiner

--PRIOR ART--

--PRIOR ART--

--PRIOR ART--

--PRIOR ART--

--PRIOR ART--

--PRIOR ART--

LED DRIVING DEVICE AND METHOD FOR DRIVING AN LED BY USING SAME

CROSS REFERENCE TO RELATED APPLICATIONS

This application is the U.S. National Stage entry of International Application Number PCT/KR2012/003522 filed under the Patent Cooperation Treaty having a filing date of May 4, 2012, which claims priority to Korean Patent Application Serial Number 10-2011-0042866 having a filing date of May 6, 2011, Korean Patent Application Serial Number 10-2011-0057798 having a filing date of Jun. 15, 2011 and Korean Patent Application Serial Number 10-2011-0088439 having a filing date of Sep. 1, 2011, all of which are hereby incorporated by reference herein in their entirety for all purposes.

TECHNICAL FIELD

The present invention relates to a light emitting diode (LED) driving device and an LED driving method using the same, and more particularly, to an LED driving device capable of stably controlling a current flowing in an LED and enhancing power efficiency, and an LED driving method using the same.

BACKGROUND ART

A light emitting device refers to a semiconductor device capable of implementing light of various colors by configuring a light emitting source with various compound semiconductor materials such as GaAs, AlGaAs, GaN, InGaAlP, and the like. Light emitting devices, advantageously having an excellent monochromatic peak wavelength and excellent optical efficiency, being compact and environmentally friendly, and consuming low levels of power, and the like, have been widely used for various applications such as in TVs, computers, illumination devices, vehicles, and the like, and the utilization thereof is gradually expanding.

Recently, organic light emitting diodes (OLEDs) using organic compounds, rather than inorganic compounds, have been increasingly applied to products. OLEDs, able to be implemented in a large area and easily bendable, are anticipated to be extendedly used in various fields of application.

A light emitting device (such as an LED) has characteristics that a current flowing therethrough is increased exponentially in a voltage (e.g., over a voltage applied to both ends thereof). Thus, in a case in which a lighting device using LEDs as light sources is driven upon receiving direct current (DC) power voltage with fluctuations therein, a constant current circuit generating a constant current or a DC/DC converter maintaining a constant output voltage is generally used. Namely, in an LED, a current is very susceptible to change, with regard to an applied voltage, and thus, in order to apply DC power with large fluctuations therein to an LED and obtain stable optical output, an apparatus or a method for stably controlling a current flowing in an LED is required.

FIG. 1 schematically illustrates a related art LED driving circuit to which alternating current (AC) power is applicable, and voltage and current waveforms of the LED driving circuit. Specifically, FIG. 1A is a view schematically illustrating a related art LED driving circuit, FIG. 1B is a view illustrating a waveform of a voltage $V_{DR}$ applied to a light source unit D and a resistor R in FIG. 1A, and FIG. 1C is a view illustrating a waveform of a current $I_D$ flowing in the light source unit D.

First, referring to FIG. 1A, the related art LED driving circuit includes a rectifying unit converting alternating current (AC) power input from the outside into DC power, the light source unit D driven upon receiving a DC voltage output from the rectifying unit and including a plurality of LEDs, and a resistor R connected to the light source unit D in series.

As mentioned above, with respect to an input voltage, a current flowing in an LED is changed exponentially, so the resistor R may be connected to the light source unit D including a plurality of LEDs in series to restrain a change in the current flowing in the light source unit D, and a peak current flowing in the LED may be prevented from being changed exponentially according to fluctuations (e.g., 220 Vrms→240 Vrms) in the AC power voltage input from the outside due to the resistor R. Here, if a value of the resistor R may be increased, a variation of a peak current flowing in the LED may be reduced but a proportion of power consumed in the resistor R is increased, and a peak current flowing in the LED when a voltage is the highest has a very high value, relative to an average or root mean square (RMS) current, increasing a peak factor (or crest factor). Also, as illustrated in FIG. 1C, since a current flows only in a partial section of the overall period, it may have difficulty in satisfying the International Electrotechnical Commission (IEC) regarding electricity usage, such as power factor as an indicator indicating similarity between an input voltage and a current waveform, a magnitude of a harmonic component (harmonic distortion) included in an input current, and the like. Also, a current flowing in the LED is changed relatively significantly according to a variation of an AC power voltage input from the outside, making it difficult for the LED driving circuit to be applied to a case in which fluctuations in an input power voltage are large.

FIG. 2 is a view illustrating a modification of a related art LED driving circuit that may be applicable to commercial AC power and voltage and current waveforms of the LED driving circuit. Referring to FIG. 2A, the related art LED driving circuit includes a rectifying unit converting AC power input from the outside into DC power, a light source unit D including a plurality of LEDs and driven upon receiving DC power output from the rectifying unit, and a current limiting unit $I_S$ connected to the light source unit D in series to limit a current input to the light source unit D. The current limiting unit $I_S$ operates as a current source only when a forward voltage has a magnitude equal to or greater than a predetermined value in a direction in which a current flows. FIG. 2B illustrates a waveform of a voltage $V_{DR}$ applied to the light source unit D and the current limiting unit $I_S$, and FIG. 2C illustrates a waveform of a current $I_D$ flowing in the light source unit D and the current limiting unit $I_S$. In the case of using the current limiting unit $I_S$, the same average value of the current flowing in the light source unit D as that in case of using the resistor R (please see FIG. 1), while lowering a peak value of the current flowing in the light source unit D, can be obtained.

In the LED driving circuit illustrated in FIG. 2, even in the case that a voltage of external AC power is increased (e.g., 220 Vrms→240 Vrms), the current $I_D$ flowing in the light source unit D is rarely affected. In this case, however, since a current-voltage relationship of the LED appears exponentially, if a voltage across the light source unit D is lower than a predetermined voltage, the current is rapidly reduced and rarely flows. Thus, even in the LED driving circuit illustrated in FIG. 2, in the section P in which the input voltage is lower than a rated voltage of the LED, a current flows rarely, and thus, a waveform of the current $I_D$ of the light source unit D is significantly different from the rectified sinusoidal wave and a peak value of the current $I_D$ is still high, relative to the rectified sinusoidal wave having the same RMS value.

DISCLOSURE

Technical Problem

An aspect of the present invention provides an LED driving device capable of stably controlling a current flowing in an LED simply under an operational condition that a power supply voltage is greatly changed, and an LED driving method using the same.

An aspect of the present invention also provides an LED driving device capable of enhancing power efficiency and improving a power factor, and an LED driving method using the same.

Technical Solution

According to an aspect of the present invention, there is provided an LED driving device comprising: a light source unit including a plurality of first to nth LED groups sequentially connected in series; and a driving control unit having first to nth input terminals connected to output terminals of the first to nth LED groups, respectively, and controlling first to nth input currents input to the first to nth input terminals, through first to nth current sensing signals generated by reflecting the first to nth input currents in predetermined proportions.

According to another aspect of the present invention, there is provided an LED driving device comprising: a light source unit including a plurality of first to nth LED groups sequentially connected in series; and a driving control unit having first to nth input terminals connected to output terminals of the first to nth LED groups, respectively, and controlling first to nth input currents to be input to the first to nth input terminals according to pre-set priority by allowing a current input to an input terminal having higher priority among the first to nth input terminals to reduce or cut off a current input to an input terminal having lower priority.

The driving control unit may control a current to be exclusively input preferentially to an input terminal having higher degree among the first to nth input terminals.

The current input to the input terminal having higher priority has a current level equal to or higher than that of the current input to the input terminal having lower priority.

The driving control unit comprises: a current sensing block generating first to nth current sensing signals reflecting the first to nth input currents in predetermined proportions; a current control block receiving the first to nth current sensing signals and outputting first to nth control signals for controlling respective currents input to the first to nth input terminals; and first to nth current control units regulating magnitudes of the first to nth input currents according to the first to nth control signals, respectively.

Magnitudes of at least a portion of the first to nth current sensing signals are equal.

Degrees of at least a portion of the first to nth current sensing signals are sequential and magnitudes thereof are equal.

Current sensing signals having sequential degrees and equal magnitudes are output to input terminals which drive a smaller current or drive an equal current as priority thereof is higher.

The first to nth current sensing signals generated by the current sensing block may be output in the form of voltages.

The current sensing block comprises one or more resistors connected between the current control units and a ground and generating the first to nth current sensing signals reflecting all currents flowing from the current control units to the ground in predetermined proportions.

The current sensing block comprises a single resistor connected between the current control units and a ground, and all the currents input to the first to nth input terminals flow to the ground through the single resistor.

The current sensing block comprises a plurality of resistors connected between the current control units and a ground, and the plurality of resistors connect adjacent output terminals of the first to nth current control units connected to the first to nth input terminals, respectively, and connect an output terminal of the first current control unit and a ground, to allow first to nth input currents input to the first to nth input terminals to flow to the ground through the plurality of resistors.

The current sensing block comprises a plurality of resistors connected between the current control units and a ground, and the plurality of resistors connect adjacent output terminals of the first to nth current control units connected to the first to nth input terminals, respectively, and connect an output terminal of the nth current control unit and a ground, to allow the current input to the first to nth input terminals to flow to the ground through the plurality of resistors.

In the current sensing block, the resistance of a resistor connected between an input terminal driving the largest current, among the first to nth input terminals, and a ground, is the smallest.

The current control block generates first to nth control signals for controlling magnitudes of the first to nth input currents by reflecting the first to nth current sensing signals and first to nth reference signals.

The current control block further comprises controllers outputting first to nth control signals controlling magnitudes of the first to nth input currents such that the first to nth current sensing signals are equal to the first to nth reference signals.

The current control block outputs a control signal corresponding to a magnitude of the reference signal to control the entirety or a portion of the first to nth input terminals, and outputs a control signal generated by comparing the current sensing signal with the reference signal to control an input terminal excluding an input terminal to which the control signal corresponding to the magnitude of the reference signal is output.

The first to nth control signals are generated to have magnitudes corresponding to those of the first to nth reference signals, respectively.

The first to nth reference signals have a greater value to control a current of an input terminal having higher priority among the first to nth input terminals.

Magnitudes of at least a portion of the first to nth reference signals are changed by an external signal.

Magnitudes of at least a portion of the first to nth reference signals are changed by an external signal all in the same proportion.

The driving control unit further comprises a dimming signal generator changing magnitudes of first to nth input currents according to a signal input from the outside.

The dimming signal generator changes magnitudes of at least a portion of the first to nth input currents all in the same proportion according to the signal input from the outside.

The driving control unit comprises: a current control block outputting first to nth reference signals; a current sensing block generating first to nth current sensing signals by reflecting respective currents input from output terminals of the first to nth LED groups to first to nth input terminals of the driving control unit, in predetermined proportions; and first to nth current control units controlling the first to nth input currents by comparing the first to nth current sensing signals with the first to nth reference signals.

At least a portion of the first to nth current control units comprise a bipolar junction transistor (BJT) having a base terminal to which the reference signals are input and an emitter terminal to which the current sensing signals are input.

The first to nth current control units comprise a plurality of BJTs connected to the first to nth input terminals of the driving control unit, respectively, the current control block outputs the reference signals to at least a portion of the plurality of BJTs, and outputs a control signal for controlling an input current, by comparing the current sensing signals with the reference signals, to a BJT to which the reference signals have not been input, among the plurality of BJTs, and the current control unit, which receives the control signal, among the first to nth current control units, controls a current input to an input terminal connected according to the control signal.

The driving control unit further comprises a power supplier supplying a source voltage, and the first to nth reference signals are generated by a plurality of resistors connected in series between the power supplier and a ground.

The driving control unit further comprises a power supplier supplying a source voltage, and the reference signals are generated by a plurality of resistors connected in series between the power supplier and emitter terminals of the BJTs.

The driving control unit further comprises a power supplier supplying a source voltage, and the current control block outputs at least a portion of the first to nth reference signals generated by the plurality of resistors connected in series between the power supplier and the ground to the current control units, compares a reference signal, which has not been output to the current control units, among the first to nth reference signals, and the current sensing signals, and outputs a control signal for controlling input currents to the current control units.

The driving control unit changes levels of currents input to the first to nth input terminals of the driving control unit, upon receiving voltages from the output terminals of the first to nth LED groups.

At least a portion of the currents input from the output terminals of the first to nth LED groups to the first to nth input terminals of the driving control unit are transferred through a current buffer.

The LED driving device may further comprise: a power source unit supplying DC power to the light source unit, wherein one end of the first LED group is connected to the power source unit and the other end thereof is connected sequentially in series to the second to nth LED groups.

The power source unit may comprise a rectifying unit converting AC power input from the outside into DC power and supplying the converted DC power to the light source unit.

The LED driving device may further comprise: at least one of a line filter and a common mode filter connected between the AC power input from the outside and the light source unit.

A plurality of light source units are connected to an output terminal of the power source unit in parallel.

A path is controlled such that currents are input sequentially from the first input terminal to the nth input terminal and from the nth input terminal to the first input terminal in every period of the DC power.

The driving control unit drives such that a voltage of the DC power and a current passing through the first LED group are in inverse proportion in a portion of at least one driving section.

The LED driving device may further comprise: a power supplier receiving the DC power and supplying a source voltage required for the driving control unit.

The LED driving device may further comprise: a temperature sensor sensing a temperature of the light source unit and transferring a signal for controlling an operation of the light source unit to the driving control unit according to the sensed temperature of the light source unit.

The LED driving device may further comprise: a source voltage regulating unit connected between the rectifying unit and the light source unit, receiving converted DC power from the rectifying unit, regulating a range of a voltage, and outputting the same.

The source voltage regulating unit is an active power factor correction (PFC) circuit or a passive PFC circuit.

A plurality of light source units are provided, and the plurality of light source units are connected to an output terminal of the source voltage regulating unit in parallel.

The driving control unit may further comprise a current duplication block to which first to nth input currents input from the output terminals of respective first to nth LED groups are divided and input.

The currents input to the current duplication block maintain predetermined ratios on a time axis with respect to the first to nth input currents.

Currents divided with respect to a portion of input terminals of the driving control unit are input to the current duplication block.

A plurality of light source units are provided, and the driving control unit further comprises a current duplication block driving other remaining light source units which are not driven by the current control units, among the plurality of light source units, upon receiving a control signal, the same as those of the current control units, from the current control block.

The current duplication block, which drives the other remaining light source units, drives currents having the same magnitude as those of the current control units from the output terminals of the respective first to nth LED groups included in the other remaining light source units, respectively.

The current duplication block generates current sensing signals by reflecting first to nth duplication currents input from the output terminals of the respective first to nth LED groups of the driven light source units.

The current sensing signals generated by the current duplication block have the same magnitude as those of the current sensing signals generated by the current sensing block.

According to another aspect of the present invention, there is provided an LED driving method comprising: setting first to nth driving sections sequentially according to magnitudes of DC source voltages and setting first to nth current levels with respect to the first to nth driving sections, in order to drive first to nth LED groups connected sequentially in series; generating first to nth current sensing signals by reflecting first to nth input currents input from output terminals of respective first to nth LED groups to the first to nth input terminals of a driving control unit, in predetermined proportions; setting magnitudes of first to nth reference signals such that the first to nth input currents are driven with the first to nth current levels in each of the first to nth driving sections; and controlling the first to nth input currents by comparing the first to nth current sensing signals with the first to nth reference signals, respectively, to thereby allow currents to flow with the first to nth current levels to at least a portion of the first to nth LED groups in the first to nth driving sections.

According to another aspect of the present invention, there is provided an LED driving method comprising: setting first to nth driving sections sequentially according to magnitudes of DC source voltages and setting first to nth current levels with respect to the first to nth driving sections, in order to drive first to nth LED groups connected sequentially in series; setting exclusive priority of first to nth input currents input from output terminals of the respective first to nth LED groups to first to nth input terminals of a driving control unit by reflecting the first to nth current levels; and driving currents to flow with the set first to nth current levels in at least a portion of the first to nth LED groups in the first to nth driving sections by controlling the first to nth input currents input to the first to nth input terminals, according to the set exclusive priority.

The priority is set to be higher for an input current having a higher degree among the first to nth input currents input to the first to nth input terminals of the driving control unit.

Setting of exclusive priority of the first to nth input current input to the first to nth input terminals of the driving control unit comprises: setting predetermined proportions of the first to nth input currents reflected in the first to nth current sensing signals; and setting magnitudes of the first to nth reference signals with respect to the first to nth current levels.

Exclusive priority of the first to nth input currents is determined according to magnitudes of the first to nth current levels set with respect to the first to nth driving sections.

Exclusive priority of the first to nth input currents is determined according to magnitudes of the first to nth reference signals set with respect to the first to nth current levels.

In the setting of exclusive priority of the first to nth input currents, the predetermined proportions are set such that current sensing signals, which are generated with respect to input terminals whose driving current levels are gradually decreased as their degrees are sequentially increased, among the first to nth input terminals, reflect the first to nth input currents, in the same proportion.

When the first to nth current levels set with respect to the first to nth driving sections and the first to nth reference signals set with respect to the first to nth current levels are arranged in sequence of magnitudes, orders of degrees are identical.

The first to nth current levels are set to have sequentially greater values with respect to the first to nth driving sections.

The first to nth current levels are set to have sequentially smaller values with respect to the first to nth driving sections.

The driving of currents with the set first to nth current levels such that the currents flow to at least a portion of the first to nth LED groups comprises: generating first to nth current sensing signals by reflecting first to nth input currents, in predetermined proportions; comparing magnitudes of the first to nth current sensing signals and those of the first to nth reference signals set with respect to the first to nth current levels; and controlling the first to nth input currents such that the first to nth input currents flow with the first to nth current levels in the respective first to nth driving sections.

The first to nth current sensing signals are generated in the form of voltages.

The first to nth current sensing signals have voltages obtained when the first to nth input currents input to the first to nth input terminals of the driving control unit flow to a ground through a resistor.

The first to nth current sensing signals are generated through one or more resistors reflecting respective currents input to the first to nth input terminals of the driving control unit.

The first to nth current sensing signals are generated through a plurality of resistors connecting the output terminals of the first to nth current control units controlling currents input to the first to nth input terminals of the driving control unit, respectively, and connecting the output terminal of the first current control unit and a ground.

The first to nth current sensing signals are generated through a plurality of resistors connecting the output terminals of the first to nth current control units controlling currents input to the first to nth input terminals of the driving control unit, respectively, and connecting the output terminal of the nth current control unit and a ground.

The first to nth current sensing signals are generated by reflecting a portion or the entirety of voltages generated by the resistors, by minimizing a magnitude of resistance on a path along which the largest current flows among paths along which currents input from the first to nth input terminals of the driving control unit flow to a ground, and controlling other input currents to flow to the ground through a portion or the entirety of the resistors.

The first to nth current sensing signals are generated by reflecting the first to nth input currents all in the same proportion.

The first to nth current sensing signals have voltages obtained when all of the first to nth input currents flow to a ground through a single resistor.

Magnitudes of at least a portion of the first to nth current sensing signals are equal.

At least a portion of the first to nth current sensing signals have sequential degrees and have the same magnitude.

Magnitudes of the first to nth reference signals are set to be different.

The first to nth reference signals are set to have sequentially larger values.

The LED driving method may further comprise: regulating the first to nth current levels set with respect to the first to nth driving sections by the first to nth reference signals, and changing magnitudes of at least a portion of the first to nth reference signals according to an external signal.

At least a portion of the first to nth reference signals are all changed in the same proportion.

In the driving of the currents to flow with the set first to nth current levels to at least a portion of the first to nth LED groups, an input current having a higher degree, among the first to nth input currents input to the driving control unit, is controlled to be input with priority.

In the driving of the currents to flow with the set first to nth current levels to at least a portion of the first to nth LED groups, an input current having higher exclusive priority reduces or cuts off an input current having lower exclusive priority.

An input current having higher priority, among the first to nth input currents, increases the first to nth current sensing signals to thereby reduce or cut off an input current having lower priority, among the first to nth input currents.

In the driving of the currents to flow with the set first to nth current levels to at least a portion of the first to nth LED groups, magnitudes of the first to nth input currents are controlled such that magnitudes of the first to nth current sensing signals and those of the first to nth reference signals are equal.

When the nth current sensing signal is smaller than the nth reference signal, the nth input current is controlled to be increased, and when the nth current signal is greater than nth reference signal, the nth input current is controlled to be decreased.

In the driving of the currents to flow with the set first to nth current levels to at least a portion of the first to nth LED groups, magnitudes of at least a portion of the first to nth input currents are changed according to a signal input from the outside.

Magnitudes of at least a portion of the first to nth input currents are all changed in the same proportion according to the signal input from the outside.

The LED driving method may further comprise: changing the first to nth current levels upon receiving a voltage from output terminals of the first to nth LED groups.

At least a portion of currents input from the output terminals of the first to nth LED groups to the first to nth input terminals of the driving control unit are transferred through a current buffer.

The LED driving method may further comprise: converting AC power input from the outside into DC power.

A path is controlled such that currents flow sequentially from the first LED group to the nth LED group in a half period of the DC power.

A voltage of the DC power and a current passing through the first LED group are in inverse proportion in a portion of at least one driving section.

The LED driving method may further comprise: changing magnitudes of the first to nth input currents according to a temperature of the first to nth LED groups.

The LED driving method may further comprise: reducing a swing of a source voltage upon receiving the converted DC power.

The reducing of the swing of the source voltage is performed by an active power factor correction (PFC) circuit or a passive PFC circuit.

The LED driving method may further comprise: controlling at least a portion of the first to nth input currents, which are input from the output terminals of the respective first to nth LED groups to the first to nth input terminals of the driving control unit, to flow to a ground through a different path.

The currents flowing to the ground through the different path maintain predetermined ratios on a time axis with respect to the first to nth input currents.

Advantageous Effects

According to an embodiment of the present invention, an LED driving device and an LED driving method could be obtained. The LED driving device is capable of stably controlling a current flowing in an LED simply under an operational condition that a power supply voltage is greatly changed, and the LED driving method using the same.

Also, an LED driving device and an LED driving method could be obtained. The LED driving device is capable of enhancing power efficiency and improving a power factor, and the LED driving method using the same.

Also, according to an embodiment of the present invention, an LED driving device could be obtained. The LED driving device has increased lifespan.

BEST MODE

Figure 1A:
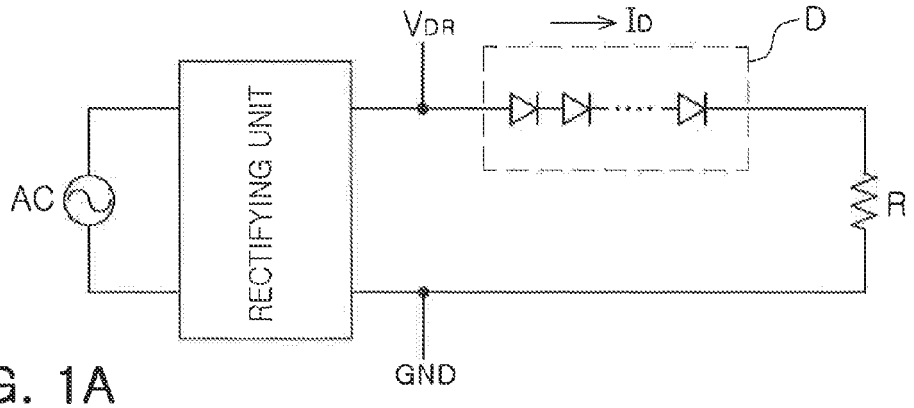
FIG. 1 is a view schematically illustrating a related art LED driving circuit to which AC power is applicable.
Figure 1B:
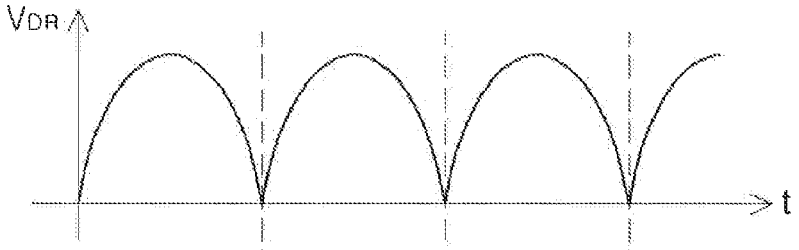
Figure 1C:
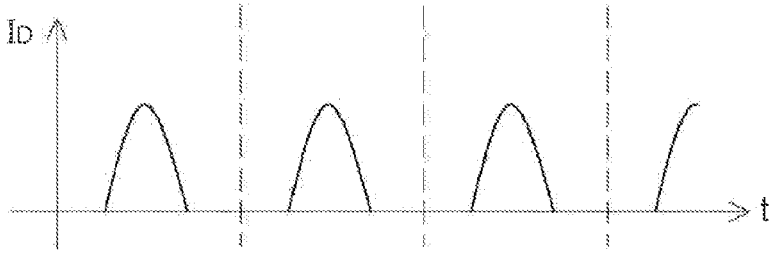
Figure 2A:
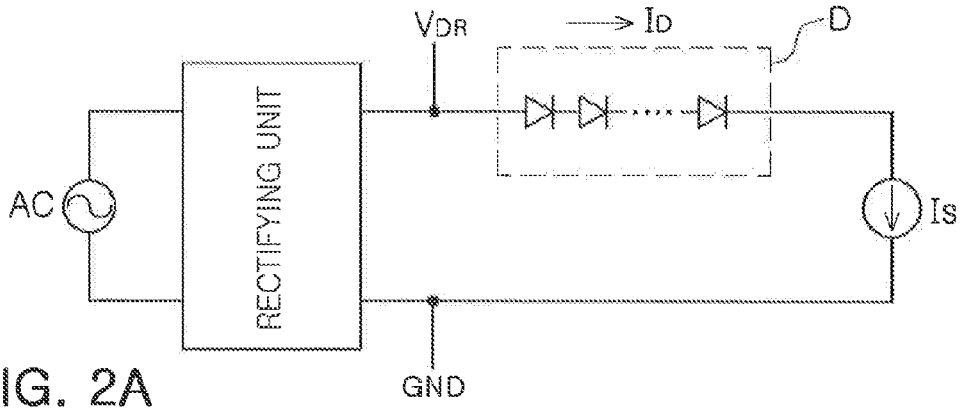
FIG. 2 is a view schematically illustrating a modification of a related art LED driving circuit to which AC power is applicable.
Figure 2B:
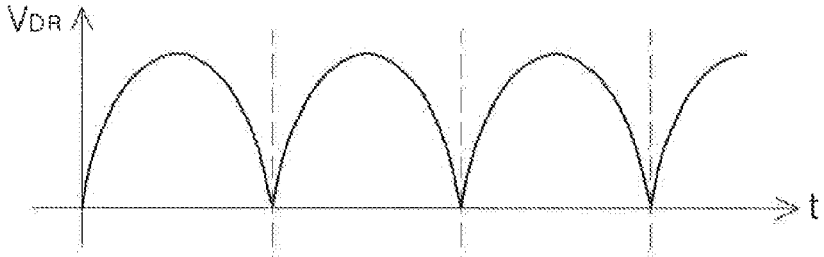
Figure 2C:
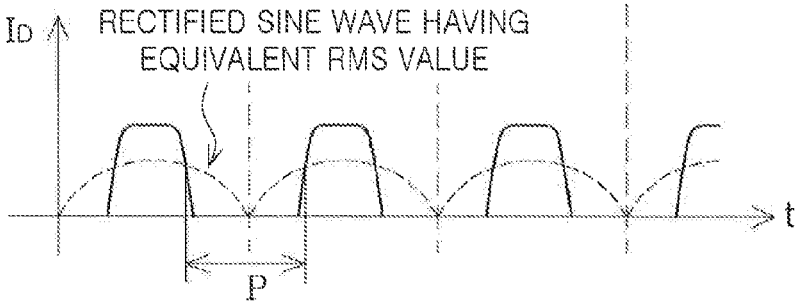

Hereinafter, preferred embodiments of the present invention will be described with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figure 3:
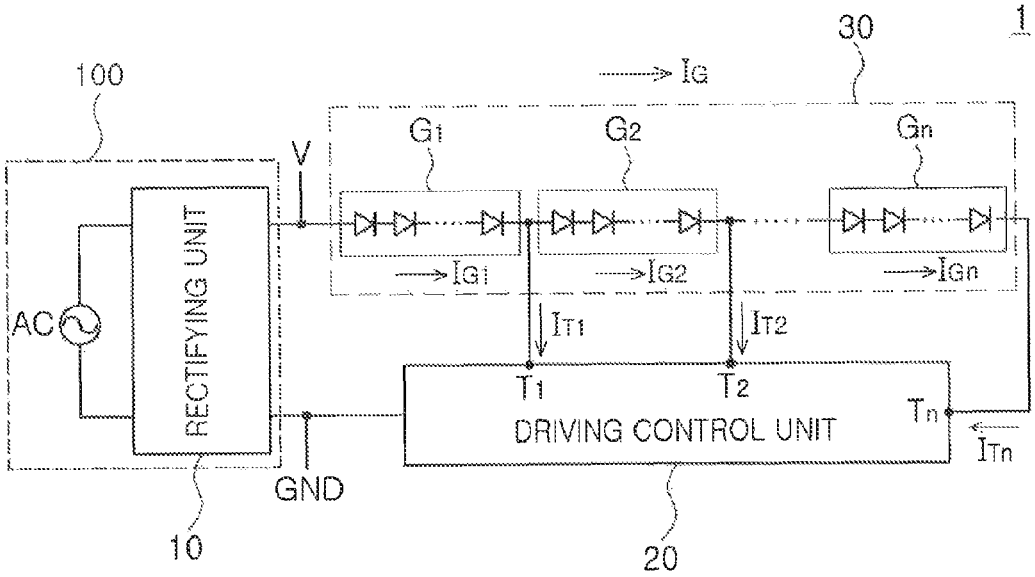
FIG. 3 is a view schematically illustrating a configuration of an LED driving device according to an embodiment of the present invention.

FIG. 3 is a view schematically illustrating a configuration of an LED driving device according to an embodiment of the present invention. Referring to FIG. 3, the LED driving device 1 may include a light source unit 30 driven by direct current (DC) power and including first to nth LED groups G1, G2, . . . , Gn sequentially connected in series, and a driving control unit 20 having first to nth input terminals T1, T2, . . . , Tn connected to an output terminal of each of the first to nth LED groups G1, G2, . . . , Gn and controlling each of the first to nth input currents $I_{T1}$, $I_{T2}$ . . . , $I_{Tn}$ through first to nth current sensing signals generated by reflecting the first to nth input currents $I_{T1}$, $I_{T2}$ . . . , $I_{Tn}$ input to the first to nth input terminals T1, T2, . . . , Tn in predetermined proportions.

Here, reflecting the first to nth input currents in predetermined proportions may not mean that proportions of the currents are all equal, but mean that they are n×n numbers determined by combinations of respective input currents and respective current sensing signals. Details of the method for determining the proportions will be described later.

Also, the LED driving device 1 according to the present embodiment may further include a rectifying unit 10 converting alternating current (AC) power output from the outside into direct current (DC) power. Power converted into DC by the rectifying unit 10 may be input to the light source unit 30.

The rectifying unit 10 may rectify AC power (e.g., 220 VAC commercial AC power) applied from the outside, and may have a half-bridge structure or a full-bridge structure including one or more diodes. As for DC power output from the rectifying unit 10, the side of the rectifying unit 10 connected to the light source unit 30 is an output terminal having high potential, and the side of the rectifying unit 10 connected to the driving control unit 20 is an output terminal having low potential, and a current flows from the rectifying unit 10 to the driving control unit 20 through the light source unit 30. In the present embodiment, potential of the output terminal of the rectifying unit 10 connected to the driving control unit 20 is regarded as reference potential, i.e., ground GND. It is described that AC power input from the outside is full-wave rectified, but it would be obvious to a person skilled in the art that the present invention is also applicable to a case in which AC power is half-wave rectified.

Unlike the present embodiment, in the LED driving device 1, DC power may be supplied from a power source unit 100, rather than the rectifying unit 10 that converts AC power into DC power.

The power source unit 100 may be a storage battery or a rechargeable battery, or may be a DC power supply device including such a battery or may simply be a DC power source. Besides, the power source unit 100 may be a DC power source that generates electric energy from a different type of energy source such as a solar cell, a DC generator, or the like, and supplies the same, or a DC power supply device including the DC power source, or may be a DC power source that obtains DC power by rectifying AC power, or a DC power supply device including the same. Among output terminals of the power source unit 100, the side connected to the light source unit 30 is an output terminal having high potential, and the side connected to the driving control unit 20 is an output terminal having low potential, which is understood as reference potential, i.e., ground GND. Thus, a current flows from the power source unit 100 to the ground GND through the light source unit 30.

Thus, DC power described in the present embodiment may include an output voltage whose magnitude is periodically changed like a full-wave rectified sinusoidal waveform, as well as an output voltage whose magnitude is constant over time, and a DC power source in the present embodiment may be understood as a DC power supply device including a case in which magnitude of power is changed over time but a polarity thereof is constant, in a broad sense.

In the present embodiment, the light source unit 30 may include first to nth LED groups G1, G2, . . . , Gn sequentially connected in series, and the first to nth LED groups G1, G2, . . . , Gn may be connected to the first to nth input terminals T1, T2, . . . , Tn of the driving control unit 20, respectively. Each of the LED groups G1, G2, . . . , Gn constituting the light source unit 30 may include at least one LED, and may include LEDs having various types of electrical connection including a series connection, a parallel connection, and a serial-parallel connection (a mixture of a series connection and a parallel connection).

In an embodiment of the present invention, the light source unit is not limited to a particular form. Namely, the light source unit may be driven by a plurality of DC power sources, and may be further generalized as including a plurality of LED groups connected to the first to nth input terminals of the driving control unit and connected between first to nth output terminals of the light source unit. In this case, a current is input from the DC power source to the first to nth input terminals of the driving control unit through the plurality of LED groups included in the light source unit. A magnitude of a DC voltage, i.e., a driving voltage, for driving the plurality of LED groups existing between the DC power source and the output terminal of the light source unit may vary according to the DC power source and the output terminal of the light source unit.

Magnitudes of DC voltages required for driving the plurality of LED groups connected between a first DC power source, among a plurality of DC power sources, and the first to nth output terminals of the light source unit may be denoted as first to nth driving voltages VD11, VD21, . . . , VDn1, respectively, with respect to a first power source, and magnitudes of DC voltages required for driving the plurality of LED groups connected between a second DC power source and the first to nth output terminals of the light source unit may be denoted as first to nth driving voltages VD12, VD22, . . . , VDn2, respectively, with respect to a second power source. In the same manner, magnitudes of DC voltages required for driving the plurality of LED groups connected between an mth DC power source and the first to nth output terminals of the light source unit may be denoted as first to nth driving voltages VD1*m*, VD2*m*, . . . , VDnm, respectively, with respect to an mth power source. In a case in which the light source unit is driven by a single DC power source, magnitudes of DC voltages required for driving the plurality of LED groups connected between the DC power source and the first to nth output terminals of the light source unit may be denoted as first to nth driving voltages VD1, VD2, . . . , VDn, respectively.

Here, the light source unit may be simultaneously supplied with a current from a plurality of DC power sources or may be supplied with a current at different points in time. In the case in which a current is supplied at different points in time, for example, at a certain point in time, rectified DC power may have a voltage close to 0, so some LED groups may be driven by DC power having a rarely fluctuated voltage at the certain point in time. Meanwhile, in a case in which voltages supplied from a plurality of DC power sources are all sufficiently greater than the nth driving voltage, the light source unit may receive a current from the plurality of DC power sources to drive the plurality of LED groups. Here, the nth driving voltages VDn1, VDn2, . . . , VDnm supplied to the light source unit by the plurality of DC power sources may differ.

When the DC power supply voltage is greatly changed, the first to nth driving voltages may be set to be sequentially higher to correspond to a magnitude of the DC power supply voltage. The light source unit may include the first to nth LED groups G1, G2, . . . , Gn sequentially connected in series between the DC power source and the nth output terminal, and output terminals of the first to nth LED groups G1, G2, . . . , Gn may be connected to the first to nth output terminals of the light source unit, respectively. However, the present invention is not limited thereto.

In the embodiment of the LED driving device according to the present invention, the light source 30 is illustrated as being driven by a single DC power source, but the present invention is not limited thereto and the light source unit 30 may be driven by a plurality of different forms or types of DC power source. Thus, in an embodiment of the present invention, although it is described that the LED driving device is driven by a single DC power source and output terminals of the first to nth LED groups sequentially connected in series are connected to the first to nth input terminals of the driving control unit, respectively, it may merely illustrate an embodiment of the light source unit and describes the concept of the present invention therethrough, and the present invention is not limited thereto.

Figure 4A:
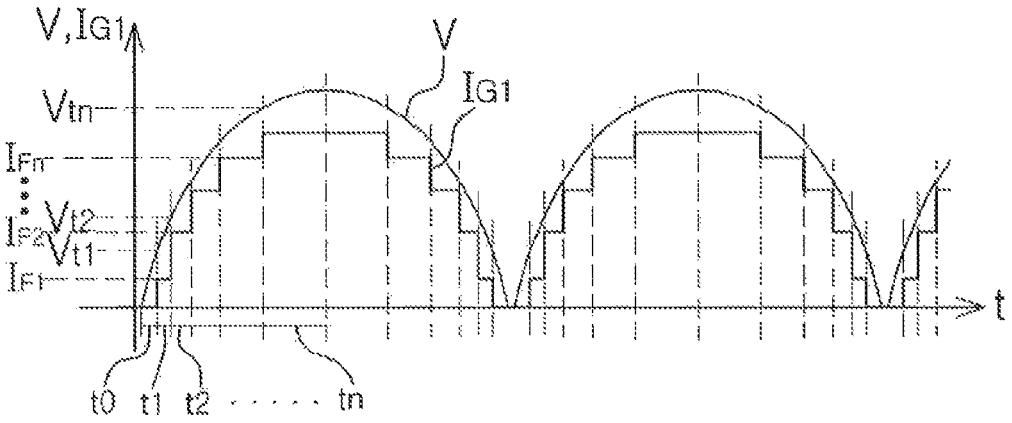
FIG. 4 is a view schematically illustrating waveforms of currents applicable to the LED driving device according to an embodiment of the present invention.
Figure 4B:
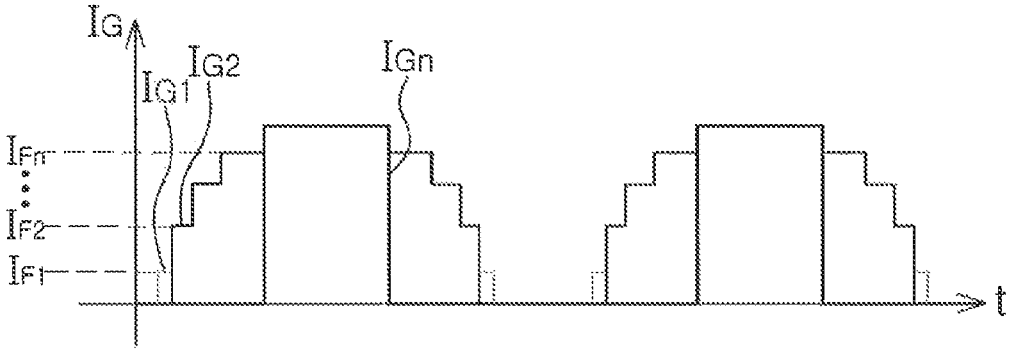
Figure 4C:
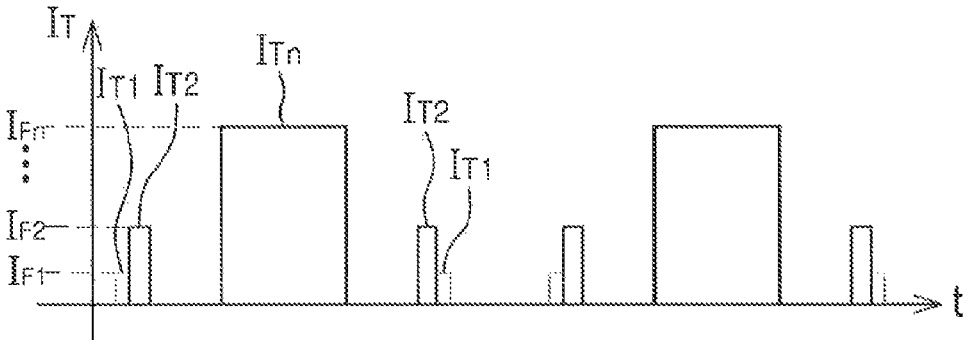

FIG. 4 is a view schematically illustrating waveforms of currents applicable to the LED driving device according to an embodiment of the present invention. Specifically, FIG. 4A illustrates a waveform of a DC source voltage V rectified by the rectifying unit 10 and input to the light source unit 30 and a waveform of a first current $I_{G1}$, simply, a driving current ($I_G=I_{G1}$), flowing in the first LED group G1. FIG. 4B schematically illustrates waveforms of currents ($I_{G1}, I_{G2}, \ldots, I_{Gn}$) flowing in the first to nth LED groups G1, G2, . . . , Gn. FIG. 4C schematically illustrates waveforms of first to nth input currents ($I_{T1}, I_{T2}, \ldots, I_{Tn}$) input to the respective input terminals T1, T2, . . . , Tn of the driving control unit 20.

First, referring to FIGS. 3 and 4(*a*), the DC source voltage V rectified by the rectifying unit 10 and input to the light source unit 30 has a shape of a full-wave rectified sinusoidal wave, and the first LED group G1 connected to and positioned to be nearest to the output terminal of the rectifying unit 10 may have a waveform of a current close to the waveform of the rectified DC source voltage V as illustrated in FIG. 4A. Namely, since the waveform $I_{G1}$ of the current input to the first LED group G1 is close to the full-wave rectified sinusoidal wave, a power factor is improved and a magnitude of a harmonic wave component can be reduced. Here, the shape of the waveform denoting the current $I_{G1}$ of the first LED group G1 has been designed in advance according to the rectified DC source voltage V. Specifically, the driving current ($I_G=I_{G1}$) flowing in the light source unit 30 may have first to nth current levels ($I_{F1}, I_{F2}, \ldots, I_{Fn}$) in first to nth driving sections t1, t2, . . . , tn. In the present embodiment, it is illustrated that the amount of the plurality of LED groups G1, G2, . . . , Gn and the amount of the current levels denoted by the first LED group G1 are equal, but the present invention is not limited thereto and a plurality of continued driving sections may have the same current level or a single driving section may have a plurality of current levels.

In detail, when the DC source voltage V is lower than a minimum voltage Vt1 by which the first LED group G1 positioned to be nearest to the rectifying unit 10 can be driven, namely, when the DC source voltage V is in a non-driven section to, a current cannot flow to any one of the first to nth LED groups G1, G2, . . . , Gn. When the DC source voltage V is higher than the minimum voltage Vt1 at which the first LED group G1 can be driven and lower than a minimum voltage Vt2 at which both the first and second LED groups G1 and G2 can be driven, namely, when the DC source voltage V is in the first driving section t1, the driving control unit 20 may provide control to allow the first input current $I_{T1}$ to be input to the first input terminal T1, so the driving current $I_{G1}$ flowing in the first LED group G1 is the same as the current $I_{T1}$ input to the first input terminal T1 of the driving control unit 20.

Next, when the DC source voltage V is higher than the minimum voltage Vt2 at which both the first and second LED groups G1 and G2 can be driven and lower than a minimum voltage at which all of the first to third LED groups G1, G2, and G3 can be driven, namely, when the DC source voltage V is in the second driving section t2, the driving control unit 20 may cut off a current input to the first input terminal T1 and provide control to allow the second input current $I_{T2}$ to be input to the second input terminal T2, so a driving current ($I_{G1}=I_{G2}=I_{T2}$) having the same magnitude as that of the second input current $I_{T2}$ may flow to the first and second LED groups G1 and G2. In the same manner, in the nth driving section tn in which a magnitude of the DC source voltage V is the greatest, the driving control unit 20 cuts off a current input to the first to (n−1)th input terminals T1, T2, . . . , Tn−1, and provides controlling to allow the nth input current (I) to be input to the nth input terminal Tn, whereby the nth input current ($I_{Tn}=I_{G1}=I_{G2} \ldots =I_{Gn}$) flows to the first to nth LED groups G1, G2, . . . , Gn, and thus, the first LED group G1 positioned to be nearest to the power source unit 10 may have a current ($I_{G1}$) waveform the same as that illustrated in FIG. 4A.

Here, the first to nth driving sections t1, t2, . . . , tn may be understood as corresponding to the amount of the LED groups connected sequentially in series and driven by the DC source voltage V. In case of driving the LED groups according to a change in the DC source voltage V, a current is regulated to flow along a path including as many LED groups as possible in each driving section, thus minimizing power required for obtaining predetermined optical power. In this embodiment, a path of a current is determined to increase power efficiency to the maximum in each driving section.

Waveforms of the first to nth currents ($I_{G1}, I_{G2}, \ldots, I_{Gn}$) flowing in the respective LED groups G1, G2, . . . , Gn will be described with reference to FIG. 4B. The first LED group G1 is driven in the first to nth driving sections (t1, t2, . . . , tn), so it has the same waveform as that of the first current $I_{G1}$ of FIG. 4A. Meanwhile, the second LED group G2 cannot be driven in the first driving section t1 and may be driven only in the second to nth driving sections t2, . . . , tn, so it has a current waveform the same as that of the first current $I_{G1}$ in the regions excluding the first driving section t1. Similarly, the nth LED group Gn can be driven only in the nth driving section tn, it may have a current waveform the same as that of the nth current $I_{Gn}$ illustrated in FIG. 4B.

Meanwhile, in order to make the first to nth LED group G1, G2, . . . , Gn have the current waveform illustrated in FIG. 4B, a magnitude of a current input to the first to nth input terminals T1, T2, . . . , Tn of the driving control unit 20 and a driving point in time thereof may be controlled, as illustrated in FIG. 4C. Referring to FIG. 4C, by controlling a first input current $I_{T1}$ to be input to the first input terminal T1 of the driving control unit 20 in the first driving section t1, a second input current $I_{T2}$ to be input to the second input terminal T2 in the second driving section t2, and the nth input current $I_{T2}$ to be input to the nth input terminal Tn in the nth driving section tn, the first, second, and nth input currents $I_{T1}$, $I_{T2}$, and $I_{Tn}$ may be driven in the first LED group G1, the first and second LED groups G1 and G2, and the first to nth LED groups G1, G2, . . . , Gn, respectively, in the respective driving sections.

Figure 5A:
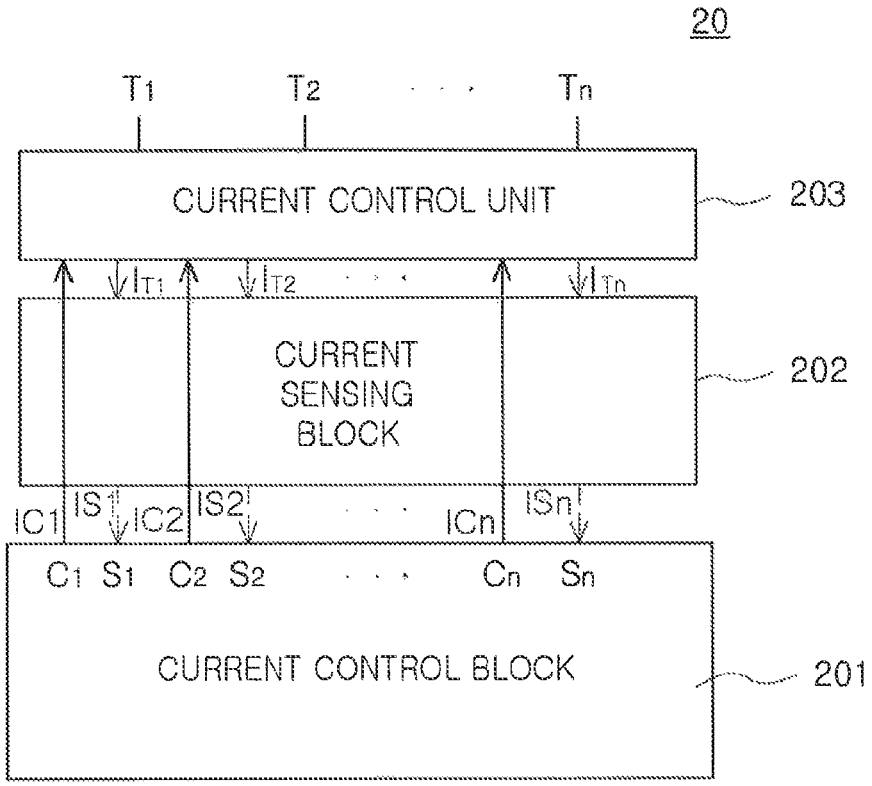
FIG. 5 is a block diagram of a driving control unit applicable to the LED driving device according to an embodiment of the present invention.

FIG. 5A is a block diagram of a driving control unit applicable to the LED driving device according to an embodiment of the present invention.

Referring to FIG. 5A, the driving control unit 20 according to the present embodiment may include a current control block 201 generating a signal for controlling a magnitude and a path of a current input to the driving control unit 20, a current sensing block 202 generating first to nth current sensing signals $IS_1$, $IS_2$, . . . , $IS_n$ reflecting all of the first to nth input currents $I_{T1}$, $I_{T2}$, . . . , $I_{Tn}$ input to the driving control unit 20 in predetermined proportions, and a current control unit 203 adjusting a magnitude of the first to nth input currents $I_{T1}$, $I_{T2}$, . . . , $I_{Tn}$ input to the first to nth input terminals T1, T2, . . . , Tn of the driving control unit 20 according to first to nth control signals IC1, IC2, . . . , ICn output from the current control block 201 receiving the first to nth current sensing signals from the current sensing block 202.

In the present embodiment, the current control unit 203 may include first to nth current control units (not shown) connected to the first to nth input terminals of the driving control unit 20 and controlling the first to nth input currents $I_{T1}$, $I_{T2}$, . . . , $I_{Tn}$ input to the first to nth input terminals of the driving control unit 20 according to the first to nth control signals IC1, IC2, . . . , ICn, respectively.

Figure 5B:
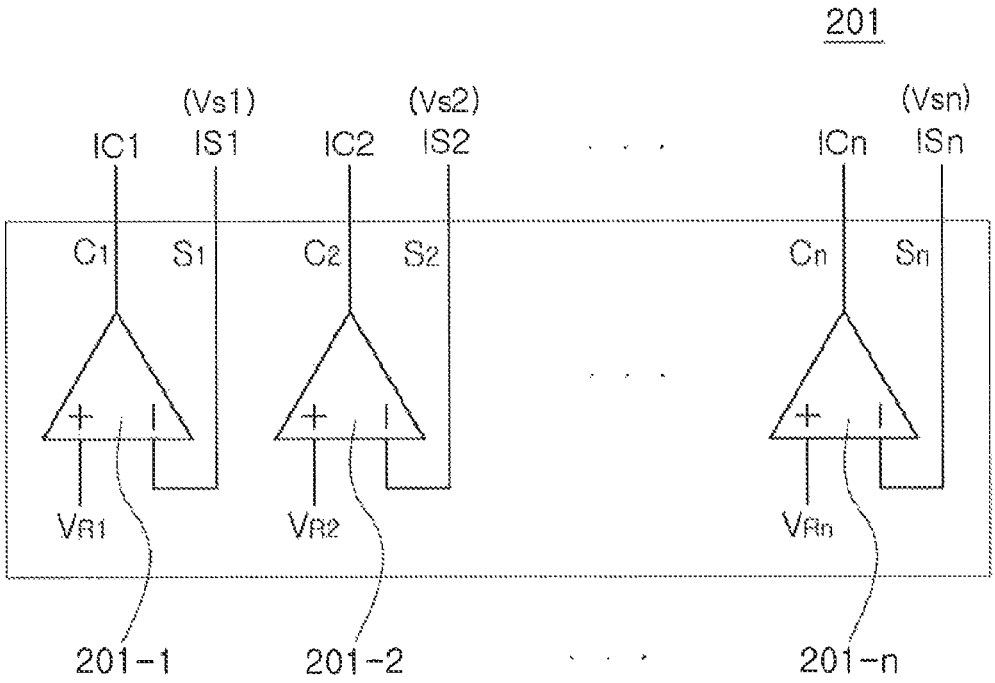

Meanwhile, FIG. 5B illustrates an embodiment of the current control block 201 applicable to the driving control unit 20 illustrated in FIG. 5A. Referring to FIG. 5B, the current control block 201 may include first to nth controllers 201-1, 201-2, . . . , **201-*n* receiving the first to nth current sensing signals IS1, IS2, . . . , ISn, comparing the received first to nth current sensing signals IS1, IS2, . . . , ISn with respective reference signals VR1, VR2, . . . , VRn, and outputting the first to nth control signals IC1, IC2**, . . . , ICn such that they are equal, respectively.

In detail, the first to nth controllers 201-1, 201-2, . . . , **201-*n* may receive the first to nth reference signals VR1, VR2, . . . , VRn by non-inverting positive (+) input terminals, and receive the first to nth current sensing signals IS1, IS2**, . . . , ISn by inverting negative (−) input terminals, respectively. Also, each controller may output a control signal proportional to a difference between the two input signals, namely, the signal input to the non-inverting positive (+) input terminal and the signal input to the inverting negative (−) input terminal, to thus make magnitudes of the two input signals equal. Here, the current control unit may be regarded as a unit for increasing a magnitude of an input current in proportion to a magnitude of the control signal, and a form of the control signal is not limited to a current or a voltage and may vary according to a current control unit that receives it. A specific embodiment of the current control unit will be described later.

In the present embodiment, a current sensing signal and a reference signal are the same type of signals, so they have the same unit. Namely, when the current sensing signal has a voltage form, the reference signal also has a voltage form, and in this case, the current sensing signal and the reference signal will be referred to as a current sensing voltage and a reference voltage. The first to nth reference signals (or voltages) input to the first to nth controllers 201-1, 201-2, . . . , **201-*n* are directly related to magnitudes of the currents, i.e., first to nth current levels, input to the first to nth input terminals T1, T2**, . . . , Tn, respectively. Thus, although they are simply referred to as the reference signals (or voltages) of the first to nth input terminals or the first to nth reference signals (or voltages), they are understood as meaning the same.

Referring back to FIG. 5A, the first to nth input currents $I_{T1}$, $I_{T2}$, . . . , $I_{Tn}$ input to the first to nth input terminals T1, T2, . . . , Tn from the output terminals of the first to nth LED groups G1, G2, . . . , Gn are all delivered to the current sensing block 202, and thus, the first to nth current sensing signals IS1, IS2, . . . , ISn input to the current control block 201 may be generated by reflecting respective currents input through the first to nth input terminals T1, T2, . . . , Tn of the driving control unit 20 in predetermined proportions.

In detail, the current sensing block 202 may generate the first to nth current sensing signals IS1, IS2, . . . , ISn reflecting all of the first to nth input currents $I_{T1}$, $I_{T2}$, . . . , $I_{Tn}$ input to the first to nth input terminals of the driving control unit 20 from the respective output terminals of the first to nth LED groups G1, G2, . . . , Gn in predetermined proportions, and output the generated first to nth current sensing signals IS1, IS2, . . . , ISn to the current control block 201.

Namely, it is not that a current flowing to the first input terminal T1 of the driving control unit 20 from the output terminal of the first LED group G1 is sensed and a signal corresponding to the current is output to the first input terminal S1 of the current control block 201, but that current sensing signal generated by reflecting all of the input currents input to the first to nth input terminals T1, T2, . . . , Tn of the driving control unit 20 from the respective output terminals of the first to nth LED groups G1, G2, . . . , Gn in predetermined proportions is output to the first input terminal S1 of the current control block 201.

In more detail, the current sensing block 202 inputs the first to nth current sensing signals IS1, IS2, . . . , ISn reflecting all of the input currents $I_{T1}$, $I_{T2}$, . . . , $I_{Tn}$ flowing to the first to nth input terminals T1, T2, . . . , Tn of the driving control unit 20 from the respective output terminals of the first to nth LED groups G1, G2, . . . , Gn in predetermined proportions, to the first to nth input terminals S1, S2, . . . , Sn of the current control block 201. Here, the current sensing signals IS1, IS2, . . . , ISn input to the current control block 201 may be represented by Equation (1) to Equation (3).

$$IS1=I_{T1}\times c11+I_{T2}\times c12 \ldots +I_{Tn}\times c1n \quad (1)$$

$$IS2=I_{T1}\times c21+I_{T2}\times c22 \ldots +I_{Tn}\times c2n \quad (2)$$

. . .

$$ISn=I_{T1}\times cn1+I_{T2}\times cn2 \ldots +I_{Tn}\times cnn \quad (3)$$

Here, c11 to c1*n*, c21 to c2*n*, and cn1 to cnn are specific symbols denoting the predetermined proportions, which are n×n number of values determined for combinations of the respective input currents $I_{T1}$, $I_{T2}$, . . . , $I_{Tn}$ and respective current sensing signals IS1, IS2, . . . , ISn. The current sensing block 202 may be implemented by various means, and the predetermined proportions may be uniquely determined according to an implemented current sensing block.

In a case in which the current sensing block 202 is configured to include only a linear resistor(s), all of c11 to cnn may be denoted by a real number greater than 0, and in a case in which the current sensing block 202 is configured to include a passive device such as a capacitor or an inductor, each of the c11 to cnn may be expressed as a complex number, having a positive number of real part. In a case in which the current sensing block 202 is configured by using a linear circuit including an active device, c11 to cnn may be expressed in the form of a complex number, and in case of using the linear circuit, some of c11 to cnn may be 0. This means that all of the input currents are reflected in predetermined proportions, but certain current sensing signals may be generated by reflecting only some input currents. Here, the unit of c11 to cnn is omitted, but when the current sensing signals, i.e., IS1 to ISn, are voltages, the unit of the predetermined proportions may be the same as that of resistance, and in case of a current, there is no unit. Thus, the unit of the predetermined proportions varies according to the unit, i.e., a type, of the current sensing signals.

In addition, the current sensing block 202 may be configured to include a non-linear device or circuit. The non-linear device may be a passive device, but in general, it is an active device. Here, c11 to cnn may not be indicated as fixed values, and may be expressed as a function of the first to nth input currents $I_{T1}, I_{T2}, \ldots, I_{Tn}$ as shown in Equation (4) to Equation (6).

$$IS1=C11(I_{T1})+C12(I_{T2})\ldots+C1n(I_{Tn}) \quad (4)$$

$$IS2=C21(I_{T1})+C22(I_{T2})\ldots+C2n(I_{Tn}) \quad (5)$$

$$\ldots$$

$$ISn=Cn1(I_{T1})+Cn2(I_{T2})\ldots+Cnn(I_{Tn}) \quad (6)$$

Thus, a linear circuit may be used in a particular case, among the cases of using a nonlinear circuit, in which a function form of C11($I_{T1}$) to Cnn($I_{Tn}$) is a polynomial equation in which coefficients of terms other than the term of degree 1 are all 0, and a case of configuring a current sensing block only with a resistor belongs to a particular case in which coefficients of the term of degree 1 are all positive real numbers, among the cases of using the linear circuit. Thus, in the following embodiment, although it is described that a current sensing block is configured by using only resistors, the present invention is not limited thereto and, as described above, the current sensing block may be considered to be configured to include a nonlinear element and a circuit.

As a means for reflecting all of the currents flowing from the output terminals of the first to nth LED groups G1, G2, . . . , Gn to the first to nth input terminals T1, T2, . . . , Tn of the driving control unit 20 in predetermined proportions, namely, as a means implementing c11 to cnn, a linear resistor may be applied, and the current sensing signals IS1, IS2, . . . , ISn may be output in the form of a voltage. Here, the current sensing block 202 may be implemented including one or more current sensing resistors reflecting all of the currents input to the first to nth input terminals T1, T2, . . . , Tn of the driving control unit 20 in predetermined proportions, and first to nth current sensing voltages Vs1, Vs2, . . . , Vsn generated by the current sensing block 202 may be input to the respective input terminals S1, S2, . . . , Sn of the current control block 201. Here, the first to nth current sensing voltages Vs1, Vs2, . . . , Van may be represented by Equation (7) to Equation (9) as follows.

$$Vs1=I_{T1}\times R11+I_{T2}\times R12\ldots+I_{Tn}\times R1n \quad (7)$$

$$Vs2=I_{T1}\times R21+I_{T2}\times R22\ldots+I_{Tn}\times R2n \quad (8)$$

$$\ldots$$

$$Vsn=I_{T1}\times Rn1+I_{T2}\times Rn2\ldots+I_{Tn}\times Rnn \quad (9)$$

Here, R11 to R1*n*, R21 to R2*n*, and Rn1 to Rnn are specific symbols denoting the foregoing predetermined proportions, which are n×n number of resistance values determined for each combination of the respective input currents $I_{T1}$, $I_{T2}$, . . . , $I_{Tn}$ and respective current sensing voltages Vs1, Vs2, . . . , Vsn. Also, the predetermined proportions may be determined to be specific according to the current sensing block implemented by using a linear resistor.

Hereinafter, although the current block is implemented with a linear resistor, it is merely for the purpose of description and the present invention is not limited thereto, unless otherwise mentioned.

Meanwhile, the current control block 201 may control a magnitude of a current input to the first input terminal T1 connected to the output terminal of the first LED group G1 by using the first current sensing signal IS1 input to the first input terminal S1. Similarly, a magnitude of each of currents $I_{T2}$, . . . , $I_{Tn}$ input to the second to nth input terminals T2, . . . , Tn of the driving control unit 20 may be controlled upon receiving the second to nth current sensing signals IS2, . . . , ISn generated by the current sensing block 202. In other words, a magnitude of each of the input currents $I_{T1}$, $I_{T2}$, . . . , $I_{Tn}$ input to the first to nth input terminals T1, T2, . . . , Tn of the driving control unit 20 from the output terminal of each of the first to nth LED groups G1, G2, . . . , Gn may be independently controlled through the first to nth current sensing signals IS1, IS2, . . . , ISn input to the first to nth input terminals, S1, S2, . . . , Sn of the current control block 202.

Also, in the present embodiment, in order for the light source unit 30 including the first to nth LED groups G1, G2, . . . , Gn to be driven to have the current waveforms illustrated in FIG. 4, the first to nth input currents $I_{T1}$, $I_{T2}$, . . . , $I_{Tn}$ input to the first to nth input terminals T1, T2, . . . , Tn should be controlled to be input to one of the first to nth input terminals T1, T2, . . . , Tn according to a change in the driving section t1, t2, . . . , tn. Namely, the first to nth input currents $I_{T1}, I_{T2}, \ldots, I_{Tn}$ should be controlled to be input to the first input terminal T1 in the first driving section, and controlled to be input to the second input terminal T2 in the second driving section t2, and with respect to each driving section, a current input to any other input terminals that may be driven by a current than a determined input terminal should be prevented. For example, a current input to driving-available input terminals T1, T2, . . . , Tn-1, other than the nth input terminal Tn, should be prevented when the DC source voltage V is in the nth driving section tn. Such an operation of changing a path of a current according to a change in a driving section may also be performed by independently controlling respective currents input to the first to nth input terminals T1, T2, . . . , Tn of the driving control unit 20 according to the first to nth current sensing signals IS1, IS2, . . . , ISn reflecting all of the currents input to the first to nth input terminals of the driving control unit 20 from the output terminals of the respective first to nth LED groups G1, G2, . . . , Gn in predetermined proportions.

In detail, the DC source voltage V input to the light source unit 30 when the DC source voltage V is in the first driving section t1 only has a magnitude sufficient for driving the first LED group G1, so the driving current $I_{G1}$, which has passed through the first LED group G1, is input to the first input terminal T1 and no current is input to the second to nth input terminals T2, . . . , Tn ($I_{T2}$= . . . =$I_{Tn}$=0). Thus, the first to nth current sensing signals input to the respective input terminals of the current control block 201 may be expressed as Vs1=$I_{T1}$×R11, Vs2=$I_{T1}$×R21, . . . , Vsn=$I_{T1}$×Rn1. Here, the current control block 201 may control the first current sensing signal Vs1 to be equal to the first reference signal VR1, whereby the first input current $I_{T1}$ input to the first input terminal T1 of the driving control unit 20 may have a level equal to a current level $I_{F1}$. Namely, the current control block 201 may control the input current $I_{T1}$ such that the driving current $I_{G1}$ flowing in the first LED group G1 satisfies $I_{G1}$=$I_{T1}$=$_{F1}$=Vs1/R11=VR1/R11, and in this case, the second sensing signal Vs2 is obtained as Vs2=$I_{T1}$×R21=VR1×R21/R11.

Next, in the second driving section t2 in which the DC source voltage V sufficient for driving the first and second LED groups G1 and G2, in order to control a current such that a current input to the first input terminal T1 of the driving control unit 20 is cut off and a current is only input to the second input terminal T2, the second reference signal VR2 may be set to have a magnitude greater than that of the second current sensing signal (Vs2=$I_{F1}$×R21=VR1×R21/R11) obtained when the first input current $I_{T1}$ is input at a first current level $I_{F1}$. In this case, when the current $I_{T2}$ input to the input terminal T2 having a higher degree is increased according to an increase in the DC source voltage V, a current input to the input terminal T1 having a lower degree is gradually decreased to reach a state in which no current flows, and thus, the first input current $I_{T1}$ may be completely cut off by the second input current $I_{T2}$ in the second driving section t2. Similarly, all of the first to (n−1)th input currents $I_{T1}$, $I_{T2}$, . . . , $I_{Tn-1}$ input to the first to (n−1)th input terminals are cut off by the nth input current $I_T$ in the nth driving section tn, so the first to nth LED groups G1, G2, . . . , Gn may be driven to have the current waveforms illustrated in FIG. 4.

Here, the degree related to the present invention will be summarized. A degree of LED groups sequentially connected to the DC power source may be regarded as corresponding to the amount of LED groups between the power source unit 100 and the output terminals of the respective LED groups. Also, a degree of input terminals of the driving control unit 20 is equal to the degree of the LED groups to which the respective input terminals connected. Namely, when the first and second LED groups are connected sequentially to the DC power source, a degree of the first LED group directly connected to the DC power source is 1, and a degree of the second LED group connected to the output terminal of the first LED group in series is 2. Also, a degree of the first input terminal of the driving control unit 20 connected to the output terminal of the first LED group is 1. Hereinafter, when a particular input terminal of a particular LED group or that of the driving control unit 20 is mentioned, it will be referred to as a first driving section t1, a first LED group, a first input terminal T1, or a first input current $I_{T1}$ by putting a degree in front thereof, unless otherwise mentioned. Also, in describing an operational principle of the LED driving device according to an embodiment of the present invention by applying a degree, the LED driving device may be generalized as controlling the nth input current, input to the nth input terminal of the driving control unit 20 from the output terminal of the nth LED group, to have nth current level when the DC source voltage V is in the nth driving section tn.

The process in which a path of the current is changed to an input terminal having a higher degree may be understood such that an input terminal having a higher degree is driven to allow a current to be exclusively input thereto with higher priority over an input terminal having a lower degree. Here, when an input terminal Tn has higher priority than the other input terminals T1, . . . , Tn-1, it means that the input terminal Tn having higher priority may drive a current up to a current level $I_{Fn}$ of the input terminal Tn, regardless of a driving current driven by the other input terminals T1, . . . , Tn-1 having lower priority, and in case of an input terminal having lower priority, a driving current to the corresponding input terminal is reduced as the current flowing to the input terminal Tn having higher priority is increased. When a current is exclusively driven, it means that a driving current to the input terminal Tn having higher priority is increased and when a current level thereof reaches a predetermined level or higher, the other input terminals T1, . . . , Tn-1 having lower priority cannot drive a current. A principle of giving priority for exclusively driving a current to respective input terminals T1, T2, . . . , Tn will be described in detail.

First, in order for the first input terminal T1 to have the lowest priority, a current should be input to all remaining input terminals T2, . . . , Tn when the first input terminal T1 drives a current with the first current level $I_{F1}$. In order to satisfy this condition, all of the second to nth current sensing signals Vs2, . . . , Vsn generated when the current having the first current level $I_{F1}$ is driven to the first input terminal T1 should be lower than the respective reference signals VR2, . . . , VRn. Namely, {R21×$I_{F1}$}<VR2 to {Rn1×$I_{F1}$}<VRn should be satisfied. Here, the second to nth input terminals T2, . . . , Tn may allow a current to flow, taking precedence over the first input terminal Tn. In order for the second to nth input terminals T2, . . . , Tn to have exclusive priority for exclusively driving a current over the first input terminal T1, when a current having a pre-set current level $I_{F2}$ to $I_{Fn}$ flows to any one of the second to nth input terminals T2, . . . , Tn having higher priority, the first current sensing signal Vs1 input to a first controller (please see FIG. 5B) should be greater than the first reference signal VR1. Namely, VR1<{R12×$I_{F2}$} to VR1<{R1*n*×$I_{Fn}$} should be satisfied. In this case, the first current sensing signal Vs1 input to the inverting negative (−) input terminal of the first controller is greater than the first reference signal VR1 input to the non-inverting positive (+) input terminal of the first controller (VR1<Vs1), and thus, a current of the first input terminal T1 may be completely cut off by the operation of the first controller.

In order for the third to nth input terminals T3, . . . , Tn to have exclusive higher priority over the second input terminal T2, the same process may be repeatedly performed on the remaining input terminals T2, . . . , Tn, excluding the first input terminal T1. Namely, {R32×$I_{F2}$}<VR3 to {Rn2×$I_{F2}$}<VRn should be satisfied, and VR2<{R23×$I_{F3}$} to VR2<(R2*n*×$I_{Fn}$) should also be satisfied. In the same manner, when the condition for setting exclusive priority for two terminals having the highest priority finally, namely, {Rn(n−1)×$I_{Fn-1}$}<VRn and VR(n−1)<{R(n−1)n×$I_{Fn}$}, are satisfied, giving priority to all of the input terminals for exclusively driving a current in order of T1<T2 . . . <Tn is completed. Thus, the process of giving priority for exclusively driving a current provided to each input terminal may be understood as a process of configuring first to nth current sensing signals and first to nth reference signals satisfying all of the foregoing conditions to meet the pre-set priority.

When the conditions for guaranteeing exclusive priority proposed as described above are applied to two input terminals A and B and generalized, Equation (10) and Equation (11) are obtained. In this case, however, the input terminal B is regarded as having higher exclusive priority over the input terminal A (A<B). Here, a and b are degrees of the input terminals A and B.

$$\{R[b][a]\times I_{F[a]}\}<VR[b] \quad (10)$$

$$VR[a]<\{R[a][b]\times I_{F[b]}\} \quad (11)$$

Here, symbols in square brackets [ ] represent degrees. Namely, when a=1 and b=2, R[b][a] represents R21, $I_{F[a]}$ represents the first current level $I_{F1}$, and VR[b] represents the second reference signal VR2.

Equation (10) and Equation (11) should be established for every combination of a and b for which exclusive priority should be guaranteed. Here, Equation (10) is a condition for guaranteeing priority between two input terminals, and Equation (11) is a condition further required to guarantee exclusivity.

Although priority or exclusive priority between the input terminals is expressed as priority or exclusive priority between the input currents, they have the same meaning. Namely, when the second input terminal drives a current by having exclusive priority over the first input terminal, it may be understood as having the meaning that the second input current has exclusive priority over the first input current.

The principle of implementing exclusive priority may be summed up as follows. That is, even in a state that the input current $I_{F1}$ having lower priority and having a pre-set current level $I_{F1}$ flows, the input currents $I_{T2}$, . . . , $I_{Tn}$ having higher priority are allowed to be input any time, and currents of all of the input terminals T2, . . . , Tn having higher priority are sensed to act as a signal for reducing or interrupting a current of the input terminal T1 having lower priority. During this process, when a current starts to flow to a new input terminal having higher priority (T1→T2), the current $I_{T1}$ of the input terminal having lower priority is gradually decreased and eventually interrupted, and when the DC source voltage V is further increased, a current of the new input terminal T2 having higher priority is increased up to a current level $I_{F2}$ intended for driving, and thereafter, the current level $I_{F2}$ and a path are maintained during the new driving section t2 according to an operation of a controller. In a case in which the DC source voltage V is decreased, the reverse process is repeated and a current flows along a new path.

In this embodiment, an input terminal having higher degree may be given higher priority, whereby a current may be driven through a path including the largest amount of LED groups that can be driven in each driving section. Also, in a boundary of two driving sections, a current may be controlled to be gradually changed through a new path according to a change in a DC source voltage V. Thus, the LED driving method based on exclusive priority may increase power efficiency, and since a current is not rapidly changed during a process in which a current path is changed, optical power can be stably maintained.

Also, even when electrical characteristics of the light source unit 30, namely, a voltage-current relationship, are slightly changed, only a driving section is slightly changed, and since the driving control unit may operate upon reflecting a changed driving section, a lighting device is not greatly affected. Thus, this embodiment may be applicable even in a case in which a rated voltage of the LEDs has a relatively great distribution, and even in the case that the rated voltage is changed according to a change in a temperature while the LEDs are in use, such a change does not significantly affect an operation of the lighting device, and thus, this embodiment may be used within a wide temperature range without having to compensate for an influence due to a change in a temperature. Although the LED driving device has high capacity to stabilize the DC source voltage, it does not need an electrolyte capacitor having a short lifespan, obtaining an effect of increasing a lifespan thereof.

So far, the principle and conditions for setting exclusive priority based on the current sensing block regarded as being implemented with a linear resistor have been described, but the present invention is not limited thereto. Extending even to a case of configuring a current sensing block including a non-linear element or circuit, the conditions for setting exclusive priority for driving a current between input terminals are very similar to the case of using a linear current sensing block. Here, the non-linear element or circuit may include a passive element or an active element. In case of a passive element, a non-linear resistor may be applied as an example, and in case of an active element, various elements such as a diode, a transistor such a BJT, a MOSFET, or the like, a logic gate such as a NAND, a NOR, and the like, may be applied.

In a case in which a current sensing block is configured to include a non-linear element or circuit, in order for a first input current $I_{T1}$ to have the lowest exclusive priority, R21($I_{F1}$)<VR2 to Rn1($I_{F1}$)<VRn and VR1<R12($I_{F2}$) to VR1<R1*n*($I_{Fn}$) should be entirely satisfied, and in order for the second input current $I_{T2}$ to have the second lowest exclusive priority, similarly, R32($I_{F2}$)<VR3 to Rn2($I_{F2}$)<VRn and VR2<R23($I_{F3}$) to VR2<R2*n*($I_{Fn}$) should be satisfied. In the same manner, in order for the (n−1)th input current $I_{Tn-1}$ to have exclusive priority lower than that of the nth input current $I_{Tn}$, Rn(n−1) ($I_{Fn-1}$)<VRn and VR(n−1)<R(n−1)n($I_{Fn}$) should be satisfied. In this manner, even when a non-linear current sensing block is configured to include a non-linear element or circuit, conditions for setting priority for exclusively driving an input current among respective input terminals can be proposed. Here, R11($I_{T1}$) to Rnn($I_{Tn}$) are functions using first to nth input currents $I_{T1}$, $I_{T2}$, . . . , $I_{Tn}$ as input variables, and outputs of the respective functions correspond to magnitudes of respective input variables contributing to current sensing signals IS1, IS2, . . . , ISn. In this case, the conditions proposed in the above are to provide higher exclusive priority to the respective input terminals T1, T2, . . . , Tn in order of T1 <T2 . . . <Tn.

In the case in which the current sensing block is configured to include a non-linear element or circuit, when the conditions for guaranteeing exclusive priority proposed as described above are applied to the two input terminals A and B and generalized, Equation (12) and Equation (13) can be obtained. In this case, the input terminal B is regarded as having higher exclusive priority over the input terminal A (A<B). Here, a and b are degrees of the input terminals A and B.

$$R[b][a](I_{F[a]})<VR[b] \quad (12)$$

$$VR[a]<R[a][b](I_{F[b]}) \quad (13)$$

Here, symbols in square brackets [ ] represent a degrees. Namely, when a=1 and b=2, R[b][a] represents R21, $I_{F[a]}$ represents the first current level $I_{F1}$, and VR[b] represents the second reference signal VR2.

Equation (12) and Equation (13) should be established for every combination of a and b for which exclusive priority should be guaranteed. Here, Equation (12) is a condition for guaranteeing priority between two input terminals, and Equation (13) is a condition further required to guarantee exclusivity.

In addition, conditions for securing exclusive priority between the two input terminals A and B may be organized as follows. Whether exclusive priority is guaranteed for the two input terminals may be known by determining whether a relationship is established when the two input terminals A and B are applied to Equation (10) and Equation (11).

First, a case in which exclusive priority is determined based on a reference signal will be described. Conditions for the input terminal B having a reference signal higher than that of the input terminal A to have higher exclusive priority over the input terminal A are as follows.

$$VRA<VRB \quad (A1)$$

$$VsA=VsB=I_A\times R1+I_B\times R2+\ldots \quad (A2)$$

Here, VRA and VRB are reference signals for controlling a current of the input terminals A and B, respectively. VsA and VsB are current sensing signals for controlling currents from the input terminals A and B. $I_A$ and $I_B$ are currents input to the input terminals A and B, respectively. Magnitudes of currents, i.e., current levels of currents, input to the input terminals A and B are indicated as $I_{FA}$ and $I_{FB}$. Also, the omission mark ( . . . ) in Equation (A2) indicates that other input currents may be further reflected in the current sensing signals of the two input terminals A and B.

When the conditions A1 and A2 are summed up, the reference signal VRB of the input terminal B should be greater than the reference signal VRA of the input terminal A, and the current sensing signals VsA and VsB of the input terminals A and B should be equal. In this case, since the reference signals have relationships VRA=$I_{FA}$×R1 and VRB=$I_{FB}$×R2, respectively, the $I_{FA}$ and $I_{FB}$ are determined by VRA and R1 and VRB and R2, respectively.

When Equation (A2) defining relationships between the currents $I_A$ and $I_B$ from the two input terminals A and B and the current sensing signals and Equation (A1) defining the relationships between the reference signals are applied to Equation (10), {R1×$I_{FA}$}<VRB is obtained, and when Equation (A2) and Equation (A1) are applied to Equation (11), VRA<{R2×$I_{FB}$} is obtained. As for {R1×$I_{FA}$}<VRB, since VRA=R1×$I_{FA}$, it can be expressed as {VRA=R1×$I_{FA}$}<VRB, and when the condition of VRA<VRB is met, the relational expression is satisfied. Also, as for VRA<{R2×$I_{FB}$}, since VRB=R2×$I_{FB}$, it can be expressed as VRA<{VRB=R2×$I_{FB}$}, and when VRA<VRB is met, the relational expression is also established. Thus, it can be seen that, in the case of the two input terminals A and B satisfying Equation (A1) and Equation (A2), the input terminal B satisfies all of the conditions for having exclusive priority over the input terminal A. Here, {V1=V2}<{V3=V4}represents that relationships V1=V2, V3=V4, V1<V3, V1<V4, V2<V3 and V2<V4 are all established.

Hereinafter, a case in which exclusive priority is determined by a current level will be described. Conditions for the input terminal B having a higher current level to have higher exclusive priority over the input terminal A are as follows.

$$I_{FA}<I_{FB} \quad (B1)$$

$$VsA=I_A\times R1+I_B\times R1+\ldots \quad (B2)$$

$$VsB=I_A\times R2+I_B\times R2+\ldots \quad (B3)$$

The conditions may be summarized as follows: A level $I_{FB}$ of the current input to the input terminal B should be higher than a level $I_{FA}$ of the current input to the input terminal A, and in the current sensing signals for controlling the currents input to the input terminals A and B, the coefficients of terms in which the currents $I_A$ and $I_B$ of the input terminals A and B are included, namely, predetermined proportions reflecting the respective input currents should be equal for the current sensing signals VsA and VsB. Here, the respective reference signals have relationships VRA=$I_{FA}$×R1 and VRB=$I_{FB}$×R2, so $I_{FA}$ and $I_{FB}$ are determined by VRA and R1 and VRB and R2, respectively. In Equation (B2) and Equation (B3), the omission marks ( . . . ) indicate that other input currents may be further reflected in the current sensing signals of the input terminals A and B.

When Equation (B2) and Equation (B3) defining relationships between the currents $I_A$ and $I_B$ of the two input terminals A and B and the current sensing signals and Equation (B1) defining the relationship between two current levels are applied to Equation (10), {R2×$I_{FA}$}<VRB is obtained, and when Equation (B2) and Equation (B3) and Equation (B1) are applied to Equation (11), VRA<{R1×$I_{FB}$} is obtained. As for {R2×$I_{FA}$}<VRB, since VRB=R2×$I_{FB}$, it can be expressed as {R2×$I_{FA}$}<{VRB=R2×$I_{FB}$}, and when the condition of $I_{FA}<I_{FB}$ is met, the relational expression is satisfied. Also, as for VRA<{R1×$I_{FB}$}, since VRA=R1×$I_{FA}$, it can be expressed as {VRA=R1×$I_{FA}$}<{R1×$I_{FB}$}, and when the condition of $I_{FA}<I_{FB}$ is met, the relational expression is also established. Thus, it can be seen that, in the case of the two input terminals A and B satisfying Equation (B1) to Equation (B3), the input terminal B satisfies all of the conditions for having exclusive priority over the input terminal A.

Finally, a case in which exclusive priority is determined by two factors, i.e., a reference signal and a current level, will be described. Conditions for the input terminal B having a higher current level and reference signal to have exclusive priority over the input terminal A are as follows.

$$VRA<VRB \quad (C1)$$

$$I_{FA}<I_{FB} \quad (C2)$$

$$VsA=I_A\times R1+I_B\times R2+\ldots \quad (C3)$$

$$VsB=I_A\times R2+I_B\times R2+\ldots \quad (C4)$$

or $$VsA=I_A\times R1+I_B\times R1+\ldots \quad (C3')$$

$$VsB=I_A\times R1+I_B\times R2+\ldots \quad (C4')$$

Namely, the reference signal VRB of the input terminal B should be greater than the reference signal VRA of the input terminal A, and the current level $I_{FB}$ input to the input terminal B should be higher than the current level $I_{FA}$ input to the terminal A. Also, when a coefficient of a term in which the current $I_A$ of the input terminal A in the current sensing signal VsA for controlling the current of the input terminal A is R1 and when a coefficient of a term in which the current $I_B$ of the input terminal B in the current sensing signal VsB for controlling a current of the input terminal B is R2, all coefficients of other terms including the currents $I_A$ and $I_B$ of the two input terminals A and B should be R1 or R2. In this case, since the reference signals have relationships VRA=$I_{FA}$×R1 and VRB=$I_{FB}$×R2, respectively, the $I_{FA}$ and $I_{FB}$ are determined by VRA and R1 and VRB and R2, respectively. In Equation (C3) and Equation (C4) or Equation (C3') and Equation (C4'), the omission marks ( . . . ) indicate that other input currents may be further reflected in the current sensing signals of the input terminals A and B.

When Equation (C3) and Equation (C4) defining the relationships between the currents $I_A$ and $I_B$ of the two input terminals A and B and the current sensing signals and Equation (C1) and Equation (C2) defining the relationships between the two reference signals and the two current levels are applied to Equation (10), {R2×$I_{FA}$}<VRB is obtained, and when Equation (C3), Equation (C4), Equation (C1), and Equation (C2) are applied to Equation (11), VRA<{R2×$I_{FB}$} is obtained. As for {R2×$I_{FA}$}<VRB, since VRB=R2×$I_{FB}$, it can be expressed as {R2×$I_{FA}$}<{VRB=R2×$I_{FB}$}, and when the condition of $I_{FA}<I_{FB}$ is met, the relational expression is satisfied. Also, as for VRA<{R2×$I_{FB}$}, since VRB=R2×$I_{FB}$, it can be expressed as VRA<{VRB=R2×$I_{FB}$}, and when the condition of VRA<VRB is met, the relational expression is also established. Thus, it can be seen that, in the case of the two input terminals A and B satisfying Equation (C1) through Equation (C4), the input terminal B satisfies all of the conditions for having exclusive priority over the input terminal A.

Also, when Equation (C3') and Equation (C4') defining the relationships between currents $I_A$ and $I_B$ of the two input terminals A and B and the current sensing signals and Equation (C1) and Equation (C2) defining the relationships between the two reference signals and the two current levels are applied to Equation (10), (R1×$I_{FA}$)<VRB is obtained, and when Equation (C3'), Equation (C4'), Equation (C1), and Equation (C2) are applied to Equation (11), VRA<{R1×$I_{FB}$} is obtained. As for {R1×$I_{FA}$}<VRB, since VRA=R1×$I_{FA}$, it can be expressed as {VRA=R1×$I_{FA}$}<VRB, and when the condition of VRA<VRB is met, the relational expression is satisfied. Also, as for VRA<{R1×$I_{FB}$}, since VRA=R1×$I_{FA}$, it can be expressed as {VRA=R1×$I_{FA}$}<{R1×$I_{FB}$}, and when the condition of $I_{FA}<I_{FB}$ is met, the relational expression is also established. Thus, it can be seen that, in the case of the two input terminals A and B satisfying Equation (C1), Equation (C2), Equation (C3'), and Equation (C4'), the input terminal B satisfies all of the conditions for having exclusive priority over the input terminal A.

Referring to the relationships in which the exclusive priority as proposed above are satisfied, when an input terminal having high exclusive priority drives a higher current level, any one of the three cases proposed above may be applied. Meanwhile, in a case in which an input terminal having high exclusive priority drives a lower current level, only the first method as proposed above may be applied. Thus, input terminals whose priority levels are equal to orders of magnitude of current levels and otherwise input terminals are classified in two and exclusive priority of the two cases may be given thereto in different manners. For example, input terminals having relationships in which an input terminal having higher priority drives a current equal to or lower than that of an input terminal having lower priority are all configured to have a current sensing signal having the same magnitude to thus secure exclusive priority, and in case of input terminals whose priority levels are equal to the orders of magnitude of driving currents, although they have current sensing signals having different magnitudes, they can secure exclusive priority. Details thereof will be described through embodiments.

Hereinafter, an embodiment in which exclusive priority is determined among input terminals will be described in detail. In the present embodiment, for the purposes of description, the current sensing block 202 is configured with a linear resistor, and current sensing signals IS1, IS2, . . . , ISn input to the current control block 201 are in the form of voltage, but the present invention is not limited thereto unless otherwise mentioned.

In an embodiment, exclusive priority is guaranteed for input terminals in order of degrees of input terminals, starting from an input terminal having the highest degree. For example, The first to nth reference voltages VR1, VR2, . . . , VRn input to the first to nth controllers controlling each current input to the first to nth input terminals of the driving control unit 20 satisfy sequentially greater values VR1<VR2< . . . <VRn, and all of the first to nth current sensing voltages Vs1, Vs2, . . . , Vsn generated by reflecting all of the first to nth input currents $I_{T1}$, $I_{T2}$, . . . , $I_{Tn}$ input to the first to nth input terminals have the same magnitude. In detail, it corresponds to a case in which the first to nth input currents $I_{T1}$, $I_{T2}$, . . . , $I_{Tn}$ are reflected in the first to nth current sensing signals, respectively, in the same proportions R1, R2, . . . , Rn. In this case, the first to nth current sensing voltages Vs1, Vs2, . . . , Vsn may be generalized to be represented by Equation (14).

$$Vs1=Vs2=\ldots Vsn=I_{T1}\times R1+I_{T2}\times R2\ldots+I_{Tn}\times Rn \tag{14}$$

Here, $I_{T1}$ to $I_{Tn}$ are first to nth input currents input to the first to nth input terminals of the driving control unit, respectively. Also, R1 to Rn are values obtained by dividing current sensing voltages obtained when the first to nth input currents are input to the first to nth input terminals of the current sensing block 202, by the magnitudes of the respective input currents. R1 to Rn are the predetermined proportions.

When the current sensing voltages are given as represented by Equation (14), Equation (A1) and Equation (A2) as discussed above may be applied as conditions for checking exclusive priority to the two input terminals A and B. In Equation (14), since the current sensing signals of all of the input terminals are equal, the first to nth input terminals have exclusive priority, respectively, such that an input terminal having a higher reference voltage has higher exclusive priority, sequentially. Thus, the embodiment for guaranteeing sequentially higher exclusive priority for the first to nth input terminals may be summarized in Equation (14) and Equation (15).

$$Vs1=Vs2=\ldots=Vsn=I_{T1}\times R1+I_{T2}\times R2\ldots+I_{Tn}\times Rn \tag{14}$$

$$VR1<VR2<\ldots<VRn \tag{15}$$

In order to drive the LED groups sequentially connected in series according to exclusive priority, exclusive priority levels of the input terminals should be secured, and finally, whether currents of the respective input terminals can be driven at pre-set magnitudes, namely, with respective current levels $I_{F1}$, $I_{F2}$, . . . , $I_{Fn}$ should be determined.

First, when the current sensing voltages and the reference voltages as shown in Equation (14) and Equation (15) are given, whether the current waveforms shown in FIG. 4 can be driven may be determined. To this end, the first to nth current levels $I_{F1}$, $I_{F2}$, . . . , $I_{Fn}$ should be determined by certain values greater than 0 in order of $I_{F1}<I_{F2}<\ldots<I_{Fn}$. From Equation (14), it can be seen that the first current level $I_{F1}$ satisfies a relationship of $I_{F1}$×R1=VR1 according to an operation of the first controller in the first driving section t1 during which the current $I_{T1}$ is input to the first input terminal T1. Here, the first current level $I_{F1}$ is a pre-set value, so when VR1 is first determined to have an appropriate value, a condition for satisfying the first current level is R1=VR1/$I_{F1}$.

As for a condition for satisfying the second current level $I_{F2}$, $I_{F2}$×R2=VR2, and similarly, when the second reference voltage VR2 is determined to be a value greater than VR1, a condition for the second current level $I_{F2}$ to have a pre-set value will be R2=VR2/$I_{F2}$. In the same manner, as for a condition for nth current level $I_{Fn}$, since $I_{Fn}$×Rn=VRn, when VRn is first determined to be a value greater than other reference voltages VR1, VR2, . . . , VR(n−1), a condition for satisfying the nth current level may be determined as Rn=VRn/$I_{Fn}$.

Therefore, when the first to nth current sensing voltages and reference voltages are given as shown in Equation (14) and Equation (15), the driving control unit 20 driving the input currents $I_{T1}$, $I_{T2}$, . . . , $I_{Tn}$ with pre-set current levels $I_{F1}$, $I_{F2}$, . . . , $I_{Fn}$ in each driving section may be implemented by first determining that input terminals having higher priority, i.e., having higher degrees, have greater reference values and subsequently determining the predetermined proportions R1, R2, . . . , Rn such that values obtained by multiplying the proportions R1, R2, . . . , Rn of the respective input currents reflected in the current sensing voltages to magnitudes of the currents driven in respective driving sections, i.e., the current levels $I_{F1}, I_{F2}, \ldots, I_{Fn}$ are equal to the reference voltages VR1, VR2, . . . , VRn of the input terminals.

In the case of Equation (14) and Equation (15), even a case in which the current levels satisfy all of the conditions of $I_{F1}<I_{F2}< \ldots <I_{Fn}$ and the current levels have a different relationship may also be applicable. The reason is because, the proportions R1, R2, . . . , Rn in which the respective input currents $I_{T1}, I_{T2}, \ldots, I_{Tn}$ are reflected in the current sensing voltages may be determined as real numbers greater than 0, and the magnitudes of the respective input currents, i.e., the current levels $I_{F1}, I_{F2}, \ldots, I_{Fn}$, may be freely determined according to the proportions R1, R2, . . . , Rn and the reference voltages VR1, VR2, . . . , VRn. In detail, the nth current level may be increased in proportion to the nth reference voltage and may be decreased in proportion to the proportion Rn in which the nth input current is reflected in the current sensing voltages, so, by regulating the two values, the nth current level $I_{Fn}$ having a certain magnitude greater than 0 may be set.

Hereinafter, comparisons between current levels driven in a case in which the current sensing voltages Vs1, Vs2, . . . , Vsn are further simplified as shown in Equation 16, namely, in a case in which all of the first to nth input currents are reflected in the first to nth current sensing voltages in the same proportion Rs and the current levels of the former cases will be described. In this case, in order to guarantee exclusive priority, all of the reference voltages VR1, VR2, . . . , VRn are regarded as satisfying Equation (15).

$$Vs1=Vs2= \ldots =Vsn=I_{T1}\times Rs+I_{T2}\times Rs \ldots +I_{Tn}\times Rs \quad (16)$$

As shown in Equation (16), even in the case that current sensing voltages are determined, exclusive priority is guaranteed. The reason is because all of the current sensing voltages Vs1, Vs2, . . . , Vsn are equal (Vs1=Vs2= . . . =Vsn). Even when exclusive priority is maintained, current levels in each driving section may vary according to proportions of input currents reflected in the current sensing voltages. Current levels that may be driven when the current sensing voltages are determined as shown in Equation (16) are determined as follows.

The first current level $I_{F1}$ satisfies a relationship of $I_{F1}\times Rs=VR1$. First, when the first reference voltage VR1 is determined as an appropriate value, the current sensing resistance Rs is determined as $Rs=VR1/I_{F1}$. Next, since the current sensing resistance Rs has been already determined, the second current level should satisfy a relationship of $VR2=I_{F2}\times Rs=I_{F2}\times VR1/I_{F1}$. Since the nth current level $I_{Fn}$ should satisfy a relation of $VRn=I_{Fn}\times Rs$, relationships between the reference voltages and the current levels may be generalized as follows. Namely, relationships of $VR1/I_{F1}=VR2/I_{F2}=VRn/I_{Fn}=Rs$ should be maintained. Here, it can be seen that the ratios of the reference voltages VR1, VR2, . . . , VRn and the ratios of the current levels $I_{F1}, I_{F2}, \ldots, I_{Fn}$ among the respective input terminals are obtained to be the same. In order to guarantee exclusive priority, Equation (15) should be satisfied, so, it can be seen that the current sensing voltages as shown in Equation (16) are appropriate for the case in which an input terminal having higher exclusive priority drives a higher current level. Meanwhile, in the present embodiment, since the first to nth reference voltages and the first to nth current levels have the same ratios (Rs), orders of magnitudes of the reference voltages and orders of magnitudes of the current levels are the same. Thus, this case corresponds to a case in which an input terminal having a higher reference voltage has exclusive priority and also to a case in which an input terminal having a higher driving current level has exclusive priority.

So far, the case in which the current sensing voltages Vs1, Vs2, . . . , Vsn are all equal to easily secure exclusive priority has been described. However, exclusive priority is not always obtained limitedly in the case in which the current sensing voltages are all equal. As discussed above, the driving control unit 20 having exclusive priority may be implemented by forming the linear current sensing block to satisfy both Equation (10) and Equation (11) and the non-linear current sensing block to satisfy both Equation (12) and Equation (13). A specific embodiment will be described below.

In the present embodiment, when the current sensing block 202 is configured to only include a passive element such as a resistor, or the like, when the input currents $I_{T2}, \ldots, I_{Tn}$ having higher priority are reflected to generate the first current sensing voltage Vs1 having the lowest priority, the current $I_{T1}$ of the first input terminal T1 is reflected to generate the second to nth current sensing voltages Vs2, . . . , Vsn having higher priority. This means that all of R11 to R1*n*, R21 to R2*n*, and Rn1 to Rnn in Equation (7) to Equation (9) have values greater than 0. Thus, in the present embodiment, although it is described that the first to nth current sensing voltages Vs1, Vs2, . . . , Vsn are generated by reflecting all of the input currents $I_{T1}, I_{T2}, \ldots, I_{Tn}$ in predetermined proportions, but this may correspond only to a case in which the current sensing block 202 is configured by using a passive element.

Namely, in a case in which a linear current block in which an input current and a current sensing signal have a linear relationship is configured to include an active element, besides a passive element, an input current having low priority may not be reflected as described above, and thus, a portion of R11 to R1*n*, R21 to R2*n*, and Rn1 to Rnn may become 0. In case of configuring a linear current sensing block by using an active element, each of R11 to Rnn may be set to a certain value, and a current sensing block for providing exclusive priority to drive a current between input terminals may be implemented in various manners.

For example, first to nth current sensing signals may be generated by sensing each of first to nth input currents and the magnitudes of the sensed input currents are added in certain proportions by using an analog operational circuit such as an adder, or the like. In another example, analog signals corresponding to first to nth input currents may be converted into digital signals by using an analog-to-digital converter (ADC), and a micro-controller may perform arithmetical operation thereon to generate first to nth current sensing signals. Here, each of the predetermined proportions R11 to Rnn may be easily set to certain values. Therefore, the present invention is not limited only to a particular form of the current sensing block.

Hereinafter, an embodiment of the driving control unit 20 capable of driving the current waveforms illustrated in FIG. 4 will be described with reference to FIG. 6, and an operation of the driving control unit 20 on the basis of the embodiment will be described in detail. Although it is described that the current waveforms of FIG. 4 are driven by applying an embodiment of the driving control unit, the present invention is not limited thereto and other current waveforms and the driving control unit required therefor by applying the principle of the present invention may be implemented.

Figure 6A:
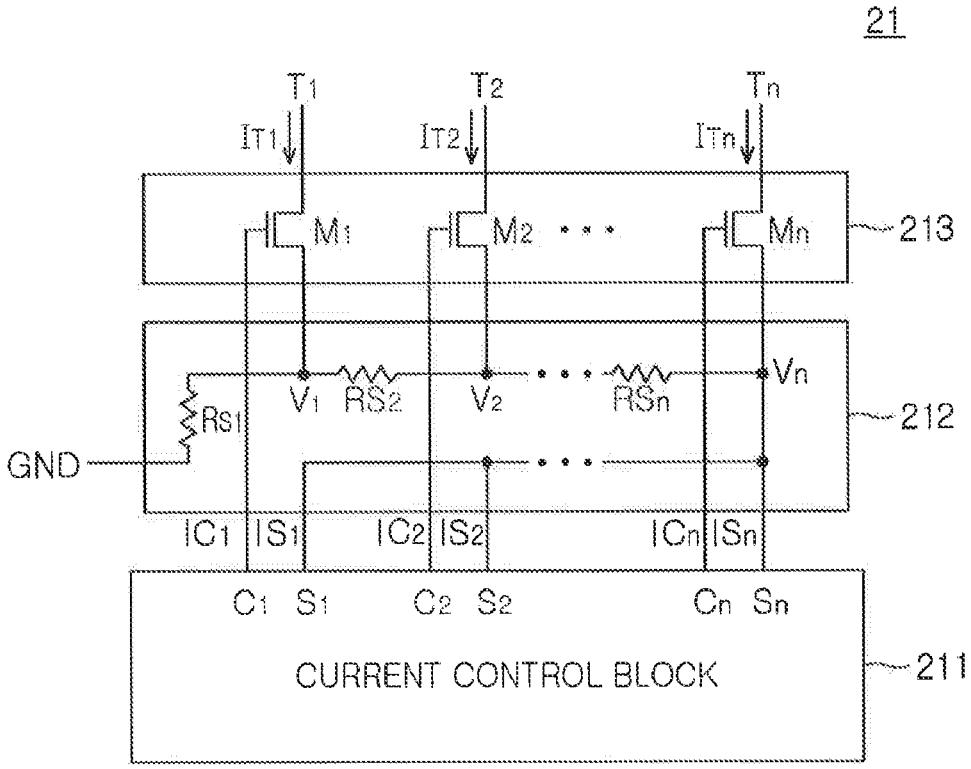
FIG. 6 is a view schematically illustrating a configuration of the driving control unit applicable to the LED driving device according to an embodiment of the present invention.
Figure 6B:
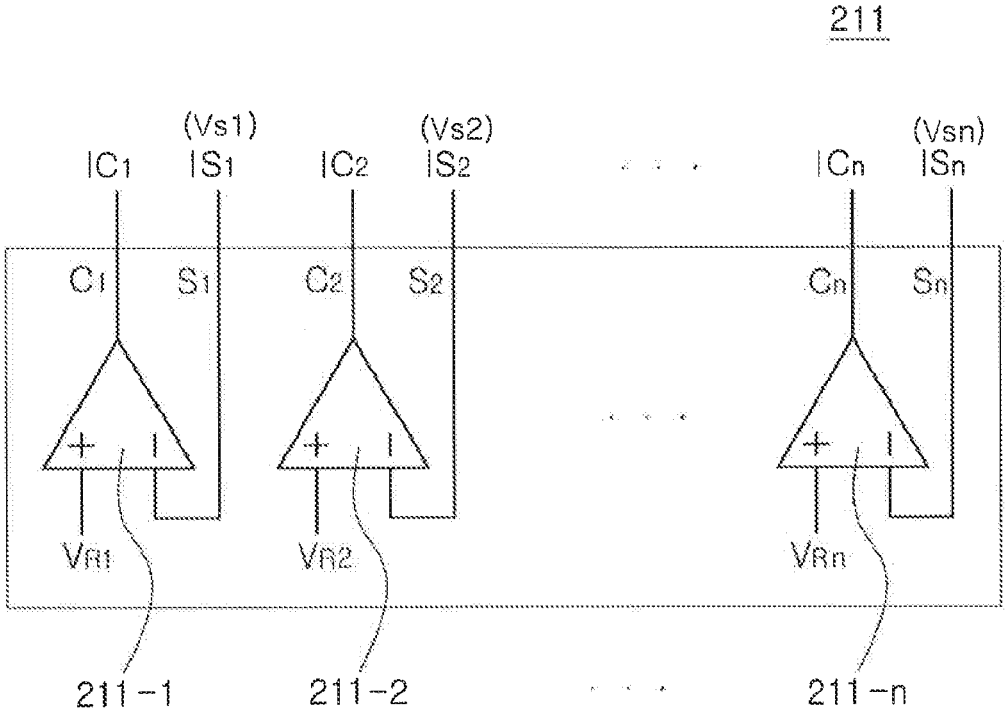

FIG. 6 is a view schematically illustrating a configuration of a driving control unit according to an embodiment of the present invention capable of driving the current waveforms shown in FIG. 4. Referring to FIG. 6A, a driving control unit 21 according to the present embodiment may include a current sensing block 212 generating first to nth current sensing signals reflecting all of first to nth input current $I_{T1}$, $I_{T2}$, . . . , $I_{Tn}$ input through first to nth input terminals T1, T2, . . . , Tn of the driving control unit 21 in predetermined proportions, a current control block 211 outputting signals for controlling magnitudes and a path of currents input to the driving control unit 21 upon receiving the first to nth current sensing signals generated by the current sensing block 212, and a current control unit 213 controlling currents input to the first to nth input terminals T1, T2, . . . , Tn of the driving control unit 21 according to the first to nth control signals output from the current control block 211. Also, FIG. 6B schematically illustrates an embodiment of the current control block 211 illustrated in FIG. 6A.

The current control unit 213 according to an embodiment of the present invention may include first to nth current control units M1, M2, . . . , Mn regulating magnitudes of the first to nth input currents input to the first to nth input terminals of the driving control unit 21 according to first to nth control signals input from the current control block 211. The first to nth current control units may be implemented as MOSFETs to change a driving current, but the present invention is not limited thereto and the first to nth current control units may be implemented as current control elements such as a bipolar junction transistor (BJT), an insulated gate bipolar transistor (IGBT), a junction gate field-effect transistor (JFET), a double-diffused metal-oxide-semiconductor field-effect transistor (DMOSFET), and the like, or a combination thereof. Namely, the first to nth current control units may be implemented to include one or more current control elements such as transistors. Here, the current control units may increase a driving current in proportion to a magnitude of an input control signal, respectively. Also, each of the current control units M1, M2, . . . , Mn may be implemented through a single current control element (transistor), may be implemented to further include an amplifier, or may be implemented to further include different current control elements connected in a cascade manner in a path along which a current flows.

When different current control elements connected in a cascade manner in a path along which a current flows are provided to serve as current buffers, the current control elements receiving a control signal may not be directly connected to an output terminal of an LED group and may receive a current through a different current control element, i.e., a current buffer, so a voltage applied to an input terminal may be limited by the different current control element, i.e., the current buffer. This type is a circuit configuration scheme well known as a cascode or cascade amplifier. When a current control unit is configured to have a cascode structure, circuits other than a small number of elements directly connected to the light source unit 30, may operate with a low voltage, so the current control unit may be implemented with an element having a low operational voltage. When circuits including only an element having a low operational voltage are integrated, manufacturing costs can be lowered. Also, the entirety or a portion of an LED group including a component to which a high voltage is applied, i.e., a single current buffer, may be integrated into a single component. In this case, the size of the component is reduced to enhance user convenience and lower manufacturing costs. Various known circuit design techniques may be applied to implement a current control unit.

The current sensing block 212 may generate first to nth current sensing signals Vs1, Vs2, . . . , Vsn reflecting the first to nth input currents $I_{T1}$, $I_{T2}$, . . . , $I_{Tn}$ through voltages applied to current sensing resistors Rs1, Rs2, . . . , Rsn. An end of one of current sensing resistors connected to each other in the current sensing block 212 may be connected to a ground GND to deliver a current input to the current sensing block 212 to the ground, and also, a current having a magnitude based on the ground may be output in the form of a voltage.

Referring to FIG. 6A, the current sensing block 212 includes a current sensing resistor Rs1 having one end connected to a ground GND to generate current sensing signals reflecting all currents input from the first to nth LED groups G1, G2, . . . , Gn to the first to nth input terminals T1, T2, . . . , Tn of the driving control unit 21 in predetermined proportions. Currents input to the first to nth input terminals T1, T2, . . . , Tn of the driving control unit 21 may all be delivered to the ground through the current sensing resistor Rs1 having one end grounded. In this case, a current sensing voltage V1 in proportion to a magnitude of the entire currents may be detected in the other end of the resistor Rs1 having one end connected to the ground. Also, current sensing resistors Rs2, . . . , Rsn may be further disposed between adjacent output terminals of the first to nth current control units M1, M2, . . . , Mn controlling first to nth input currents such that currents input through the second to nth input terminals to be delivered to the other end of the current sensing resistor Rs1 having one end connected to the ground, whereby current sensing voltages V1, V2, . . . , Vn which are sequentially added in proportion to the magnitude of currents flowing through the current sensing resistors R1, R2, . . . , Rsn may be obtained. The magnitudes of the detected currents, namely, the current sensing voltages V1, V2, . . . , Vn, may not have values corresponding to the magnitudes of the respective input currents $I_{T1}$, $I_{T2}$, . . . , $I_{Tn}$, but have values obtained by reflecting the respective input currents $I_{T1}$, $I_{T2}$, . . . , $I_{Tn}$ in predetermined proportions, which may be represented by Equation (17) to Equation (19).

$$V1=Rs1\times I_{T1}+Rs1\times I_{T2}\ldots+Rs1\times I_{Tn} \tag{17}$$

$$V2=Rs1\times I_{T1}+(Rs1+Rs2)\times I_{T2}\ldots+(Rs1+Rs2)\times I_{Tn} \tag{18}$$

. . .

$$Vn=Rs1\times I_{T1}+(Rs1+Rs2)\times I_{T2}\ldots+(Rs1+\ldots+Rsn)\times I_{Tn} \tag{19}$$

Here, as for the current sensing voltage V1 in Equation (17), when Rs1 is replaced by Rs (Rs=Rs1), it can be seen that Equation (17) is the same as Equation (16) illustrated as a form of the current sensing voltage. Also, as for the current sensing voltage Vn of Equation (19), when Rs1 is replaced by R1 (R1=Rs1), and (Rs1+Rs2) is replaced by R2 (R2=Rs1+Rs2), and (Rs1+ . . . +Rsn) is replaced by Rn (Rn=Rs1+ . . . +Rsn), it can be seen that the current sensing voltage Vn has the same form as that of the current sensing voltage of Equation (14). Equation (19) is different from Equation (14) in that relative magnitudes among predetermined proportions reflecting input currents have been already determined in order of R1<R2< . . . <Rn. In the present embodiment, only Vn, among the detected current sensing voltages, may be output to the first to nth current sensing voltages Vs1, Vs2, . . . , Vsn to make the magnitudes of the first to nth current sensing voltages Vs1, Vs2, . . . , Vsn input to the first to nth input terminals S1, S2, . . . , Sn of the current control block 211 the same.

Meanwhile, in implementing the current sensing block 211, preferably, current sensing resistance present in a path along which the greatest input current flows is configured to be the lowest and current sensing resistance present in a path along which a lower input current flows is configured to be gradually increased, whereby fluctuations in a current sensing voltage are small according to a driving section. When fluctuations in a current sensing voltage are small according to a change in a driving section, a difference between the reference voltages may be reduced, and accordingly, a voltage applied to the current sensing block 211 may be lowered. Thus, power consumed in the current sensing block may be reduced to enhance power efficiency of the LED driving device. Also, when it is configured that a different input current is delivered to a ground through a portion or the entirety of current sensing resistors present in the path along which the greatest current flows, the configuration of the current sensing block 211 may be simplified and all of the respective input currents may be reflected in predetermined proportions easily. The current sensing block 212 illustrated in FIG. 6 does not substantially correspond to this criteria, and an embodiment thereof which substantially correspond to the criteria will be described below.

In the driving control unit 21 according to the present embodiment, when the first to nth reference voltages VR1, VR2, . . . , VRn input to the non-inverting positive (+) input terminals of the first to nth controllers (please see FIG. 6B) that control the first to nth input currents $I_{T1}$, $I_{T2}$, . . . , $I_{Tn}$ satisfy Equation (15), namely, VR1<VR2< . . . <VRn, exclusive priority levels of the input terminals are obtained in order of reference voltages of the respective input terminals (starting from the greatest reference voltage). The reason is because, since the current sensing voltages Vs1, Vs2, . . . , Vsn input to the inverting negative (−) input terminals S1, S2, . . . , Sn of the first to nth controllers are all equal as Vn, so exclusive priority levels of the input terminals can be secured in order of the magnitudes of the reference voltages. Namely, in this case, both Equation (14) and Equation (15) are satisfied.

Meanwhile, conditions required for the driving control unit 21 illustrated in FIG. 6 to drive the current waveform $I_{G1}$ illustrated in FIG. 4 according to exclusive priority are as follows.

$$VR1<VR2< \ldots <VRn$$

$$R1<R2< \ldots <Rn$$

Here, R1=Rs1, R2=Rs1+Rs2, and Rn=Rs1+ . . . +Rsn.

Hereinafter, how the magnitudes of currents, i.e., first to nth current levels $I_{F1}$, $I_{F2}$, . . . , $I_{Fn}$, flowing to the respective input terminals are determined when reference voltages satisfy the above conditions and proportions (R1, R2, . . . , Rn) of the respective input currents reflected in the current sensing voltages are determined in order of R1<R2< . . . <Rn will be described.

When the first input current $I_{T1}$ is input with the first current level $I_{F1}$ and the other input currents are all 0 in Equation (19), current sensing voltages are Vs1=Vs2 . . . =Vsn=Vn=$I_{F1}$×Rs1=VR1. Thus, when VR1 is first determined, the first current sensing resistance value may be determined as Rs1=VR1/$I_{F1}$ according to $I_{F1}$×Rs1=VR1. Next, current sensing voltages obtained when the second input current $I_{T2}$ is input with the second current level $I_{F2}$ and the other input currents are all 0 have a relationship of Vs1=Vs2 . . . = Vsn=Vn=$I_{F2}$×(Rs1+Rs2)=VR2, so Rs2 may be determined from the final relational expression of the equation.

Namely, since Rs1 has been already determined, when VR2 is determined as a value greater than VR1, Rs2 may be easily expressed as Rs1, $I_{F2}$, and VR2. If Rs2 is determined as a value smaller than 0, VR2 may be determined as a greater value and the Rs2 may be determined. In the same manner, a relationship of $I_{Fn}$×(Rs1+Rs2+ . . . +Rsn)=VRn is established for Rsn, and since the other current sensing resistances excluding Rsn have already been determined according to current levels and reference voltages of input terminals having lower priority, when VRn is determined as a value greater than (n−1)th reference voltage VR(n−1), Rsn may also be easily determined.

Thus, the driving control unit 21 illustrated in FIG. 6A has a slight restriction in determining the proportions R1, R2, . . . , Rn of the input currents reflected in the current sensing voltages in terms of the form of the current sensing block 211, but it does not have any restriction with the driving current waveforms. Namely, in the case in which the first to nth current levels are greater than 0, the driving control unit 21 may drive respective current levels without any restriction.

Meanwhile, the current control block 211 may receive first to nth current sensing signals generated by reflecting all of the currents input to the first to nth input terminals T1, T2, . . . , Tn of the driving control unit 21 in predetermined proportions, through a plurality of input terminals S1, S2, . . . , Sn, and may output the first to nth control signals IC1, IC2, . . . , ICn to the current control unit 213 through a plurality of output terminals C1, C2, . . . , Cn according to the input first to nth current sensing signals to control magnitudes and a path of the currents input to the first to nth input terminals T1, T2, . . . , Tn of the driving control unit 21 in the first to nth driving sections.

In detail, the current control block 211 may compare the first to nth current sensing voltages Vs1, Vs2, . . . , Vsn generated by reflecting the input currents flowing to the ground GND through the current sensing block 212 in predetermined proportions with the first to nth reference voltages, and controls the first to nth current sensing voltages Vs1, Vs2, . . . , Vsn to be equal to the first to nth reference voltages, thereby controlling the first to nth input terminals T1, T2, . . . , Tn to be driven at predetermined current levels in the first to nth driving sections t1, t2, . . . , tn. Here, the current sensing voltages and the reference voltages should be set in advance to satisfy the exclusive priority levels of the input terminals and the magnitudes of the currents, i.e., the current levels, flowing to the input terminals in the respective driving sections. A detailed configuration of the current control block 211 will be described with reference to FIG. 6B.

FIG. 6B is a view schematically illustrating a current control block applicable to an embodiment of the present invention, which corresponds to an embodiment of the current control block applicable to the driving control unit 21. The current control block 211 according to the present embodiment may include first to nth controllers 211-1, 211-2, . . . , **211-*n* output control signals for controlling currents input to the first to nth input terminals T1, T2, . . . , Tn of the driving control unit 21. The first to nth controllers 211-1, 211-2, . . . , 211-*n* may compare the first to nth current sensing voltages Vs1, Vs2, . . . , Vn reflecting all of the first to nth input currents $I_{T1}$, $I_{T2}$, . . . , $I_{Tn}$ input to the first to nth input terminals T1, T2, . . . , Tn in predetermined proportions with the first to nth reference voltages VR1, VR2, . . . , VRn, and output first to nth control signals IC1, IC2, . . . , ICn for controlling the first to nth input currents $I_{T1}$, $I_{T2}$, . . . , $I_{Tn}$ input to the first to nth input terminals of the driving control unit 21**.

In detail, the first controller 211-1 may compare the first current sensing voltage Vs1 generated by reflecting the first to nth input currents input to the first to nth input terminals T1, T2, . . . , Tn of the driving control unit 21 from the output terminals of the first to nth LED groups G1, G2, . . . , Gn through the current sensing block 212 in predetermined proportions with the first reference voltage VR1 and output the first control signal IC1 to the first current control unit M1 to make the first sensing voltage Vs1 equal to the first reference voltage VR1, and similarly, the second controller 211-2 may compare the second current sensing voltage Vs2 with the second reference voltage VR2 and output the second control signal IC2 to the second current control unit M2 to make the second current sensing voltage Vs2 equal to the second reference voltage VR2. In the present embodiment, the magnitudes of the first to nth current sensing voltages Vs1, Vs2, . . . , Vsn are all equal as Vn.

As for a path of the currents input to the first to nth input terminals T1, T2, . . . , Tn of the driving control unit 21, the first to nth controllers 211-1, 211-2, . . . , 211-*n* of the current control block 211 may compare the first to nth current sensing voltages Vs1, Vs2, . . . , Van generated by the current sensing resistors Rs1, Rs2, . . . , Rsn with the first to nth reference voltages VR1, VR2, . . . , VRn in a state in which exclusive propriety among input terminals is set, and output the first to nth control signals to make the first to nth current sensing voltages Vs1, Vs2, . . . , Vsn equal to the first to nth reference voltages, to thereby determine a path to include the largest amount of LED groups that may be driven in the respective driving sections.

For example, when the DC source voltage V in the rectifying unit 10 is in the first driving section t1 during which only the first LED group G1 may be driven, the first controller 211-1 may control the first current sensing voltage Vs1 generated by the first input current $I_{T1}$ input from the output terminal of the first LED group G1, to be equal to the first reference voltage VR1. Namely, when the first current sensing voltage Val is lower than the first reference voltage VR1, the first controller 211-1 outputs a control signal for increasing an amount of the current input to the first input terminal T1, and when the first current sensing voltage Vs1 is higher than the first reference voltage VR1, the first controller 211-1 outputs a control signal for reducing the amount of the current input to the first input terminal T1, to thus maintain the current input to the first input terminal T1 at a predetermined magnitude, i.e., at the first current level $I_{F1}$.

When the second input terminal has higher priority over the first input terminal, the magnitude of the DC source voltage V is increased, and when the DC source voltage V reaches the lowest voltage of the second driving section t2 (Vt2 in FIG. 4A), a current starts to flow through the second LED group G2 and inputs to the driving control unit 21 through the second input terminal T2 of the driving control unit 21. The second controller 211-2 for controlling the current input to the second input terminal T2 of the driving control unit 21 has the second reference voltage VR2 higher than the first reference voltage VR1. Thus, when the current sensing voltage Vn is higher than the first reference voltage VR1 and lower than the second reference voltage VR2, the first controller 211-1 controls the current input to the first input terminal T1 to be reduced and the second controller 211-2 outputs a control signal for increasing the magnitude of the current input to the second input terminal T2 until it reaches the second current level $I_{F2}$.

Figure 7A:
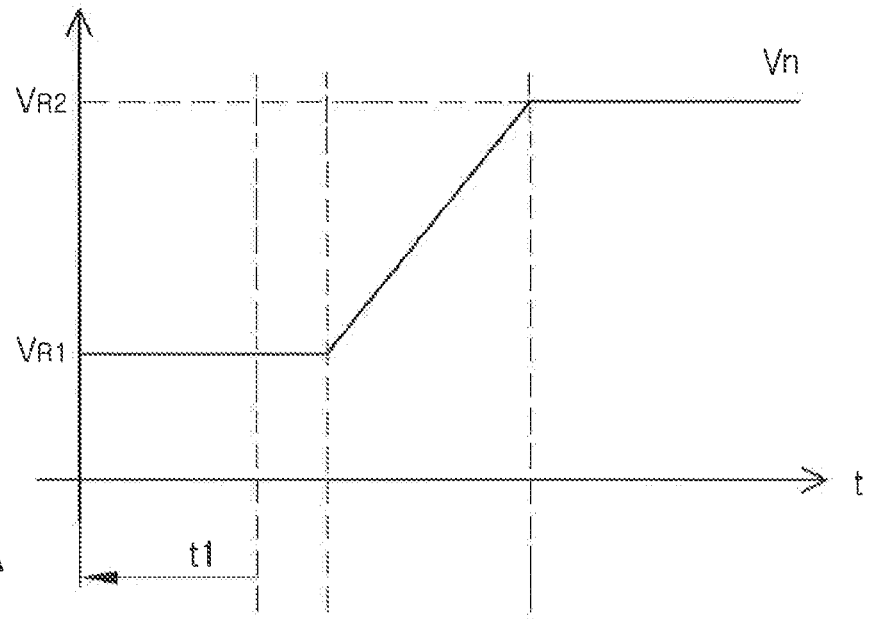
FIG. 7 is a view illustrating waveforms of a voltage and an input current detected by the driving control unit according to an embodiment of the present invention.
Figure 7B:
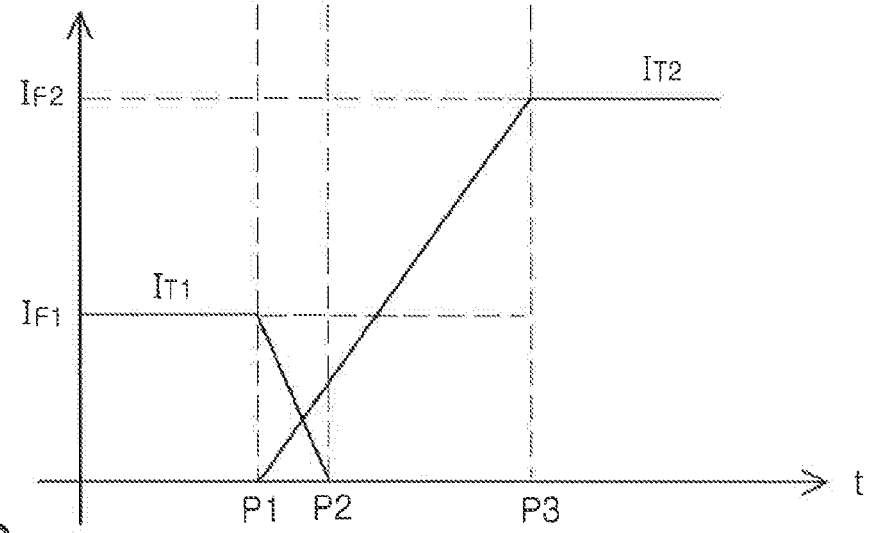

In a case in which the second input terminal has higher exclusive priority over the first input terminal, when the first current sensing voltage Vs1 cannot maintain the first reference voltage VR1 although the current input to the first input terminal T1 is reduced to 0, the current input to the first input terminal T1 is completely cut off by the current input to the second input terminal T2. Namely, in a case in which the DC source voltage V is increased to be higher than the lowest voltage of the second driving section t2 (Vt2 in FIG. 4A) by more than a predetermined value, the first input current $I_{T1}$ input to the first input terminal T1 becomes 0 and the second input current $I_{T2}$ input to the second input terminal T2 is gradually increased to a predetermined level $I_{F2}$ and subsequently maintained uniformly during a driving section to which the DC source voltage V belongs. Thus, the driving control unit 21 according to the present embodiment may be able to control a path such that a current is input to only one of the first to nth input terminals T1, T2, . . . , Tn of the driving control unit 21 according to a driving section. FIG. 7 is a view illustrating waveforms of a current sensing voltage and input currents detected by the driving control unit according to an embodiment of the present invention. Specifically, a waveform of the current sensing voltage Vn (FIG. 7A) and waveforms of the first and second input currents $I_{T1}$ and $I_{T2}$ (FIG. 7B) at the moment that a path of a current input to the first input terminal T1 according to an increase in the DC source voltage V moves to the second input terminal T2 are illustrated. Here, other input currents (not shown) are all 0.

In the present embodiment, the current sensing block 212 generates the first to nth current sensing voltages Vs1, Vs2, . . . , Vsn by reflecting all currents input through the first to nth input terminals of the driving control unit 21 in predetermined proportions, but since the first to nth current sensing voltages Vs1, Vs2, . . . , Vsn commonly use Vn generated by reflecting the first to nth input currents $I_{T1}, I_{T2}, \ldots, I_{Tn}$ in the same proportion, the first to nth current sensing voltages Vs1, Vs2, . . . , Vsn input to the first to nth controllers 211-1, 211-2, . . . , 211-*n* are all equal (Vs1=Vs2 . . . =Vsn=Vn).

First, referring to FIG. 7A, since the first to nth current sensing voltages Vs1, Vs2, . . . , Vsn generated by reflecting the first to nth input currents $I_{T1}, I_{T2}, \ldots, I_{Tn}$ input through the input terminal of the driving control unit 21 in the same proportion R1, R2, . . . , Rn are equal, the first to nth current sensing voltages Vs1, Vs2, . . . , Vsn appear as a single curve (graph) Vn. When the DC source voltage V is in the first driving section t1 in which only the first LED group G1 is driven, the first controller 211-1 connected to the first input terminal T1 controls the first current sensing voltage Vs1 to have a magnitude equal to that of the first reference voltage VR1, and accordingly, the first current sensing voltage Vs1 is maintained to be equal to the first reference voltage VR1 in the first driving section t1.

Meanwhile, referring to FIG. 7B, as the DC source voltage V is gradually increased, the second input current $I_{T2}$ is input to the second input terminal T2, so, in order to maintain the first current sensing voltage Vs1 such that it is equal to the first reference voltage VR1, the first controller 211-1 reduces an amount of the first input current $I_{T1}$ input to the first input terminal T1, starting from a predetermined point in time P1, to maintain the first current sensing voltage Vs1 to be equal to the first reference voltage VR1, and here, the magnitude of the reduced current is greater than that of the current $I_{T2}$ input to the second input terminal T2 as illustrated in FIG. 7B in the case of the current sensing block of the embodiment illustrated in FIG. 6. The reason is because, a proportion of the second input current $I_{T2}$ input through the second input terminal reflected in the current sensing voltage Vn is greater than that of the first input current $I_{T1}$ input through the first input terminal. Namely, it results from R1<R2.

When a point in time P2 at which the first controller 211-1 cannot reduce the current input to the first input terminal T1 any further as the second input current $I_{T2}$ is continuously increased according to an increase in the DC source voltage V, no more current is input to the first input terminal T1 and the current is entirely input to the second input terminal T2. The second controller 211-2 controlling the second input current $I_{T2}$ input to the second input terminal T2 has the second reference voltage VR2 greater than that of the first controller 211-1 and outputs a control signal such that the second current sensing voltage Vs2 is equal to the second reference voltage VR2.

Namely, in a section from P1 to P3 in which the second current sensing voltage Vs2 is lower than the second reference voltage VR2, the second controller 211-2 increases an amount of the second input current $I_{T2}$ input to the second input terminal T2 to make the current sensing voltage Vs2 equal to the second reference voltage VR2, and when the second input current $I_{T2}$ becomes equal to the pre-set second current level $I_{F2}$, the second controller 211-2 uniformly maintains the magnitude of the current.

In the present embodiment, when the current $I_{T2}$ starts to flow to the new input terminal T2 having higher priority at a point in time at which a driving section is changed (e.g., t1→t2), the current $I_{T1}$ that flows to the input terminal T1 having lower priority is decreased, and thereafter, when the current $I_{T2}$ of a new input terminal having higher priority is increased to a level above a predetermined level, the current $I_{T1}$ of the input terminal having lower priority is completely cut off. Through this process, a path of the current is naturally changed to the new input terminal T2 having higher priority to allow the current to flow therealong.

Meanwhile, even in a case in which the current path is changed from the input terminal T2 having higher priority to the input terminal T1 having lower priority, when the current $I_{T2}$ flowing to the input terminal having higher priority has lowered to a level below a predetermined level, the current which has been cut off starts to flow to the input terminal T1 having a one-tier lower priority. Thereafter, starting from point in time at which the current $I_{T2}$ of the input terminal having higher priority is 0, the input terminal T1 having the one-tier lower priority may drive the input current at the level $I_{F1}$ set for the input terminal.

According to the present embodiment, the driving control unit 21 sets exclusive priority among input terminals through the first to nth current sensing voltages Vs1, Vs2, . . . , Vsn generated by reflecting the respective currents flowing to the first to nth input terminals of the driving control unit 21 connected to the output terminals of the first to nth LED groups G1, G2, . . . , Gn sequentially connected to each other and the first to nth reference voltages, whereby a current input to an input terminal having higher priority reduces or cuts off a current input to an input terminal having lower priority.

Thus, without any additional process or operation of controlling a current path to make a current input by priority to an input terminal having higher priority, the driving control unit may be able to control a current to naturally flow along a new path including the largest amount of LED groups that can be driven, at a point in time at which a current flows to the new input terminal according to an increase or decrease in the DC source voltage V or at a point in time at which a current cannot be driven to above a predetermined level in an existing path, through the functions inherent to the respective controller. Also, since a current of an input terminal is continuously increased or decreased at a point in time at which a driving section is changed, the driving current $I_{G1}$ flowing through the first LED group G1 is not rapidly changed, and thus, a generation of a harmonic component in an AC current input from an external AC power source to a lighting device can be restrained.

Hereinafter, an embodiment in which the current sensing voltages as shown in Equation (16) are generated and reference voltages as shown in Equation (15) are set to thereby give exclusive priority to the first to nth input terminals of the driving control unit, based on which the current waveforms illustrated in FIG. 4A are driven will be described. Equation (16) above is rewritten herein.

$$Vs1=Vs2=\ldots=Vsn=I_{T1}\times Rs+I_{T2}\times Rs\ldots+I_{Tn}\times Rs \quad (16)$$

In Equation (16), the first to nth current sensing voltages are equal. In the present embodiment, when the first to nth current sensing voltages are generated by reflecting all of the currents input to the driving control unit in the same proportion, exclusive priority may be determined in order of input terminals such that an input terminal having the highest reference voltage has the highest exclusive priority, and an input terminal having higher exclusive priority is more appropriate for driving a higher current level, as mentioned above.

Hereinafter, an operation of a LED driving device will be described in detail through specific embodiments of the driving control unit.

Figure 8:
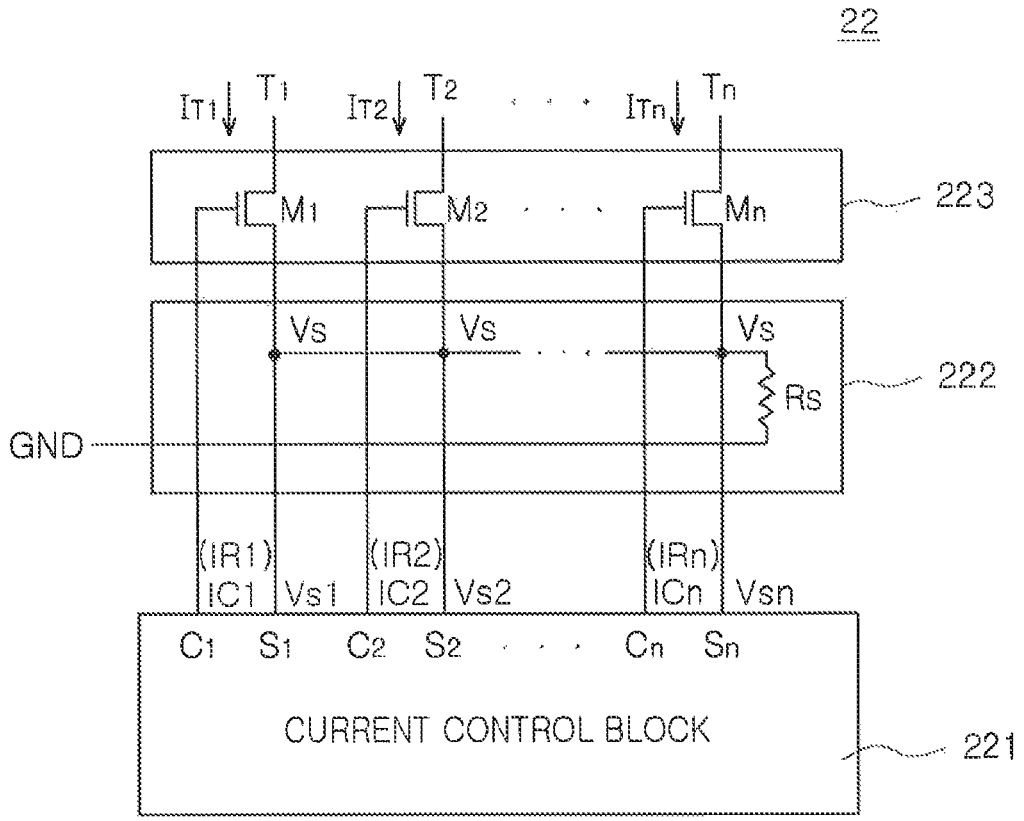
FIGS. 8 through 10 are views schematically illustrating another configuration of the driving control unit applicable to the LED driving device according to an embodiment of the present invention.
Figure 9:
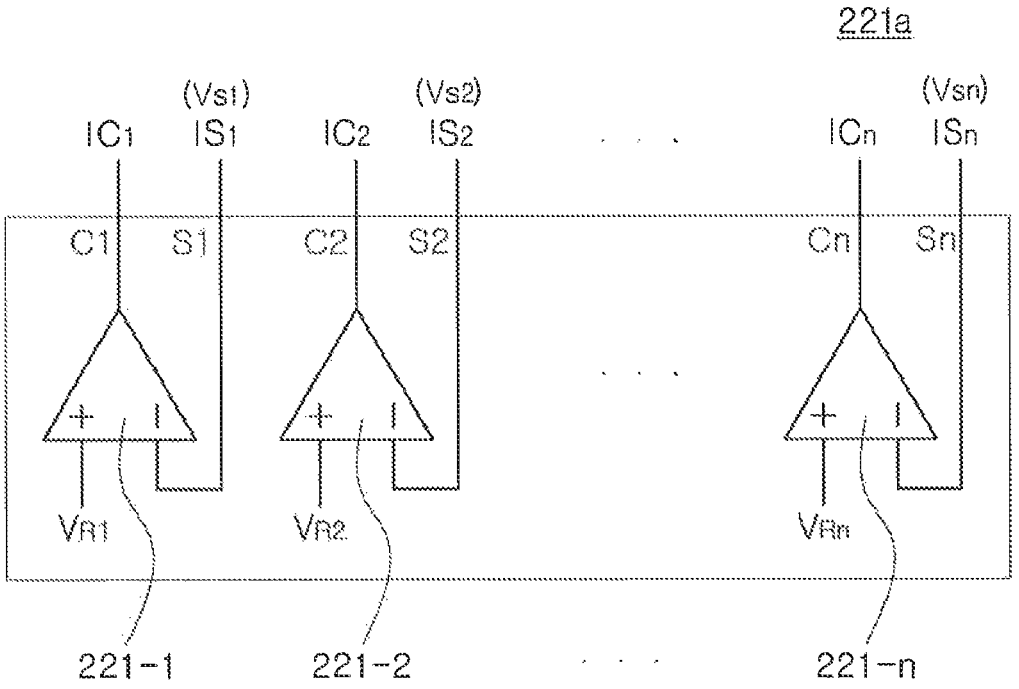
Figure 10:
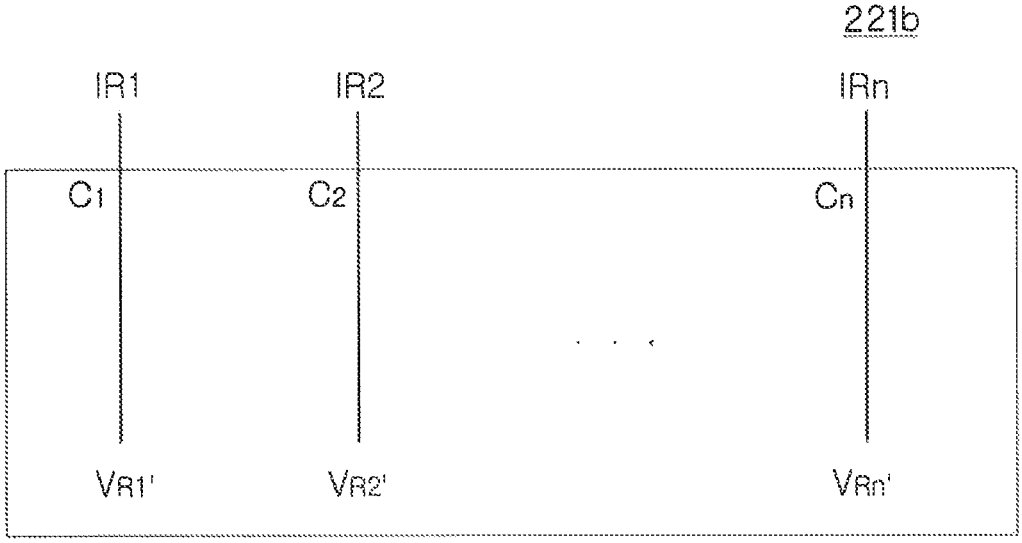

FIG. 8 schematically illustrates an embodiment of a driving control unit capable of generating the current sensing voltages shown in Equation (16) and driving the current waveforms illustrated in FIG. 4A. Also, FIG. 9 schematically illustrates an embodiment of a current control block illustrated in FIG. 8, and FIG. 10 schematically illustrates another embodiment of a current control block applicable to FIG. 8.

Referring to FIG. 8, the driving control unit according to the present embodiment may include a current control block 221 outputting first to nth control signals for controlling first to nth input currents $I_{T1}$, $I_{T2}$, . . . $I_{Tn}$ input to the first to nth input terminals T1, T2, . . . , Tn of the driving control unit, a current sensing block 222 generating first to nth current sensing voltages Vs1, Vs2, . . . , Vsn by reflecting the first to nth input currents $I_{T1}$, $I_{T2}$, . . . , $I_{Tn}$ in predetermined proportions, and a current control unit 223 receiving the first to nth current sensing voltages and controlling the first to nth input currents according to the first to nth control signals output from the current control block 221.

In the case of the current sensing block 222, all currents input to the driving control unit 22 flow to a ground GNS through a single current sensing resistor Rs. Thus, the first to nth current sensing voltages Vs1, Vs2, . . . , Vsn obtained in this case have been generated by reflecting all of the input currents in the same proportion. It can be seen that first to nth current sensing voltages Vs1, Vs2, . . . , Vsn may be represented by Equation (16) and have the same magnitude (Vs).

When the first to nth current sensing voltages Vs1, Vs2, . . . , Vsn are given in the form as expressed by Equation (16), exclusive priority among the respective input terminals may be determined by a magnitude of reference voltages or may be determined in orders of magnitude of currents driven in the respective driving sections, namely, according to order of current levels $I_{F1}$, $I_{F2}$, . . . , $I_{Fn}$ set for the respective input terminals, starting from an input terminal having the highest current level.

Thus, the driving control unit 22 of FIG. 8 is appropriate for a case in which an input terminal having higher degree has higher exclusive priority and drives greater currents.

In the case of the driving control unit 22 illustrated in FIG. 8, the configuration of the current sensing block 222 is simpler and that of the current control block 221 can be also much simpler. Hereinafter, a different type of a current control block applicable to the present embodiment will be described.

FIGS. 9 and 10 schematically illustrate the current control block 221 applicable to FIG. 8. FIG. 9 may be understood as having a structure similar to that of the current control block 221 described above with reference to FIG. 5B, so detailed descriptions thereof will be omitted.

Meanwhile, when a current control block 221*b* illustrated in FIG. 10 is applied, the current control block 221*b* may not include a controller comparing a current sensing signal with a reference signal and outputting a control signal in proportion to a difference therebetween, and may directly output a control signal corresponding to magnitudes of the reference signals IR1, IR2, . . . , IRn. The reference signals may be output as is, and when the reference signals are in the form of voltages, the reference voltages may be output as is. However, the present invention is not limited thereto. In the present embodiment, It can be assumed that the controllers 221-1, 221-2, . . . , **221-*n* included in the current control block 221*a* of FIG. 9 are moved to the current control unit 223, so reference signals are received from a current control block 221*b* and the current sensing signals Vs1, Vs2, . . . , Vsn are directly received from the current sensing block 222**, and an output in proportion to a difference therebetween is directly delivered to the current control units M1, M2, . . . , Mn. Hereinafter, a combination of a controller and a current control unit or a current control unit which also serves as a controller will be referred to as a comprehensive current control unit. A comprehensive current control unit is different from a current control unit in that it controls a current input through a connected input terminal upon receiving a reference signal and a current sensing signal.

In this case, the current control block **221*b* may not receive a current sensing signal, and the controller included in the comprehensive current control unit may directly receive a current sensing signal from the current sensing block. In an embodiment, the controller included in the current control unit may directly receive a current sensing signal through the output terminals of the current control units M1, M2, . . . , Mn that the controller controls. Meanwhile, the respective current control units M1, M2, . . . , Mn may operate in a similar manner to the comprehensive current control unit including an additional controller comparing a current sensing signal with a reference signal and outputting a control signal. Namely, when the current control block 221*b* is configured to have the configuration as illustrated in FIG. 10, the current control unit 223 may further include a separate controller similar to that illustrated in FIG. 9 or may not. When the current control unit 223** does not include a separate controller, each of the current control units M1, M2, . . . , Mn may be regarded as a comprehensive control unit including a virtual controller (not shown). Namely, although a separate controller is not included, a current control unit may operate as a comprehensive current control unit. Here, whether a current control unit operates as a comprehensive current control unit including a virtual controller may be determined by a signal input thereto.

In the present embodiment, the virtual controller may receive a reference voltage VR' from the current control block and receive a current sensing voltage Vs from the current sensing block, and output a virtual control signal to the current control unit. Upon receiving the virtual control signal, the current control unit may drive a current in a similar manner to that of the current control unit that directly receives the reference voltage VR', and the current sensing voltage Vs. Thus, the current control unit including the virtual controller may be regarded as a behavioral model with respect to the comprehensive current control unit without a controller. Hereinafter, the principle of regarding a current control unit without a controller as a comprehensive current control unit including the virtual controller will be described.

Figure 11:
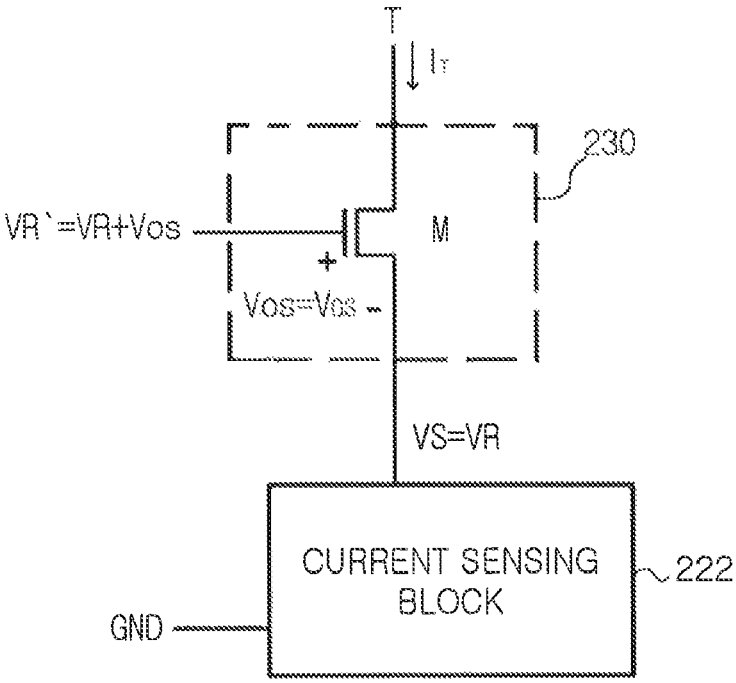
FIGS. 11 and 12 are views schematically illustrating a comprehensive current control unit which is applied to the present invention in a state of being driven and a portion of a driving control unit employing a behavior model of the comprehensive current control unit.
Figure 12:
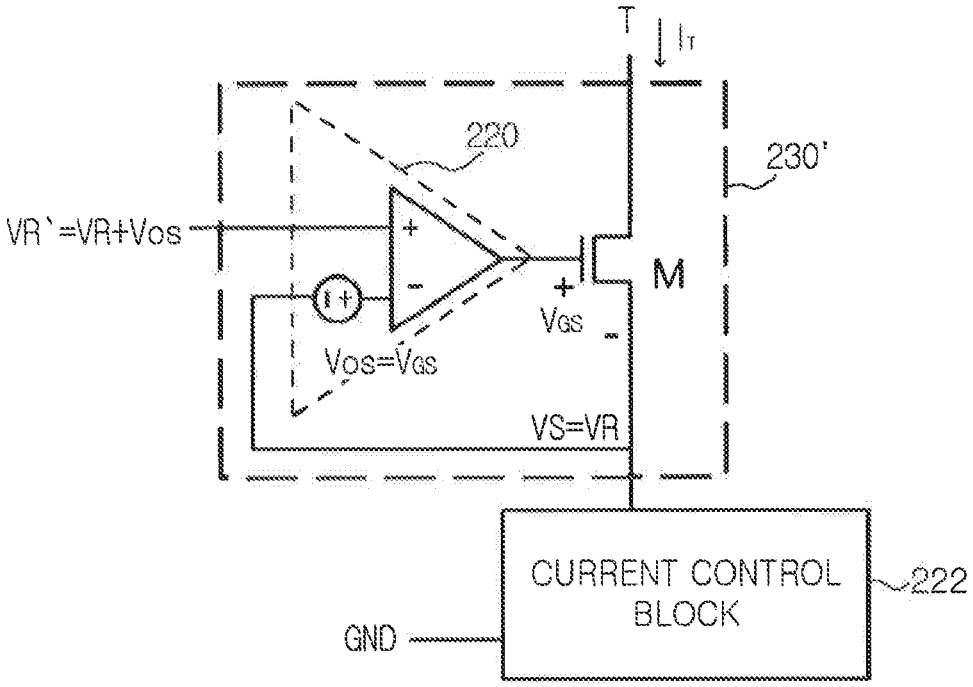

FIGS. 11 and 12 are views schematically illustrating an example of the comprehensive current control unit 230 in a state of being driven and a behavioral model of the comprehensive current control unit in order to explain an operation of the current control unit 223 in the case in which the current control block **221*b* illustrated in FIG. 10 is applied. Specifically, FIGS. 11 and 12 illustrate a portion of a driving control unit employing the comprehensive current control unit 230 without a controller and a comprehensive current control unit 230'** including a virtual controller as a behavioral model of the comprehensive current control unit.

In FIGS. 11 and 12, descriptions will be made on the basis of the comprehensive current control units 230 and 230' connected to a input terminal T in a state of being driven, for the purposes of description. Here, the comprehensive current control units 230 and 230' are current control units in a comprehensive sense that controls a current $I_T$ input through a connected input terminal T upon receiving a reference signal and a current sensing signal. In detail, the comprehensive current control unit 230 may be configured as a current control unit including one or more known current control elements (transistors) such as a MOSFET, a BJT, an IGBT, a JEFT, a DMOSFET, and the like, and may be configured to further include a unit for comparing and amplifying input signals, i.e., a controller, and the like. Thus, the comprehensive current control unit 230 is not limited to the embodiment including a MOSFET (M) in FIG. 11. FIG. 11 illustrates an embodiment in which the comprehensive current control unit 230 is only configured with a current control unit, i.e., the MOSFET (M).

First, referring to FIG. 11, an operational state of the current control element M as the comprehensive current control unit 230 may be determined. In FIG. 11, the current control element M directly receives a current sensing voltage having a magnitude VR (VS=VR) from the current sensing block 222, and receives a reference voltage (VR'=VR+VOS) having a magnitude VR+VOS from the current control block **221*b*. Here, VR is a reference voltage input to an ideal controller when the same input current is driven by applying the current control block 221*a* illustrated in FIG. 9. In the case in which the current control block 221*b* as illustrated in FIG. 10 is applied, the reference voltage VR' input to the current control element M as the comprehensive current control unit 230 is different from the reference voltage VR input to an ideal controller in use. Without a controller, the reference voltage input to the current control unit has a value (VR+VOS) obtained by adding an offset voltage (VOS) to the reference voltage VR input to the ideal controller. The offset voltage is a value determined according to electrical characteristics of the current control element M and a magnitude of a current flowing in the current control element M. Thus, the reference voltage VR' input to the current control element M as the comprehensive current control unit 230** may be determined as VR'=VR+VOS in advance.

An operation of the current control element M as the comprehensive current control unit 230 illustrated in FIG. 11 will be described. The current control element M receives the reference voltage VR' from the current control block **221*b* and receives the current sensing voltage VS from the current sensing block 222 to control the input current $I_T$, and the input current $I_T$ is delivered to the current sensing block 222 through the current control element M. The current sensing block 222 may input the current sensing voltage VS generated by reflecting the delivered input current $I_T$ to an output terminal of the current control element M, whereby a magnitude of the input current $I_T$ may be regulated according to variations in the current sensing voltage VS. This means that the input current $I_T$ flows in proportion to a difference between the input reference voltage VR' and the current sensing voltage VS (VGS=VR'−VS). In this case, the single current control element M may be understood as the comprehensive current control unit 230** including a function of a controller that compares two input signals and outputs a control signal according to a difference therebetween to control an input current.

FIG. 12 illustrates a behavioral model of the comprehensive current control unit in order to explain an operation of the comprehensive current control unit 230. Namely, the current control element M illustrated in FIG. 11 may be a comprehensive current control unit 230' including a virtual controller 220 as illustrated in FIG. 12. Here, the virtual controller 220 of FIG. 12 outputs a virtual control signal in proportion to the difference (VR'−VS) between the reference voltage VR' and the current sensing voltage VS to the current control unit M, and the current control unit M may control the current $I_T$ input through the input terminal T according to the virtual control signal input from the virtual controller 220. Also, it can be seen that the virtual controller reflects an offset voltage VOS included in the comprehensive current control unit 230.

Referring to FIG. 12, the comprehensive current control unit according to the present embodiment does not require an input terminal and a signal line for receiving the current sensing voltage Vs. Namely, the current sensing block 222 may receive a current from an output terminal of the comprehensive current control unit 230' and input a current sensing signal in the form of a voltage to the output terminal of the comprehensive current control unit 230'. Then, the current sensing block 222 may deliver the current sensing signal to the comprehensive current control unit 230' without using a separate signal line and an input terminal.

Accordingly, in the case in which the current control block 221*b* illustrated in FIG. 10 is applied, the current control unit 223 further includes the virtual controller 220 that controls a current input to each input terminal. The virtual controller 220 may receive current sensing signals in the form of voltages from the respective output terminals of the current control unit 223, and receive reference voltages VR1', VR2', . . . , VRn' from the current control block 221*b* and output a virtual control signal in proportion to a difference between two signals to the current control units M1, M2, . . . , Mn. In this case, even when the comprehensive current control unit is implemented as only a current control element M without a controller, it may be regarded as including the virtual controller 220 by itself, as illustrated in FIG. 12, and thus, the configuration of the current control block may be significantly simplified.

When the current control element M operates as if it had the virtual controller 220, the virtual controller 220 operates such that a magnitude of an output signal (VGS+VS) in proportion to a difference between two input signals, namely, a gain of the controller, is low, and an offset voltage is added to a signal input to the inverting negative (−) input terminal among the two input signals, in comparison to a general controller. Here, the offset voltage may be considered as a value approximate to a magnitude of the reference voltage VR' when a driving current starts to flow to the current control element M (namely, when the VR is close to 0) in FIG. 11, but more strictly, it is a difference (VOS=VGS) between two input voltages to be applied to the current control element M to drive a pre-set current. The offset voltage is affected by a magnitude of a driven current and electrical characteristics of the current control element M, so it is not a fixed value, but since the current control element M and a magnitude of a driven current are determined by input terminals in advance, the offset voltage value may be regarded as a fixed value as described above.

In order to complement shortcomings that the offset voltage VOS varies according to a change in the driving current $I_T$ of the current control element M due to a small gain in the virtual controller 220, a current control element in which an output current (e.g., $I_T$ in FIG. 12) is greatly changed according to a change in an input voltage (e.g., VGS in FIG. 12), namely, a current control element having high trans-conductance, may be used. Since a bipolar junction transistor (BJT) or a current control unit including a BJT has high trans-conductance, it may be advantageously used as the comprehensive current control unit 230, but the present invention is not limited thereto.

In order to cancel out the offset voltage VOS in the virtual controller 220, the offset voltage may be added to the reference voltage VR and delivered to the comprehensive current control unit 230. Since the controller outputs a signal in proportion to a difference between two input signals, when it is considered that the offset voltages VOS input with the same magnitude are canceled out, the controller (the controller indicated by the solid line in FIG. 12) may receive the reference voltage having a magnitude VR by the non-inverting positive (+) input terminal and the current sensing voltage VS having a magnitude VR by the inverting negative (−) input terminal equivalently. In this case, the two input signals input to the controller may have the same magnitude due to the operation of the controller. Also, when the offset voltages VOS are canceled out, the controller (the controller indicated by the solid line in FIG. 12) may receive the same input signal as that of the controller illustrated in FIG. 9. Namely, it may be considered that the controller included in the current control block 221*a* of FIG. 9 has been moved to the current control unit 223.

The above descriptions of the current control unit and the comprehensive current control unit may be summarized as follows. The comprehensive current control unit receives a reference signal and a current sensing signal and controls a current proportional to a difference therebetween to be driven, while the current control unit receives only a control signal and controls to drive a current proportional to a magnitude thereof. Namely, when the comprehensive current control unit does not have a controller, the comprehensive current control unit and the current control unit may be determined according to an input signal. Thus, it should be extensively understood that a current control unit drives a current according to a control signal and also drives a current according to a difference between a reference signal and a current sensing signal. In addition, as illustrated in FIG. 8, when the current control unit receives a current sensing signal from an output terminal thereof, the current control unit may drive a current upon receiving a control signal output from the current control block and may also drive a current upon receiving a reference signal from the current control block. In other words, when the current control unit receives the same current sensing signal as that of the controller, the current control unit may drive a current upon receiving a control signal corresponding to a magnitude of a reference signal, or a reference signal, and the current control block may output a control signal corresponding to a magnitude of a reference signal, or a reference signal, to control a current flowing in the current control unit.

In portions of this disclosure, although the offset voltage VOS of the comprehensive current control unit 230 is 0 and the comprehensive current control unit has significantly high trans-conductance, namely, even in the case that the comprehensive current control unit is ideal, it merely for the purposes of description and the present invention is not limited thereto.

In the above, the embodiment in which when the driving control unit drives sequentially high current levels with respect to the first to nth driving sections, the current sensing block and the current control block applied to the driving control unit are considerably simplified has been described. Here, although detailed descriptions of controlling a magnitude and a path of an input current according to a change in a driving section by the driving control unit are omitted, it may be understood as being similar to the case of FIG. 5 or 6 as described above.

Hereinafter, an embodiment in which a difference between reference signals of respective input terminals is reduced when an input terminal having higher degree drives a higher current with higher exclusive priority will be described. In this case, a magnitude of the current sensing signal is reduced in a driving section in which a current is high, reducing power consumed in the current sensing block and enhancing efficiency of the lighting device. Also, in this case, the first to nth current sensing signals have different magnitudes.

Figure 13:
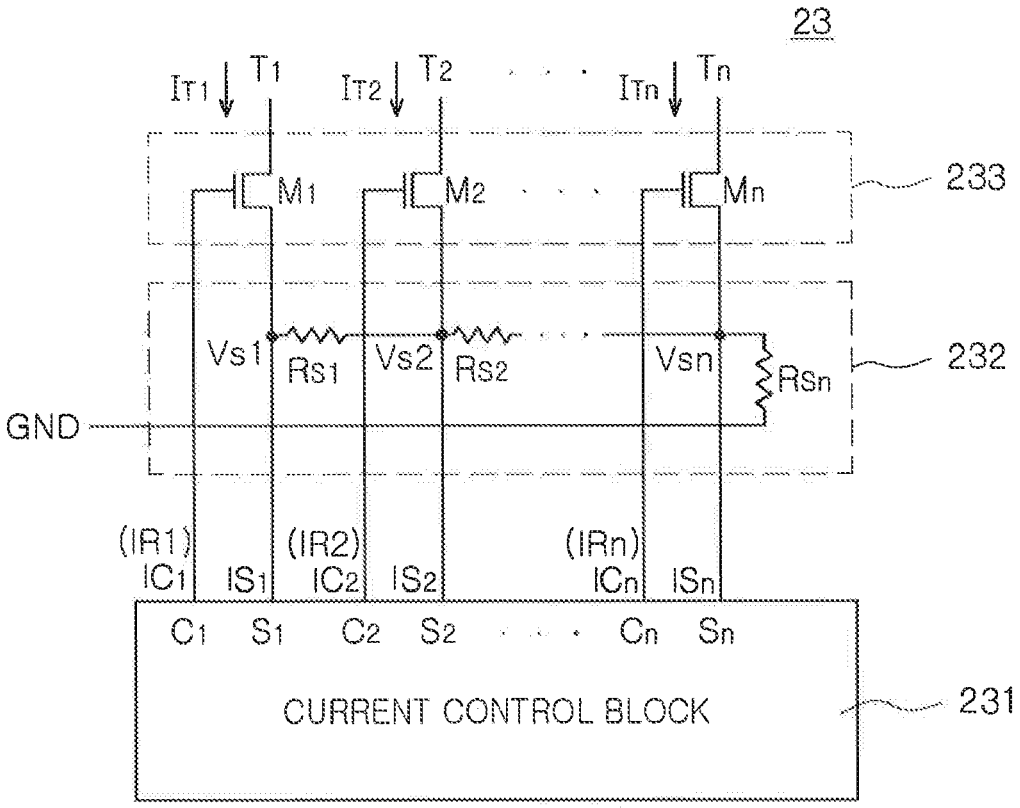
FIGS. 13 through 15 are views schematically illustrating another configuration of the driving control unit applicable to the LED driving device according to an embodiment of the present invention.

FIG. 13 schematically illustrates another example of the driving control unit 23 according to an embodiment of the present invention. In detail, it is another example of the driving control unit applicable to a case in which an input terminal having a higher degree drives a higher current with higher exclusive priority. In this embodiment, a difference between reference voltages of respective input terminals can be reduced.

Referring to FIG. 13, the driving control unit 23 according to the present embodiment may include a current sensing block 232 generating first to nth current sensing signals reflecting first to nth input currents $I_{T1}$, $I_{T2}$, . . . , $I_{Tn}$ input through first to nth input terminals T1, T2, . . . , Tn of the driving control unit 23 in predetermined ratios, a current control block 231 receiving the first to nth current sensing signals generated by the current sensing block 232 and outputting a signal for controlling a magnitude and a path of a current input to the driving control unit 23, and a current control unit 233 controlling currents input to the first to nth input terminals T1, T2, . . . , Tn of the driving control unit 23 according to the first to nth control signals output from the current control block 231.

Figure 14:
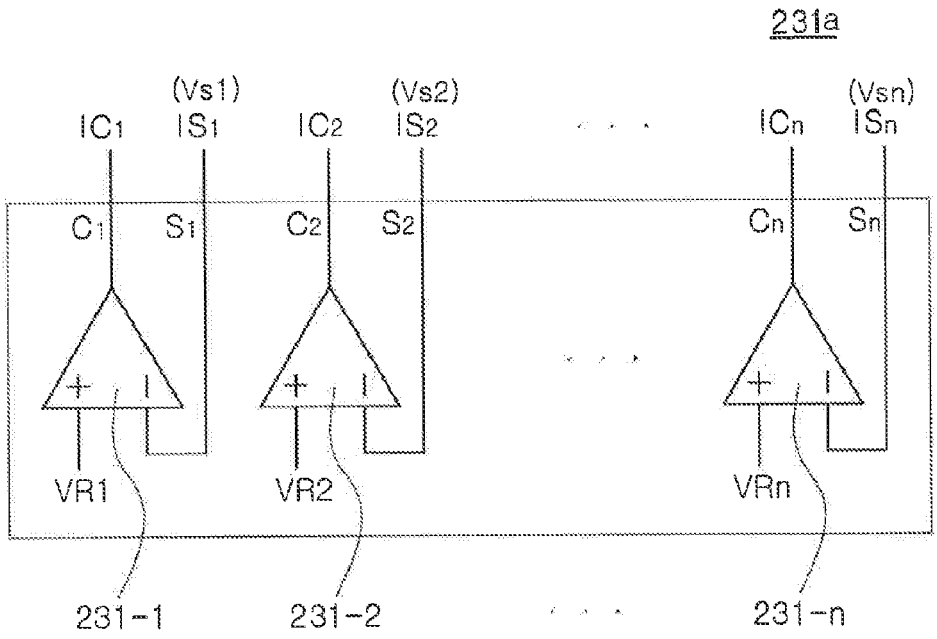
Figure 15:
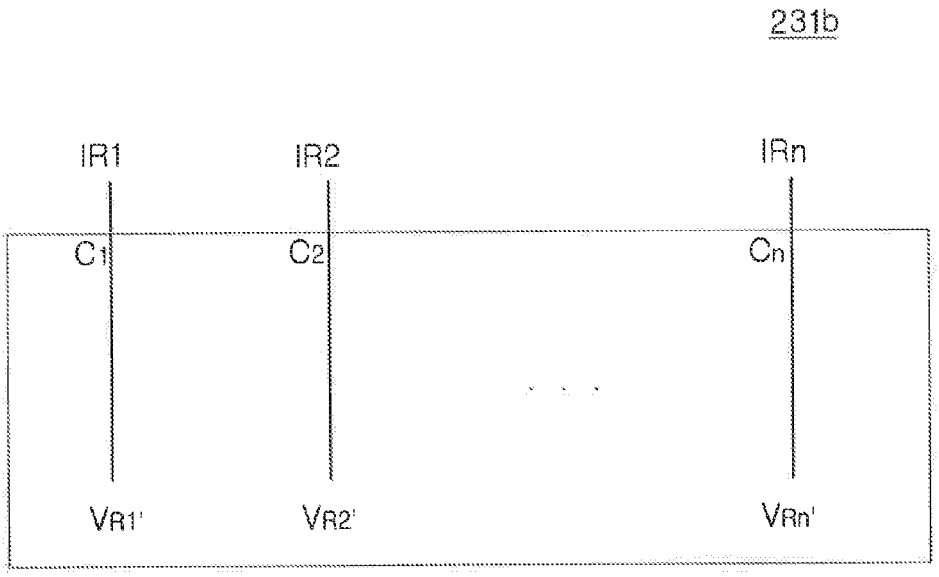

Also, FIGS. 14 and 15 schematically illustrate an embodiment of the current control block applicable to FIG. 13. An operation and principle thereof may be understood as being similar to those of FIGS. 9 and 10.

In the present embodiment, the current control unit 233 may include first to nth current control units M1, M2, . . . , Mn controlling magnitudes of first to nth input currents input to the first to nth input terminals of the driving control unit according to the first to nth control signals input from the current control block 231. The current control unit 233 may be similar to the current control unit 223 of FIG. 8 as described above.

Referring to FIG. 13, the current sensing block 232 may include a plurality of first to nth current sensing resistors Rs1, Rs2, . . . , Ran. The first to nth current sensing resistors Rs1, Rs2, . . . , Ran may be disposed between adjacent output terminals of the first to nth current control units connected to the first to nth input terminals of the driving control unit and between an output terminal of the nth current control unit and a ground GND, respectively. Here, the first to nth current sensing voltages generated by the driving control unit 23 illustrated in FIG. 13 may be represented by Equation (20) to Equation (22).

$$Vs1=R1\times I_{T1}+R2\times I_{T2}\ldots+Rn\times I_{Tn} \quad (20)$$

$$Vs2=R2\times I_{T1}+R2\times I_{T2}\ldots+Rn\times I_{Tn} \quad (21)$$

. . .

$$Vsn=Rn\times I_{T1}+Rn\times I_{T2}\ldots+Rn\times I_{Tn} \quad (22)$$

Here, R1=Rs1+Rs2+ . . . +Rsn, R2=Rs2+ . . . +Rsn, and Rn=Rsn.

Before determining whether the driving control unit having the current sensing voltages of Equation (20) to Equation (22) may be able to drive a current with a pre-set current level with respect to respective driving sections according to exclusive priority, it may be determined whether exclusive priority is guaranteed when the driving control unit has such current sensing voltages.

When the current sensing voltages are given as shown in Equation (20) to Equation (22), Equation (C1) to Equation (C4) as described above may be applied to check exclusive priority with respect to the two input terminals A and B. Namely, it was already confirmed that when Equation (C1) to Equation (C4) are all satisfied, the input terminal B has exclusive priority over the input terminal A (A<B).

Thus, when the current sensing voltages are given as expressed in Equation (20) and Equation (22), conditions for the first to nth input terminals to have higher exclusive priority in order of higher degree may be expressed by Equation (15) and Equation (23).

$$VR1<VR2<\ldots<VRn \quad (15)$$

$$I_{F1}<I_{F2}<\ldots<I_{Fn} \quad (23)$$

Also, according to an operation of the controller during respective driving sections, relationships $I_{F1}$=VR1/R1, $I_{F2}$=VR2/R2, and $I_{Fn}$=VRn/Rn are obtained. Thus, even when reference voltages are slightly differentiated to satisfy Equation (15), currents input to the respective input terminals of the driving control unit may be determined by a magnitude of current sensing resistance. Here, current sensing resistance should satisfy relationship R1>R2> . . . >Rn. It can be seen that the driving control unit 23 illustrated in FIG. 13 is appropriate for implementing a current sensing block satisfying the foregoing conditions. In the current sensing block illustrated in FIG. 13, a magnitude of the current sensing resistance Rn present on the path along which the highest input current flows is the lowest, and a different input current is delivered to the ground through the current sensing resistance Rn. The embodiment of the current sensing block corresponds properly to a preferred embodiment of the current sensing block as proposed above.

In addition, the driving control unit 23 illustrated in FIG. 13 is another embodiment applicable to a case in which an input terminal having higher degree drives a higher current with higher exclusive priority. In this embodiment, power consumed in the current sensing block is reduced by reducing a difference between reference voltages of input terminals. Also, the embodiment of the driving control unit illustrated in FIG. 13 may include a case in which there is no difference between the first to nth reference voltages, namely, a case in which all of the reference voltages VR1, VR2, . . . , VRn are equal. In this case, there is no need to generate and deliver a plurality of reference voltages and only a single reference voltage may be used, and thus, a lighting device can be more easily implemented.

In the present embodiment, the current sensing voltages Vs1, Vs2, . . . , Vsn input to respective controllers to control a current flowing in the current control unit 233 are voltages obtained from the respective output terminals of the current control unit 233. Thus, in this case, the respective current control units 233 may be comprehensive current control units including a virtual controller. Thus, the driving control unit 23 illustrated in FIG. 13 may be a different embodiment in which a current input through the current control unit 233 is controlled by the simple current control block 231*b*.

In the above, the different embodiment in which the current sensing block and the current control block applied to the driving control unit are considerably simplified when sequentially higher current levels are driven with respect to the first to nth driving sections has been described. Although detailed descriptions of controlling a magnitude and a path of an input current according to a change in a driving section by the driving control unit are omitted, it may be understood as being similar to the case of FIG. 5 or 6. Although detailed descriptions of components and operations of the driving control unit are omitted in the following description with respect to a different embodiment of the present invention, it may be understood as being similar to the case of FIG. 5 or 6, unless otherwise mentioned.

Hereinafter, an LED driving method of reducing a driving current in proportion to a DC voltage in a plurality of driving sections in which the DC source voltage V is high will be described. The LED driving method mentioned may be utilized to enhance the safety of a lighting device and obtain stable optical power in a case in which the DC source voltage fluctuates.

Figure 16:
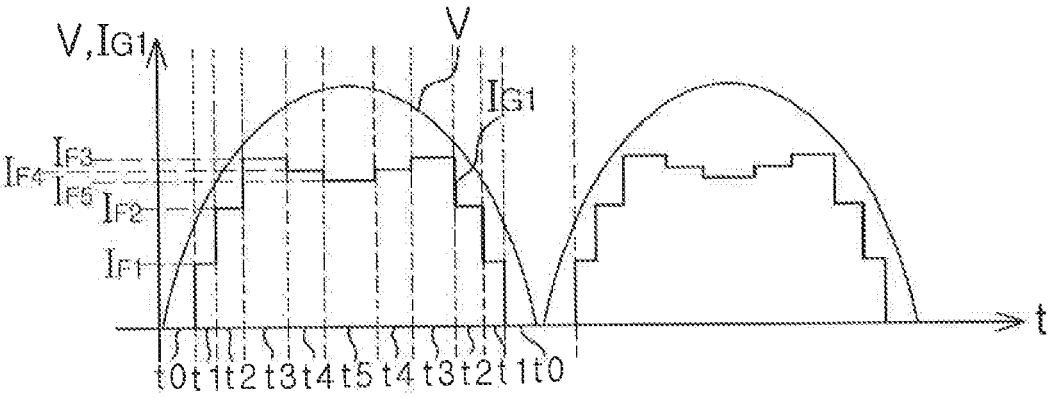
FIG. 16 is a view schematically illustrating a different type of current waveform applicable to the LED driving device according to an embodiment of the present invention.

FIG. 16 schematically illustrates a waveform of the DC source voltage V applied to the light source unit 30 and the driving current $I_{G1}$ flowing in the first LED group most adjacent to the DC source, when a current is driven such that it is inverse proportion to the DC source voltage V in a partial driving sections in which the DC source voltage V is high. In FIG. 16, five LED groups and five driving sections are illustrated for the purposes of description, but the present invention is not limited thereto and the number of the LED groups and the number of the driving sections may be modified to appropriate numbers. Also, as the DC source voltage V is increased, the number of driving sections in which the driving current $I_{G1}$ is increased and the number of driving sections in which the driving current $I_{G1}$ is decreased may be changed. Here, when a voltage and a current are in inverse proportion, it means that optical power is substantially uniformly maintained, while the product of a voltage and a current is substantially uniformly maintained, but it may also include a case in which optical power is decreased or increased according to an increase in the DC source voltage V.

In an embodiment of the driving control unit 21 illustrated in FIG. 6, there is no restriction on a magnitude of a current driven in each driving section, so the driving control unit may drive the current waveform illustrated in FIG. 16. However, the current waveform illustrated in FIG. 16 is divided into a driving section in which a driving current is increased in proportion to the DC source voltage V and a driving section in which a driving current is decreased in proportion to the DC source voltage V. Thus, an embodiment of a driving control unit appropriate for this case will be described hereinafter.

In the following description of another embodiment of the present invention, although detailed descriptions of some components and operations of the driving control unit are omitted, it may be understood as being similar to the case of FIG. 5 or 6 as described above, unless otherwise mentioned.

Figure 17:
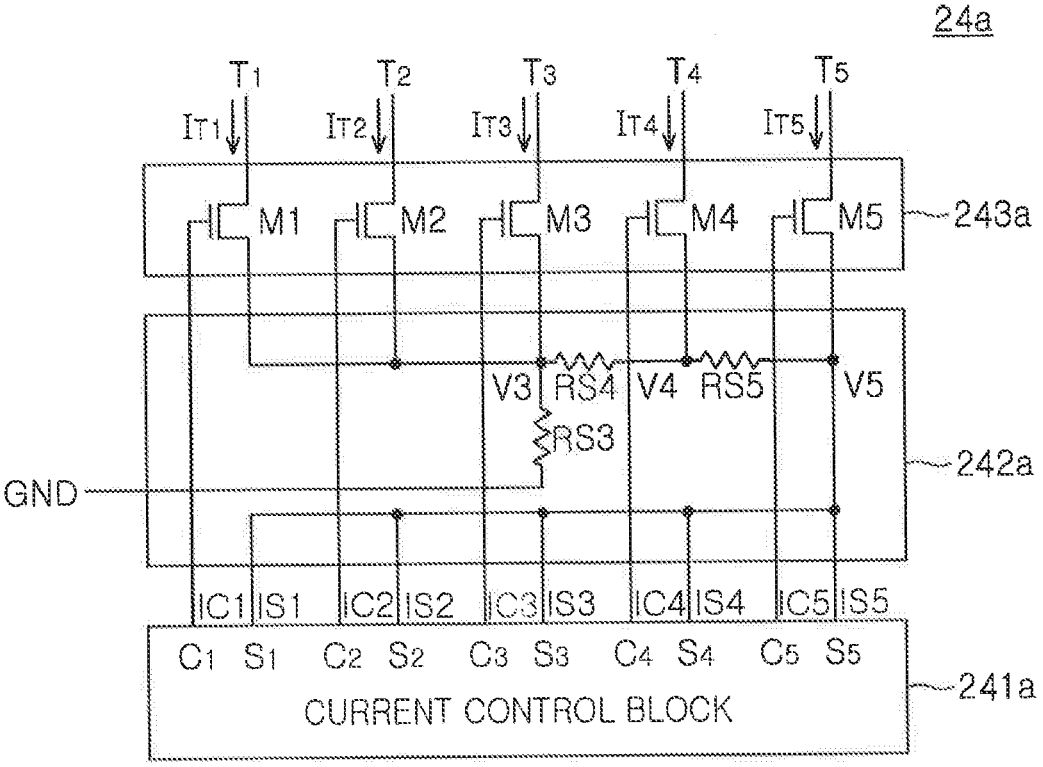
FIGS. 17 through 19 are views schematically illustrating various configurations of a driving control unit capable of driving the current waveform illustrated in FIG. 16.
Figure 18:
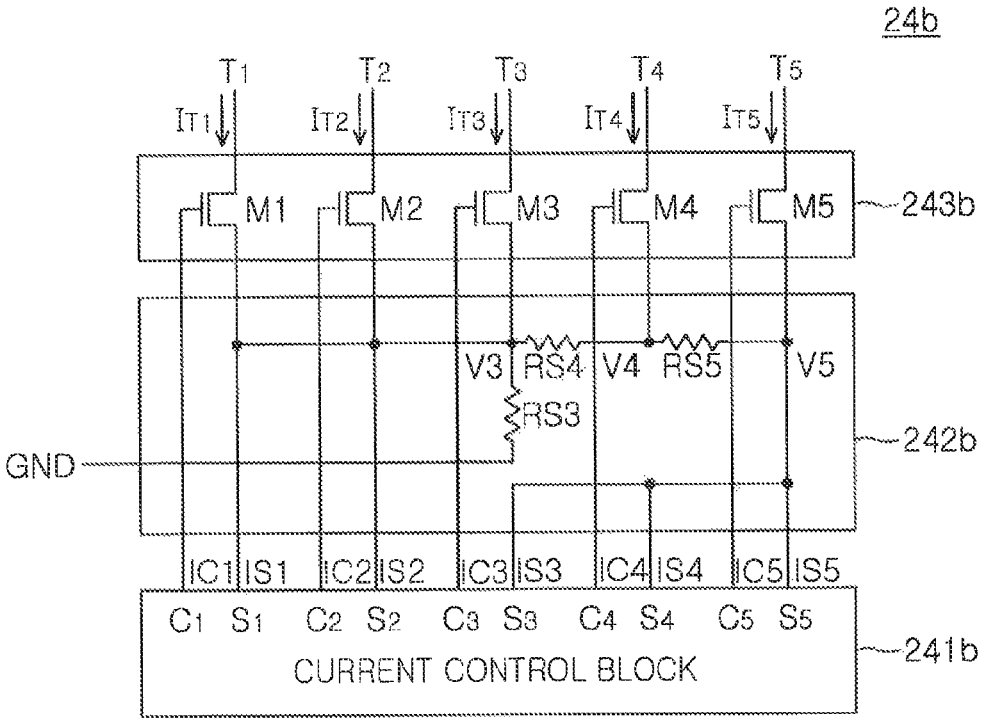
Figure 19:
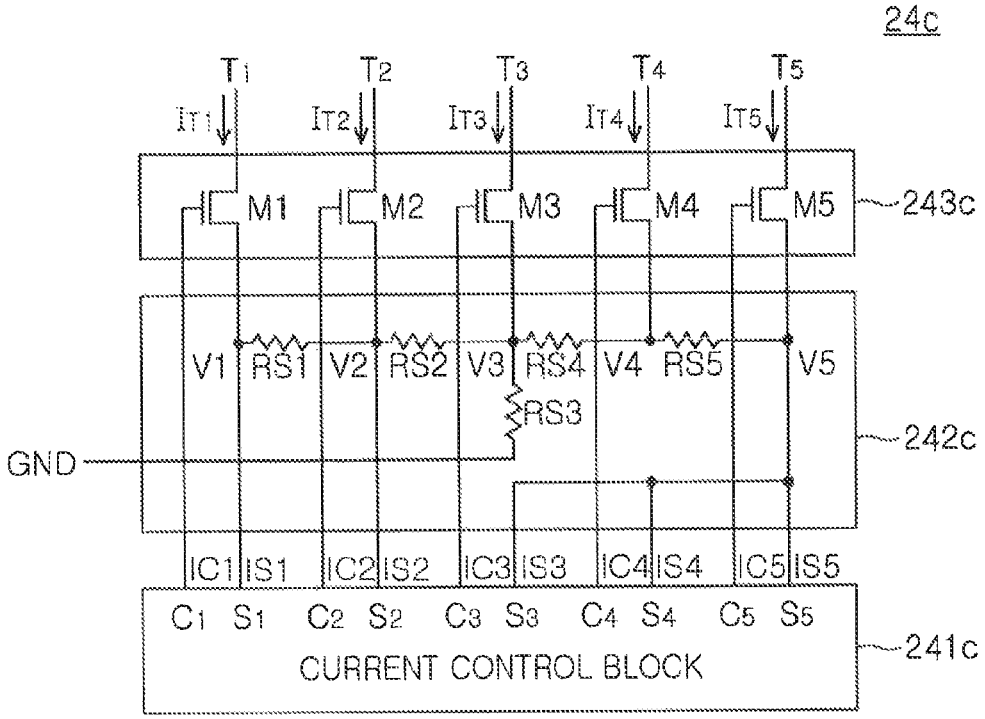

In the present embodiment, a current sensing block may be advantageously configured such that current sensing resistance on a path along which the highest input current flows is adjusted to be the lowest and a current input from a different input terminal is delivered to a ground through the entirety or a portion of current sensing resistances on a path along which the highest input current flows, in order to reduce power consumption in the current sensing block. FIGS. 17 through 19 illustrate various embodiments of a driving control unit including various embodiments of a current sensing block to which such a principle is applied and embodiments of a current control block appropriate for the respective current sensing blocks as proposed. All of these may be applied to drive the current waveform illustrated in FIG. 16. In FIGS. 17 through 19, for the purposes of descriptions, the current sensing block is implemented only with a linear resistor and all current sensing signals input to the current control block are in the form of a voltage, but the present invention is not limited thereto.

Meanwhile, regarding driving currents in regards to a current sensing voltage input to the current control block, as a current is input to the first to third input terminals, a current level is sequentially increased in each of the first to third driving sections, and as a current is input to third to fifth input terminals, a current level is sequentially reduced in each of the third to fifth driving sections. In order to secure exclusive priority with respect to input terminals which drive a current having a lower magnitude as the degree (or priority) thereof is higher, like the third to fifth input terminals, the magnitudes of the third to fifth current sensing signals should be maintained to be equal, as described above. In this case, the third to fifth current sensing voltages may be generated by reflecting the first to fifth input currents $I_{T1}$, $I_{T2}$, $I_{T3}$, $I_{T4}$, and $I_{T5}$ in the same proportion (R1, R2, R3, R4, and R5). Meanwhile, even in the case that the magnitudes of the first to third current sensing voltages are not equal, exclusive priority may be secured among the first to third input terminals. Details thereof will be described through an embodiment below.

First, referring to FIG. 17, a driving control unit 24*a* according to the present embodiment receives the same current sensing voltage V5 through first to fifth input terminals S1, S2, . . . , S5 of a current control block 241*a*. Here, in order for the first to fifth input terminals T1, T2, . . . , T5 having a higher degree to have higher exclusive priority, Equation (15), namely, VR1<VR2<VR3<VR4<VR5 should be satisfied. Also, magnitudes of currents driven by the respective input terminals, namely, first to fifth current levels $I_{F1}$, $I_{F2}$, . . . , $I_{F5}$, should be determined by current sensing resistors Rs3, Rs4, and Rs5 and first to fifth reference voltages VR1, VR2, . . . , VR5. Current sensing voltages in the driving control unit 24*a* illustrated in FIG. 17 may be expressed by Equation (24).

$$Vs1=Vs2=Vs3=Vs4=Vs5=V5=I_{T1}\times R3+I_{T2}\times R3+I_{T3}\times R3+I_{T4}\times R4+I_{T5}\times R5 \quad (24)$$

Here, R3=Rs3, R4=Rs3+Rs4, and R5=Rs3+Rs4+Rs5.

In Equation (24), when a current having a first current level $I_{F1}$ is input to the first input terminal T1 and no current is not input to the other input terminals, all of the current sensing voltages V5 are $I_{F1}\times$Rs3. Since the first current sensing voltage Vs1 is equal to the first reference voltage according to an operation of the first controller in the first driving section t1, VR1=$I_{F1}\times$Rs3 is satisfied. Thus, when VR1 is first determined, the magnitude of the resistor Rs3 on the path along which the first to third input currents $I_{T1}$, $I_{T2}$, and $I_{T3}$ flow may be determined based on Rs3=VR1/$I_{F1}$.

In the same manner, based on the pre-set second current level $I_{F2}$ and the third current level $I_{F3}$ and the predetermined Rs3, VR2 and VR3 may be easily determined based on the relationship of VR2=$I_{F2}\times$Rs3 and VR3=$I_{F3}\times$Rs3. Also, when the fourth input terminal T4 is driven at the fourth current level $I_{F4}$ and no current is input to the other input terminals, the relationship of VR4=$I_{F4}\times$(Rs3+Rs4) may be obtained from Equation (24). When VR4 is determined as a value greater than VR3, since $I_{F4}$ and Rs3 are already determined values, Rs4 may be easily determined as a value.

Finally, when a current having a fifth current level $I_{F5}$ is input to the fifth input terminal T5 and no current is input to the other input terminals, the relationship of VR5=$I_{F5}\times$(Rs3+

Rs4+Rs5) may be obtained from Equation (24). Here, when VR5 is determined as a value greater than VR4, since $I_{F4}$, Rs3 and Rs4 are already determined values, Rs5 may be easily determined.

Meanwhile, current levels that may be driven by the driving control unit 24*a* illustrated in FIG. 17 should satisfy the following relationship. Namely, since reference voltages have the relationship of $\{VR1=I_{F1}\times Rs3\}<\{VR2=I_{F2}\times Rs3\}<\{VR3=I_{F3}\times Rs3\}$, the relationship of current levels $I_{F1}<I_{F2}<I_{F3}$ should be satisfied. The conditions are all satisfied in the current waveform illustrated in FIG. 16, and thus, it can be seen that the driving control unit 24*a* of FIG. 17 corresponds to an embodiment of a driving control unit that can drive the current waveform of FIG. 16.

Hereinafter, conditions required for driving the current waveform illustrated in FIG. 16, while maintaining exclusive priority as is among input terminals even in a case (please see FIG. 18) of changing first and second current sensing voltages into $Vs1=Vs2=V3=I_{T1}\times Rs3+I_{T2}\times Rs3+I_{T3}\times Rs3+I_{T4}\times Rs3+I_{T5}\times Rs3$ by the driving control unit 24*a* illustrated in FIG. 17, and advantages will be described.

First, the first to fifth current sensing voltages of a driving control unit 24*b* illustrated in FIG. 18 may be expressed as follows. Here, the third to fifth current sensing voltages should be equal to secure exclusive priority as shown in Equation (26)

$$Vs1=Vs2=I_{T1}\times R3+I_{T2}\times R3+I_{T3}\times R3+I_{T4}\times R3+I_{T5}\times R3 \quad (25)$$

$$Vs3=Vs4=Vs5=I_{T1}\times R3+I_{T2}\times R3+I_{T3}\times R3+I_{T4}\times R4+I_{T5}\times R5 \quad (26)$$

Here, R3=Rs3, R4=Rs3+Rs4, and R5=Rs3+Rs4+Rs5.

In the driving control unit 24*b* illustrated in FIG. 18, when the reference voltages of the first and second controllers (not shown) controlling the first and second input terminals T1 and T2, respectively, satisfy VR1<VR2, since the first and second current sensing voltages Vs1 and Vs2 are equal, exclusive priority may be secured between the first input terminal T1 and the second input terminal T2 by Equation (14) and Equation (15). Similarly, when VR3<VR4<VR5 is satisfied, exclusive priority may be secured among the third to fifth input terminals T3, T4, and T5 in order of higher degrees of the input terminals. However, since the first and second input terminals T1 and T2 and the third to fifth input terminals T3, T4, and T5 have current sensing voltages having different magnitudes, whether exclusive priority is guaranteed should be determined.

In order for the driving control unit 24*b* illustrated in FIG. 18 to secure exclusive priority, first, priority levels of input terminals should be secured. Conditions for the third to fifth input terminals T3, T4 and T5 to have higher priority over the first and second input terminals T1 and T2 are as follows. Namely, in Equation (26), in order for the third to fifth input terminals T3, . . . , T5 to have higher priority over the first and second input terminals T1 and T2, $\{VR1=I_{F1}\times Rs3, VR2=I_{F2}\times Rs3\}<\{VR3=I_{F3}\times Rs3, VR4=I_{F4}\times(Rs3+Rs4), VR5=I_{F5}\times(Rs3+Rs4+Rs5)\}$ should be satisfied. Here, {A, B}<{C, D, E} means that both A and B are smaller than C, D and E.

When the condition of VR3<VR4<VR5 is satisfied, only $\{VR1=I_{F1}\times Rs3, VR2=I_{F2}\times Rs3\}<\{VR3=I_{F3}\times Rs3\}$ remains as conditions for the third to fifth input terminals T3, T4, and T5 have higher priority over the first and second input terminals T1 and T2, and the conditions may be simplified into $\{I_{F1}, I_{F2}\}<I_{F3}$. Also, in Equation (25), in order for the second input terminal T2 to have a higher priority over the first input terminal T1, $I_{F1}<I_{F2}$ should be satisfied. The reason is because, since the second current sensing voltage Vs2 obtained when the first input current is equal to the first current level ($I_{T1}=I_{F1}$) is given as $I_{F1}\times Rs3$, and the second reference voltage VR2 is given as $VR2=I_{F2}\times Rs3$, and thus, in order for the second reference voltage VR2 to be higher than the second current sensing voltage ($Vs2=I_{F1}\times Rs3$), the condition of $I_{F1}<I_{F2}$ should be satisfied.

Thus, in the driving control unit 24*b* illustrated in FIG. 18, in order for the first to fifth input terminals to have higher priority as their degrees are higher, conditions of $I_{F1}<I_{F2}<I_{F3}$ and VR1<VR2<VR3<VR4<VR5 should be all satisfied.

In the present embodiment 24*b*, in order to secure exclusive priority, the following conditions should be further satisfied. Namely, $\{VR1=I_{F1}\times Rs3\}<\{VR2=I_{F2}\times Rs3\}<\{VR3=I_{F3}\times Rs3, I_{F4}\times Rs3, I_{F5}\times Rs3\}$ should be satisfied. Here, equations $\{VR1=I_{F1}\times Rs3\}<\{VR2=I_{F2}\times Rs3\}$ are conditions further required for the second input terminal T2 to have exclusive priority over the first input terminal T1, and $\{VR2=I_{F2}\times Rs3\}<\{VR3=I_{F3}\times Rs3, I_{F4}\times Rs3, I_{F5}\times Rs3\}$ are conditions for the third to fifth input terminals T3, T4, and T5 to have higher exclusive priority over the second input terminal T2. Namely, all of $I_{F3}\times Rs3$, $I_{F4}\times Rs3$, and $I_{F5}\times Rs3$ should be greater than the second reference voltage VR2.

Thus, in the illustrated driving control unit 24*b*, conditions for input terminals to have exclusive priority in order of higher degrees of the input terminals may be expressed as follows.

$$I_{F1}<I_{F2}<\{I_{F3},I_{F4},I_{F5}\} \quad (27)$$

$$VR1<VR2<VR3<VR4<VR5 \quad (28)$$

Here, since an equation related to a current sensing voltage is uniquely determined by the current sensing block, so it is not expressed as a separate condition. VR1<VR2 is a condition required for setting exclusive priority between first and second input terminals T1 and T2, and VR3<VR4<VR5 are conditions for setting exclusive priority among third to fifth input terminals T3, T4, and T5. $I_{F1}<I_{F2}$ is a relationship incidentally obtained when the condition of VR1<VR2 is satisfied in the driving control unit 24*b*.

The driving control unit 24*a* illustrated in FIG. 17 should satisfy a relationship of current levels $I_{F1}<I_{F2}<I_{F3}$ to satisfy exclusive priority, while in order for the driving control unit 24*b* illustrated in FIG. 18 to secure exclusive priority. The condition of Equation (27) should be satisfied. However, the current waveform illustrated in FIG. 16 may satisfy all of the conditions regarding current levels for the driving control units illustrated in FIGS. 17 and 18 to have exclusive priority. Thus, like the driving control unit 24*a* illustrated in FIG. 17, the driving control unit 24*b* illustrated in FIG. 18 may be another embodiment that can drive the current waveform of FIG. 16, while maintaining higher exclusive priority in order of higher degrees of input terminals.

In comparison to the driving control unit 24*a* illustrated in FIG. 17, in order for the driving control unit 24*b* of FIG. 18 to have higher exclusive priority in order of higher degrees of the input terminals, one more condition is required. However, when this condition is satisfied, the controller controlling currents input to the first and second input terminals in the driving control unit 24*b* illustrated in FIG. 18 can be simplified. Namely, since the first and second current sensing voltages are output to the output terminals of the current control unit controlling currents of the first and second input terminals, respectively, the controller may be implemented to be very simple, similar to that illustrated in FIGS. 10 and 15. Also, it can be seen that the input terminals implementing the simple controller in FIG. 18 are the first, second, and fifth input terminals. Meanwhile, in the case of the driving control unit 24*a* illustrated in FIG. 17, it can be seen that an input terminal constituting the simple controller is only the fifth input terminal.

Referring to FIG. 18, the first and second current sensing voltages Vs1 and Vs2 of FIG. 17 are changed from V5 to V3, and the other components are the same. In FIGS. 17 and 18, the first and second reference voltages VR1 and VR2 are determined such that magnitudes of currents flowing through the resistor Rs3 satisfy $I_{F1}$ and $I_{F2}$ when the first and second reference voltages VR1 and VR2 are applied to the resistor Rs3, and thus, if $I_{F1}$ and $I_{F2}$ are low, the first and second reference voltages VR1 and VR2 may have very low values, relative to the third to fifth reference voltages VR3, VR4, and VR5. In a different point of view, it may be understood such that as the difference between the first and second reference voltages and the third to fifth reference voltages grows bigger, the third to fifth reference voltages VR3, VR4, and VR5 are increased.

Hereinafter, a method for maintaining exclusive priority while reducing the difference between the first and second reference voltages VR1 and VR2 and the third to fifth reference voltages VR3, VR4, and VR5 will be described. By reducing the difference between reference voltages, a reference voltage of an input terminal driving a large amount of current may be lowered and power consumption in the current sensing block may be reduced. The principle thereof is similar to the case of the driving control unit 23 illustrated in FIG. 13.

FIG. 19 is a view schematically illustrating another embodiment of a driving control unit applicable to drive the current waves illustrated in FIG. 16. In detail, it relates to a driving control unit capable of maintaining exclusive priority while reducing the difference between the first and second reference voltages VR1 and VR2 and the third to fifth reference voltages VR3, VR4, and VR5. Referring to FIG. 19, the first and second current sensing resistors Rs1 and Rs2 may be further disposed between respective output terminals of the current control unit 243*c* connected to the first to third input terminals T1, T2, and T3. Here, in the driving control unit 24*c* illustrated in FIG. 19, the first and second current sensing voltages Vs1 and Vs2 may be expressed as follows. Also, in this case, the third to fifth current sensing voltages should be maintained to be equal in order to secure exclusive priority, and the first to fifth input currents $I_{T1}, I_{T2}, \ldots, I_{T5}$ are reflected in the third to fifth current sensing signals in the same proportion R1, R2, . . . , R5. Meanwhile, proportions of the first and second input currents $I_{T1}$ and $I_{T2}$ reflected in the first to third current sensing voltages are not same.

$$Vs1=I_{T1}\times R1+I_{T2}\times R2+I_{T3}\times R3+I_{T4}\times R3+I_{T5}\times R3 \quad (29)$$

$$Vs2=I_{T1}\times R2+I_{T2}\times R2+I_{T3}\times R3+I_{T4}\times R3+I_{T5}\times R3 \quad (30)$$

$$Vs3=Vs4=Vs5=V5=I_{T1}\times R3+I_{T2}\times R3+I_{T3}\times R3+I_{T4}\times R4+I_{T5}\times R5 \quad (31)$$

Here, R1=Rs1+R2, R2=Rs2+R3, R3=Rs3, R4=R3+Rs4 and R5=R4+Rs5.

In order for the driving control unit 24*c* illustrated in FIG. 19 to secure exclusive priority, first, priority among input terminals should be secured. In Equation (31), the third to fifth input terminals all use the same current sensing voltage. Thus, in order to have higher priority in order of higher degrees of input terminals, the third to fifth reference voltages should have sequentially greater values. Namely, VR3<VR4<VR5 should be satisfied. Also, in Equation (31), in order for the third to fifth input terminals T3, T4 and T5 to have higher priority over the first and second input terminals T1 and T2, $\{I_{F1}\times Rs3, I_{F2}\times Rs3\}<\{VR3=I_{F3}\times Rs3, VR4=I_{F4}\times(Rs3+Rs4), VR5=I_{F5}\times(Rs3+Rs4+Rs5)\}$ should be satisfied.

When the condition of VR3<VR4<VR5 is satisfied, only $\{I_{F1}\times Rs3, I_{F2}\times Rs3\}<\{VR3=I_{F3}\times Rs3\}$ remains as a condition for the third to fifth input terminals T3, T4, and T5 to have higher priority over the first and second input terminals T1 and T2, and it may be simplified into $\{I_{F1}, I_{F2}\}<I_{F3}$. Also, in Equation (30), in order for the second input terminal T2 to have higher priority over the first input terminal T1, $I_{F1}<I_{F2}$ should be satisfied. The reason is because, the second current sensing voltage Vs2 obtained when the first input current is equal to the first current level ($I_{T1}=I_{F1}$) is given as $I_{F1}\times(Rs2+Rs3)$ and the second reference voltage VR2 is given as $VR2=I_{F2}\times(Rs2+Rs3)$, and thus, in order for the second reference voltage VR2 to be higher than the second current sensing voltage $Vs2=I_{F1}\times(Rs2+Rs3)$, the condition of $I_{F1}<I_{F2}$ should be satisfied.

Thus, in the driving control unit 24*c* illustrated in FIG. 19, in order for the first to fifth input terminals to have higher priority as degrees thereof are higher, conditions of $I_{F1}<I_{F2}<I_{F3}$, VR1<VR2 and VR3<VR4<VR5 should be all satisfied.

In case of configuring a current sensing block 242*c* including the first and second current sensing resistors Rs1 and Rs2 added thereof as in the present embodiment 24*c*, even though the first and second reference voltages VR1 and VR2 are increased, if the following conditions are met, the first and second current levels $I_{F1}$ and $I_{F2}$ may be maintained as is together with exclusive priority. Namely, values of the resistors Rs1 and Rs2 may be determined such that the first and second current levels $I_{F1}$ and $I_{F2}$ are maintained as is, while increasing the first and second reference voltages VR1 and VR2 within a range in which $\{VR1=I_{F1}\times(Rs1+Rs2+Rs3)\}<\{VR2=I_{F2}\times(Rs2+Rs3)\}<\{VR3=I_{F3}\times Rs3, I_{F4}\times Rs3, I_{F5}\times Rs3\}$ are satisfied. Here, the equation $\{VR1=I_{F1}\times(Rs1+RS2+Rs3)\}<\{VR2=I_{F2}\times(Rs2+Rs3)\}$ is a condition further required for the second input terminal T2 to have exclusive priority over the first input terminal T1, and $\{VR2=I_{F2}\times(Rs2+Rs3)\}<\{VR3=I_{F3}\times Rs3, I_{F4}\times Rs3, I_{F5}\times Rs3\}$ is a condition for the third to fifth input terminals T3, T4, and T5 to have higher exclusive priority over the second input terminal T2. Namely, all of $I_{F3}\times Rs3$, $I_{F4}\times Rs3$, and $I_{F5}\times Rs3$ should be greater than the second reference voltage ($VR2=I_{F2}\times(Rs2+Rs3)$).

Thus, in the embodiment illustrated in FIG. 19, even in the case that the first and second reference voltages are increased within a predetermined range, when Equation (32) and Equation (33) are satisfied, exclusive priority may be secured, like in FIG. 18.

$$VR1<VR2<VR3<VR4<VR5 \quad (32)$$

$$I_{F1}\times(Rs2+Rs3)<I_{F2}\times(Rs2+Rs3)<\{I_{F3}\times Rs3, I_{F4}\times Rs3, I_{F5}\times Rs3\} \quad (33)$$

Here, in case of Rs2=0, Equation (33) may be simply expressed as $I_{F1}<I_{F2}<\{I_{F3}, I_{F4}, I_{F5}\}$. When a difference between the second current level $I_{F2}$ and the third current level $I_{F3}$ is not significant, an effect of increasing the first and second reference voltages VR1 and VR2 by the second current sensing resistor Rs2 is so small that it may not be used. If the second current level $I_{F2}$ is too high to satisfy Equation (33), the second current sensing voltage for controlling the second input current is adjusted to be equal to the third to fifth current sensing voltages (Vs2=Vs3=Vs4=Vs5=V5) to secure exclusive priority. In a case in which even the first current level is so high that it cannot satisfy Equation (33), all of the first to fifth current sensing voltages are adjusted to be equal (Vs1=Vs2=Vs3=Vs4=Vs5=V5) to secure exclusive priority, and in this case, the driving control unit of FIG. 17 is applied.

Figure 20:
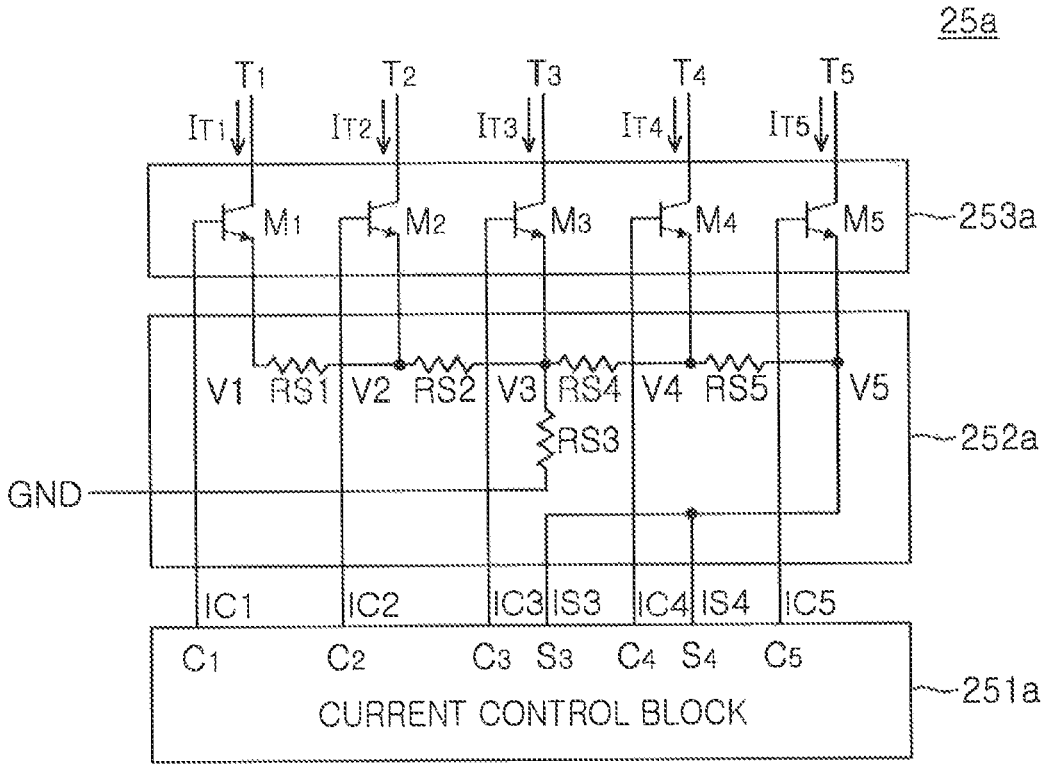
FIGS. 20 through 22 are views schematically illustrating various modifications of the driving control unit illustrated in FIG. 19.
Figure 21:
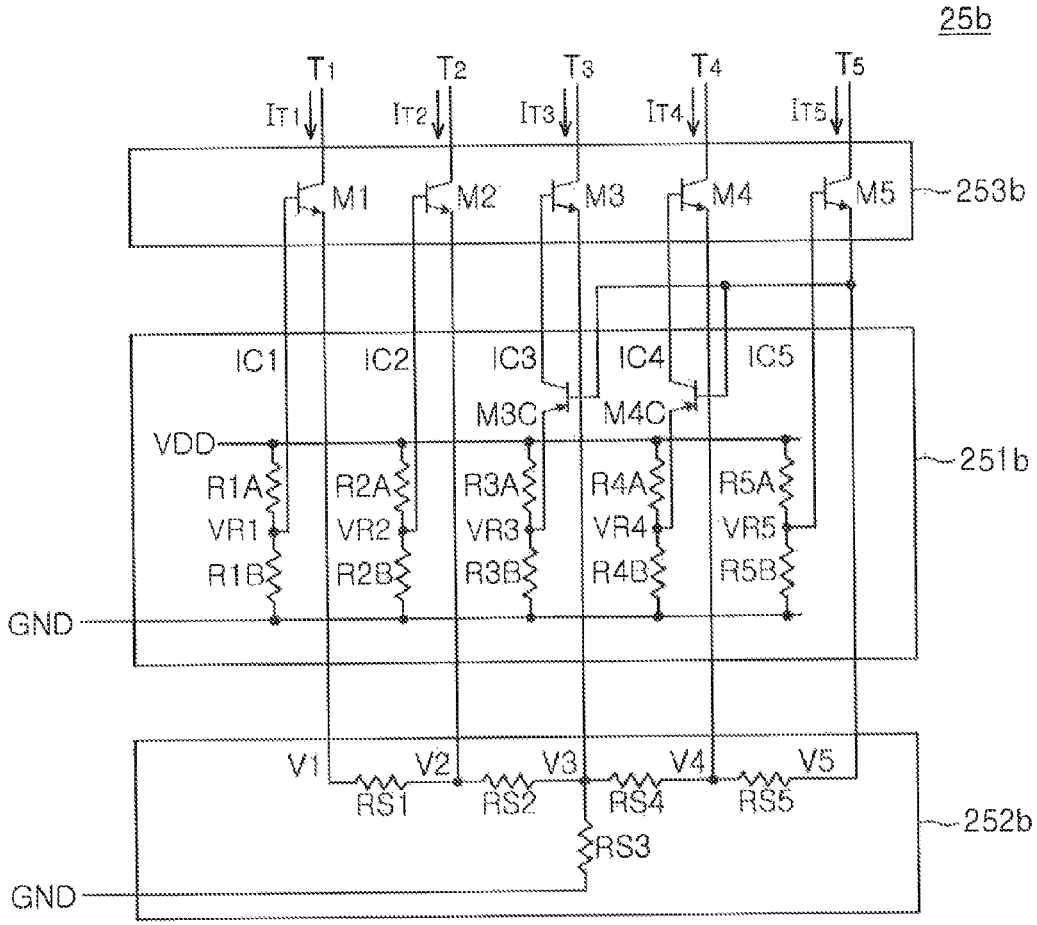
Figure 22:
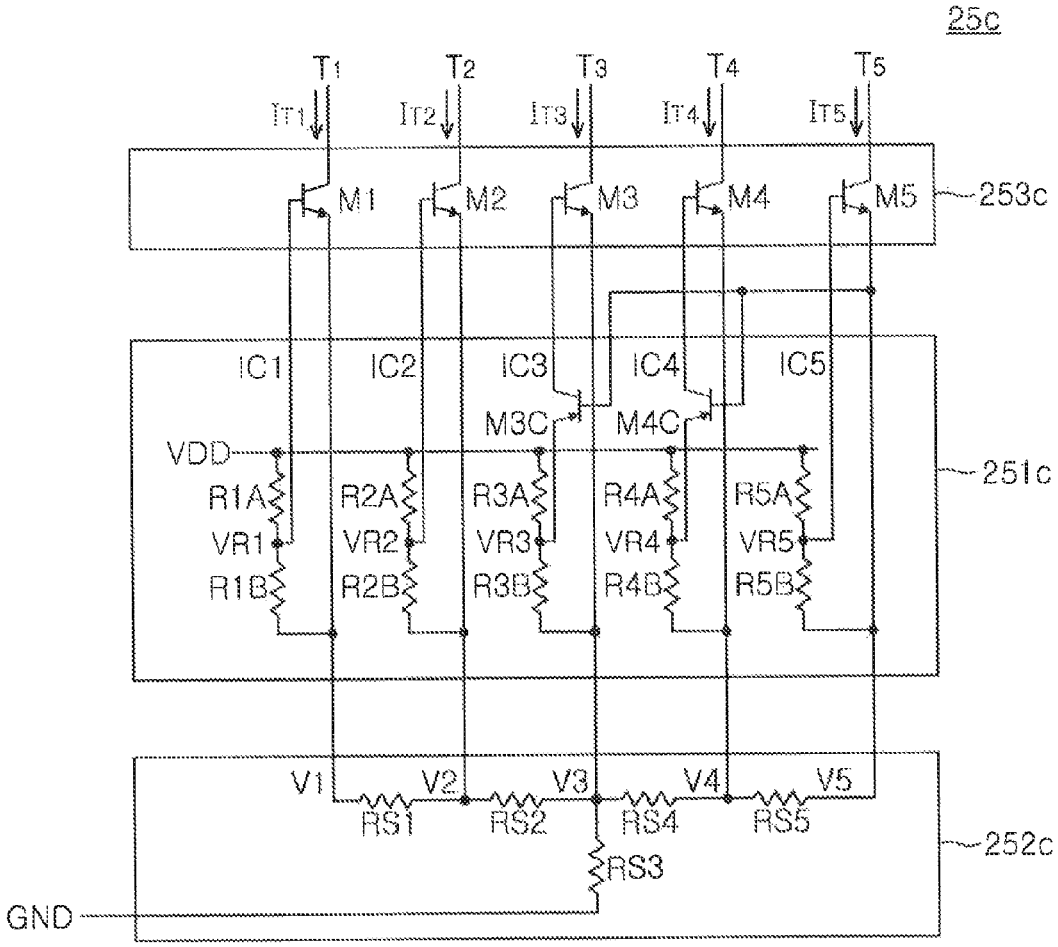

FIGS. 20 through 22 are views schematically illustrating modifications of the driving control unit 24*c* of FIG. 19. The driving control units according to the modifications aim at driving the current waveform illustrated in FIG. 16. Thus, conditions for the driving control units illustrated in FIGS. 20 through 22 to satisfy exclusive priority are similar to those of the driving control unit of FIG. 19. First, referring to FIG. 20, a driving control unit 25*a* according to the present embodiment may include a current control block 251*a*, a current sensing block 252*a*, and a current control unit 253*a*. The current control block 251*a* may generate a signal corresponding to magnitudes of the reference voltages VR1, VR2, and VR5 and output the same with respect to a portion of input terminals (e.g., the first, second, and fifth input terminals in FIG. 20). The current control unit 253*a* may serve as a controller receiving the signal corresponding to the magnitude of the reference voltage VR and a current sensing signal, and output a signal for controlling the input currents $I_{T1}$, $I_{T2}$, and $I_{T5}$ according to a differential component between the two input signals. In this case, the current control block 251*a* generates and outputs a signal corresponding to the magnitude of the reference voltage and the current control unit 253*a* may also serve to perform the function of comparing it with the current sensing signal, when the inverting negative (−) input terminal of the controller and the output terminal of the current control unit 253*a* are directly connected. Referring to FIG. 19, it can be seen that, in the first, second, and fifth input terminals T1, T2, and T5, the output terminals of the current control unit 243*a* and the inverting negative (−) input terminals S1, S2, and S5 of the controller (not shown) are directly connected to V1, V2, and V5, respectively.

In this embodiment, a BJT having high trans-conductance may be used as the current control unit 253*a*. Without a controller, a base terminal of the BJT used as the current control units M1, M2, and M5 may serve as a non-inverting positive (+) input terminal of a virtual controller, and an emitter terminal thereof may serve as an inverting negative (−) input terminal of the virtual controller. In case of BJT (NPN) element, a forward voltage having a level equal to or greater than a predetermined level should be applied between the base and the emitter to drive a current to a collector terminal. The forward voltage is approximately 0.5V, and it may be regarded as an offset voltage (VOS) of the virtual controller. As mentioned above, when the controller has an offset voltage, a reference voltage having a magnitude greater by the offset voltage, relative to the case of using an ideal controller, may be applied to cancel out an influence of the offset voltage. In FIG. 20, the BJT is illustrated as a current control unit, but of course, any other known current control unit may be applied.

Referring to FIG. 21, a driving control unit 25*b* according to the present embodiment may include a current control block 251*b*, a current sensing block 252*b*, and a current control unit 253*b*. The current control block 251*b* according to the present embodiment may receive a source voltage VDD supplied to the driving control unit 25*a* and generate first to fifth reference voltages VR1, VR2, . . . , VR5 according to a ratio between two resistors RA and RB connected in series between the source voltage VDD and a ground GND. The generated first, second, and fifth reference voltages may be directly input to bases of the current control units M1, M2, . . . , M5, and the other third and fourth reference voltages may be input to the non-inverting positive (+) input terminals of the third and fourth controllers M3C and M4C. In the controllers M3C and M4C, an emitter is a non-inverting positive (+) input terminal and a base is an inverting negative (−) input terminal. This is because, when input signals are increased in the input terminals of the controllers, a side in which a magnitude of a current driven by the current control unit upon receiving a control signal output from the controllers is increased is regarded as a non-inverting positive (+) input terminal, and a side in which the magnitude is decreased is regarded as an inverting negative (−) input terminal.

In FIG. 19, the inverting negative (−) input terminals S3 and S4 of the third and fourth controllers (not shown) controlling the input currents $I_{T3}$ and $I_{T4}$ and the output terminals of the current control units M3 and M4 are not directly connected to the third and fourth input terminals T3 and T4, so a separate controller is required. The third and fourth controllers controlling the currents of the third and fourth input terminals T3 and T4 may be configured as BJTs denoted as M3C and M4C, respectively, in FIG. 21. Bases of the M3C and M4C act as inverting negative (−) input terminals of a differential amplifier, so they receive the current sensing voltage V5, and emitters of the M3C and M4C receive the reference voltages VR3 and VR4, as non-inverting positive (+) input terminals of the controllers, respectively. Here, in the case in which the controllers M3C and M4C have an offset voltage, the reference voltages may be different from the reference voltages input to an ideal controller, in order to compensate for an influence of the offset voltage.

As illustrated in FIG. 20, a plurality of signal lines are required to connect a plurality of reference voltages generated by the current control block 251*a* to the respective base terminals of the current control unit 253*a*. However, in the case of the present embodiment, if even a resistor and the controllers M3C and M4C in the current control block 251*b* are disposed to be adjacent to the each current control unit 253*b*, it may appear such that the current control block delivers only the source voltage VDD to each current control unit, obtaining an effect that all of the reference voltages are delivered through a single signal line. Thus, when the driving control unit 25*b* is implemented on a printed circuit board (PCB) by using a discrete component, wiring is facilitated, and it is advantageous for implementing all wirings on one surface of the PCB. In case of using a one-side PCB, manufacturing costs can be effectively used.

Besides the method illustrated in FIG. 21, the first to fifth reference voltages VR1, VR2, . . . , VR5 may be generated by a plurality of resistors connected in series between the source voltage VDD and the ground GND through various methods. For example, the first to fifth reference voltages having different magnitudes may be generated by six resistors sequentially connected in series between the source voltage VDD and the ground GND. Thus, the method of generating reference voltages by a plurality of resistors connected between the source voltage VDD and the ground GND may not be limited to the illustrated embodiment. FIG. 22 is a view schematically illustrating a modification of the driving control unit in which a ground GND line required for generating respective reference voltages input to the respective current control units is eliminated. In FIG. 21, one ends of the resistors R1B to R5B are connected to the ground GND and the other ends thereof are connected to the other resistors R1A through R5A. In comparison, in the present embodiment, the first to fifth reference voltages VR1, VR2, . . . , VR5 may be generated by connecting the one ends of the resistors to emitters as output terminals of the respective current control units 253*c*, rather than to the ground GND. In this case, however, the reference voltages have values, rather than constant values, varied according to emitter voltages of the current control units 253*c*, and thus, it may be more cumbersome and intricate to set reference voltages and determine exclusive priorities.

As illustrated in FIG. 22, in a case in which the respective reference voltages VR1, VR2, . . . , VR5 are generated to be affected by the current sensing voltages of the respective input terminals T1, T2, . . . , T5, when all current sensing voltages are increased as a current is input to an input terminal having higher priority, a reference voltage of an input terminal having lower priority is increased to gradually decrease a current of the input terminal having lower priority. In this case, a rapid change in a current input to a light source unit can be restrained. When a current is supplied to the light source unit through a rectifying unit from an external AC power source, a rapid change in the current input to the light source unit causes current noise in the external AC power, making it difficult to satisfy regulations stipulated in the International Electrotechnical Commission (IEC) regarding electricity usage. Thus, the driving control unit according to the present embodiment restrains a change in a current at a point in time at which a path or a magnitude of the current flowing to the input terminals is changed, thus satisfying the regulations of the IEC.

In FIG. 22, it is illustrated that one ends of the resistors R1B to R5B for generating reference voltages are connected to the emitters of the respective current control units 253*c*, but this is merely illustrative and the present invention is not limited thereto. One ends of some resistors may be connected to the current sensing voltages V1, V2, . . . , V5, unlike the illustration of FIG. 22.

It has been described that the current sensing signals are input to the inverting negative (−) input terminals of the controllers within the current control block and the reference signals are input to the non-inverting positive (+) input terminals. However, since each controller reflects a differential component of the two input signals, i.e., a difference between the non-inverting positive (+) input and the inverting negative (−) input, as an input signal, an ideal output of each controller is not affected as long as the difference between the two input signals is constantly maintained. Namely, when a reference signal and a current sensing signal are input to two input terminals of each controller, even in the case that a certain signal is added to or subtracted from both of the input terminals, there is no influence on an output signal. Thus, as long as an output signal is maintained to be equal, no matter which signal is added to or subtracted from the two input signals, it may be regarded as the same input signals are received.

Also, in an embodiment of the present invention, when the current sensing block is configured with linear resistors, at least a portion of the linear resistors may be variable resistors. Here, a driving current may be changed according to a magnitude of the variable resistors.

So far, embodiments of the driving control unit applicable to various types of LED driving current have been described. Hereinafter, a modification of the LED driving device will be described.

Figure 23:
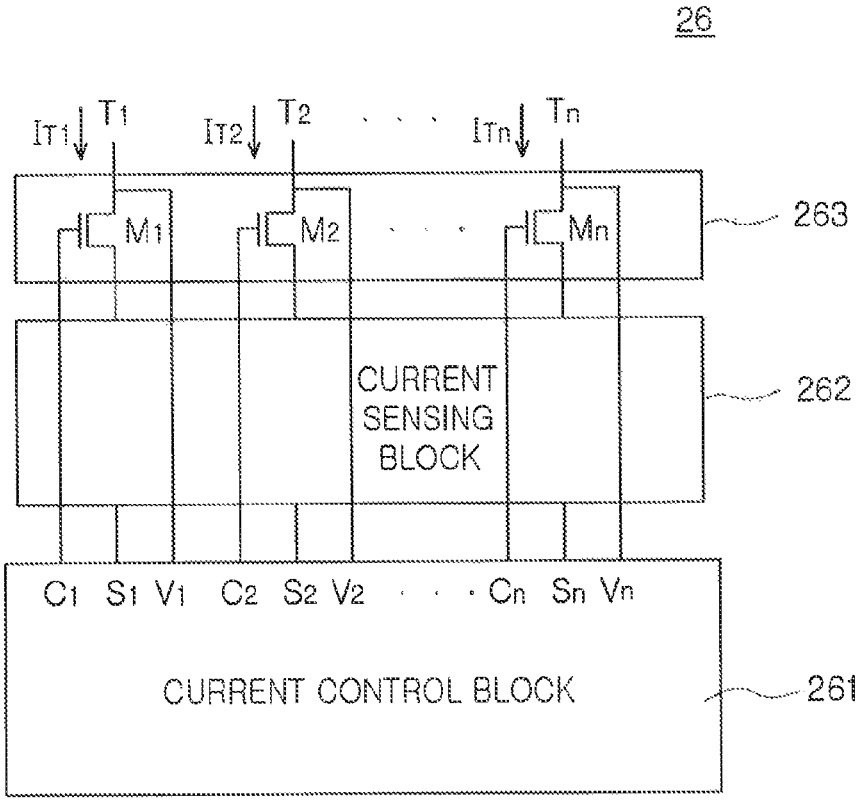
FIG. 23 is a view schematically illustrating a modification of the driving control unit applicable to the LED driving device according to an embodiment of the present invention.

FIG. 23 is a view schematically illustrating a modification of a driving control unit 26 applicable to an LED driving device according to an embodiment of the present invention. The driving control unit 26 according to the present embodiment may receive voltages from the respective output terminals of the first to nth LED groups constituting the light source unit 30 and change magnitudes of currents input to respective input terminals of the driving control unit 26. In detail, the current control block 261 may receive voltages of the respective output terminals of the first to nth LED groups G1, G2, . . . , Gn by the new input terminals V1, V2, . . . , Vn, continuously increase or decrease currents input from the first to nth LED groups G1, G2, . . . , Gn to the first to nth input terminals of the driving control unit in a single driving section, and drive the currents while changing them into a plurality of current levels, rather than to a single level. In an example of the LED driving method, a current waveform $I_{G1}$ of the first LED group G1 may become close to a more rectified sinusoidal waveform.

In another example of the LED driving method, a current may be driven to be in inverse proportion to the DC source voltage V in a single driving section, or in a portion of the single driving section. In this case, since a current may be driven to be inverse proportion to the DC source voltage V in a plurality of continued driving sections, and may be driven to be inverse proportion to the DC source voltage V in a single driving section or a portion thereof, a range of the DC source voltage V driving a current such that a voltage and a current are in inverse proportion may be freely set. Also, since an inverse proportion relationship between a voltage and a current is very accurately obtained, power consumed in a lighting device in a case in which an AC source voltage fluctuates can be substantially constantly maintained.

Figure 24:
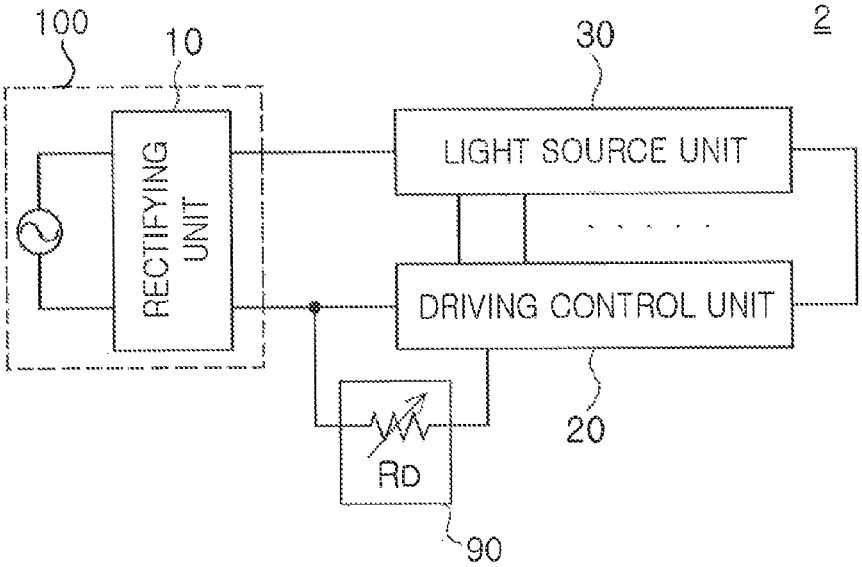
FIG. 24 is a view schematically illustrating a modification of the LED driving device according to an embodiment of the present invention.

Also, when the first to nth LED groups G1, G2, . . . , Gn are driven in a state in which output terminal voltages thereof are high (e.g., when an LED lighting device made for a 120V purpose is connected to 220V), a great amount of power consumption occurs in the LED driving device, and thus, a large amount of heat is generated in the LED driving device to damage components thereof. However, in the present embodiment, a driving current may be reduced or cut off according to a voltage input from the output terminals of the respective LED groups, thus limiting power consumed in the lighting device and preventing damage to the driving device due to a high level of heat and a fire. Also, the function of limiting or interrupting a current when differences between voltages from output terminals of the respective LED groups are equal to or greater than a predetermined level, relative to a normal case may be utilized to enhance safety required for the lighting device in the event of a short-circuit or a disconnection in a current path in some LED groups or in other parts of the lighting device. For example, in a case in which there is a disconnection in a single LED group, a difference between voltages from output terminals adjacent to the disconnected LED group is great, relative to normal driving, and in a case of a short-circuit, on the contrary, a small voltage difference may appear. In this case, safety can be enhanced by limiting an operation of the lighting device. FIG. 24 is a view schematically illustrating another modification of the LED driving device according to an embodiment of the present invention. In detail, the LED driving device according to the present embodiment includes a variable resistor RD added to the LED driving device 1 illustrated in FIG. 3 as a dimming signal generator 90. According to the present embodiment, the variable resistor RD is added between a ground terminal of the power source unit 100 and the driving control unit 20 to adjust brightness of the light source unit 30. In detail, the driving control unit 20 increases or decreases a current flowing in the light source unit 30 according to a magnitude of the variable resistance RD to thus change brightness of the light source unit 30. Unlike this, when light having constant brightness is intended to be generated, a fixed resistance value may be used. Here, the driving control unit 20 may apply a predetermined voltage to the variable resistor to receive a magnitude of the current flowing in the variable resistor as a dimming signal or may receive a magnitude of a voltage obtained by applying a constant current to the variable resistor, as a dimming signal.

In another method of adjusting a magnitude of a current flowing in the light source unit 30, an external signal, i.e., a dimming signal, for adjusting brightness may be received from the dimming signal generator 90 and output to the driving control unit 20. In this case, the dimming signal generator 90 may receive various types of input signal from an external source and output a dimming signal in a form required for the driving control unit 20. The variable resistor RD illustrated in FIG. 24 is one of a form to receive an external signal. Namely, the variable resistor may be regarded as a dimming signal generator 90 in a simpler form to output a dimming signal in a form of a voltage or a current to the driving control unit 20 by using a resistance value changed according to a user's physical action as an external signal. In this case, the driving control unit may adjust brightness of the lighting device by regulating magnitudes of the currents driven to the first to nth input terminals according to a magnitude of the input dimming signal. The lighting device may change all of the magnitudes of the currents input to the first to nth input terminals in the same proportion, and may change all of the magnitudes of currents input to a portion of the input terminals in the same proportion.

In detail, in order to adjust currents input to the driving control unit in the respective driving sections according to the magnitude of the variable resistance or the magnitude of the dimming signal input from the outside, all of the magnitudes of the first to nth reference signals may be adjusted in the same proportion. Thus, magnitudes of currents may be adjusted while maintaining the same waveform of the currents flowing in the light source unit 30, thereby adjusting brightness of the light source unit. If there is no need to maintain the waveforms of the currents constantly, only the magnitudes of a portion of reference signals may be adjusted according to the resistance of the variable resistor and the magnitude of the dimming signal input from the outside.

Figure 25:
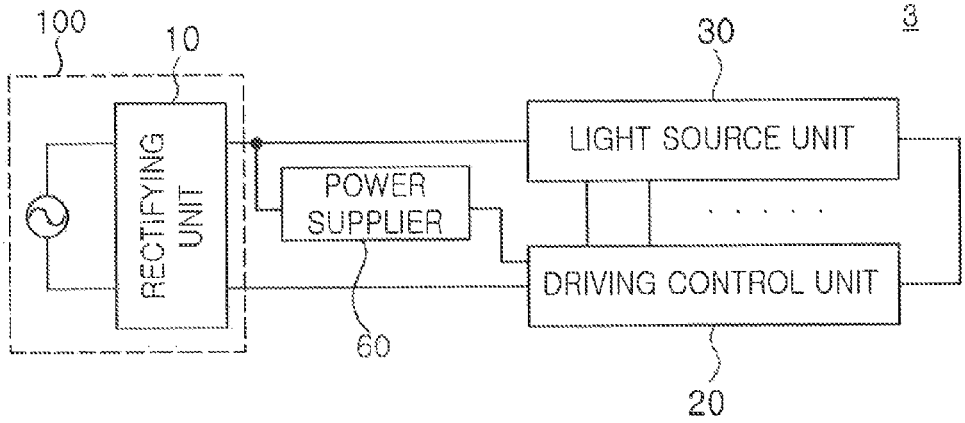
FIG. 25 is a view schematically illustrating another modification of the LED driving device according to an embodiment of the present invention.

FIG. 25 is a view schematically illustrating another modification of the LED driving device according to an embodiment of the present invention. In detail, the LED driving device according to the present embodiment includes a power supplier 60 added to the LED driving device 1 illustrated in FIG. 3. According to the present embodiment, a source voltage required for the driving control unit 20 is not received from the outside of the lighting device, or the driving control unit 20 does not generate a source voltage. Namely, upon receiving a DC power 100 input to the light source 30, a source voltage is generated and supplied by the power supplier 60. The power supplier 60 may be implemented on the same chip in which the driving control unit 20 is installed, or may be implemented by using a separate component. The power supplier 60 may be implemented to supply source power required for the driving control unit 20 continuously even when a voltage of AC power input from the outside is 0.

Figure 26A:
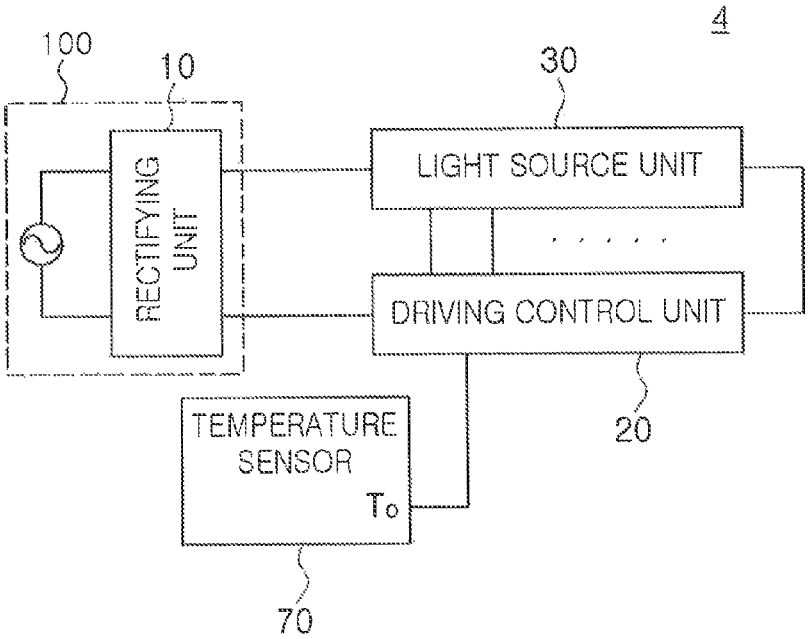
FIG. 26 is a view schematically illustrating another modification of the LED driving device according to an embodiment of the present invention.
Figure 26B:
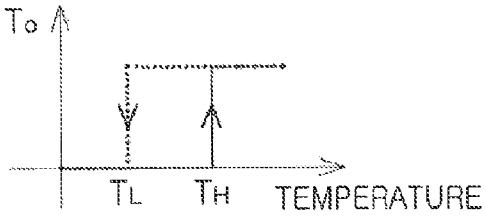

FIG. 26 is a view schematically illustrating another modification of the LED driving device according to an embodiment of the present invention. In detail, the LED driving device according to the present embodiment includes a temperature sensor 70 added to the LED driving device 1 illustrated in FIG. 3. Referring to FIGS. 26A and 26B, the temperature sensor 70 connected to the driving control unit 20 may transmit a temperature sensing signal (To=high) to the driving control unit 20 to temporarily stop an operation of the light source unit 30 when a temperature of the lighting device, namely, a temperature T of the light source unit 30, the driving control unit 20, or the like, is equal to or higher than a predetermined level TH. When the temperature T of the lighting device is lowered to be equal to or lower than a predetermined level TL, the temperature sensor 70 may transmit a temperature sensing signal (To=low) to allow the driving control unit 20 to start an operation again. In this case, in the temperature sensor 70, preferably, the temperature TH at which the operation of the light source 30 is to be stopped due to a temperature rise may be set to be higher than the temperature TL at which the operation of the light source 30 may start again, and thus, as illustrated in FIG. 26B, when the temperature T is rises or falls, outputs from the temperature sensor 70, namely, the temperature sensing signals To, may have different hysteresis curves.

Also, according to a signal output from the temperature sensor, the driving control unit may temporarily stop the operation of the light source or may reduce a driving current continuously or by gradual steps. In this case, the output signal To from the temperature sensor may be different from that illustrated in FIG. 26B. In the present embodiment, the temperature sensor 70 may be implemented in the same chip in which the driving control unit 20 is implemented or may be implemented as a separate component.

Figure 27:
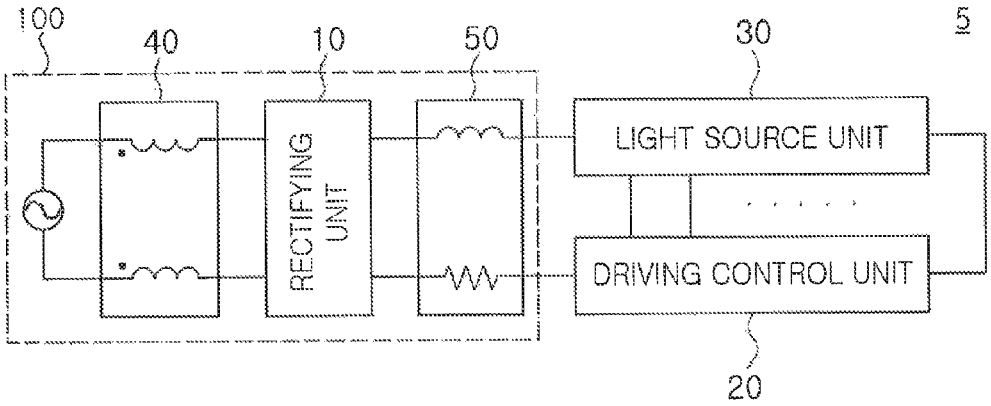
FIG. 27 is a view schematically illustrating another modification of the LED driving device according to an embodiment of the present invention.

FIG. 27 is a view schematically illustrating another modification of the LED driving device according to an embodiment of the present invention. According to the present embodiment, the LED driving device may further include a common mode filter 40 and a line filter 50 added to the LED driving device 1 illustrated in FIG. 3. In detail, the LED driving device may further include the common mode filter and the line filter in order to prevent voltage or current noise from being transferred from an external AC power source to the light source unit 30 or from the light source unit 30 to the external AC power source. Electrical noise related to the lighting device may include conduction electromagnetic interference (EMI), surge, electrical static discharge (ESD), or the like.

The common mode filter 40 is a noise filter for preventing common mode noise from being transferred from the lighting device to the external AC power source or from the external AC power source to the lighting device, which does not substantially affect a differential component of an input signal.

Meanwhile, the line filter 50 refers to a filter cancelling noise of a high frequency component included in both ends of a power line. The line filter 50 is a low pass filter (LPF) including a coil and a condenser and reacts to a differential component of a voltage and a current disposed between AC power input from the outside and the light source unit 30 to attenuate a high frequency component. As illustrated in FIG. 27, the line filter 50 according to an embodiment may include an inductor and a resistor, and the resistor may be a thermistor such as a negative temperature coefficient (NTC), a critical temperature resistor (CTR), positive temperature coefficient (PTC), or the like. However, there are no limitations on the configuration scheme. The resistor and the inductor constituting the line filter 50 may be disposed in one of two power lines or in both power lines. Alternatively, the resistor and the inductor may be disposed together in the same power line or may be separately disposed. In the present embodiment, the common mode filter 40 and the line filter 50 are illustrated to be sequentially disposed between the AC power input from the outside and the light source unit 30, but the present invention is not limited thereto and order thereof between the external AC power and the light source unit 30 is not limited.

Although not shown in detail, in the LED driving device 1 according to the present embodiment, AC power may be received through a transformer, rather than being received directly from the outside, and in order to protect components constituting the LED driving device from ESD, surges, or the like, the power source 100 may further include a varistor, a transient voltage suppressor, or the like. Besides, in order to prevent an overcurrent from flowing to the LED driving device due to a short-circuit occurring in a conducting wire or a component in which a current flows, the LED driving device may further include a fuse.

Figure 28:
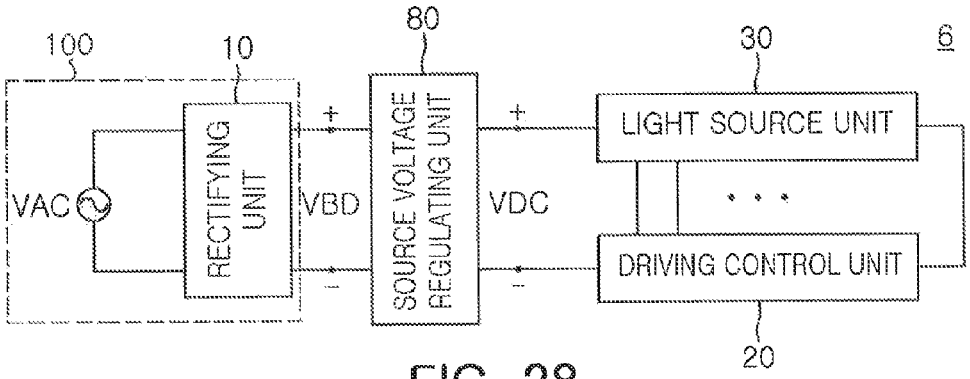
FIG. 28 is a view schematically illustrating another modification of the LED driving device according to an embodiment of the present invention.

FIG. 28 is a view schematically illustrating another modification of the LED driving device according to an embodiment of the present invention. In detail, the LED driving device according to the present embodiment may include a source voltage regulating unit 80 added to the LED driving device 1 illustrated in FIG. 3. The source voltage regulating unit 80 serves to regulate a DC source voltage output from the rectifying unit 10. As illustrated in FIG. 28, the source voltage regulating unit 80 may be connected between the rectifying unit 10 and the light source unit 30 to regulate a magnitude and a swing (or a range of fluctuation) of the DC source voltage input to the light source unit 30. In case of DC power generated by a rectifying element such as a full-wave rectifier or a half-wave rectifier, it has very large voltage swing, and since a rectifying unit does not have a means for limiting an input current, a waveform of an AC current input from an external AC power source is relied upon the characteristics of a load that receives a current from the rectifying element. Thus, the rectifying element constituting the rectifying unit 10 has an output voltage having a large swing and can hardly control a waveform of a current input from the external AC power source VAC.

In the present embodiment, since the source voltage regulating unit 80 is added between the rectifying unit 10 and the light source unit 30 to regulate a magnitude and a swing of a source voltage input from the rectifying unit 10, a swing of the DC source voltage input to the light source unit may be reduced. As the source voltage regulating unit 80, for example, a passive or active power factor corrector (PFC) may be applied, but the present invention is not limited thereto. A power factor is an index indicating a similarity between a waveform of a current input from an external AC power source and a waveform of an input voltage. In general, an active PFC, which has a small volume and high power efficiency, is commonly used. In the case of the active PFC, it can control an output voltage VDC, while maintaining a waveform of an input current close to a waveform of an input voltage. Namely, in order to increase a power factor, the PFC delivers a large amount of current to a load when the output voltage VBD of the rectifying element is high, and delivers a small amount of current when the output voltage VBD is low. Thus, when a resistive load exists in an output terminal, the output voltage VDC from the PFC is increased or decreased according to the output voltage VBD from the rectifying element, and thus, the output voltage from the PFC has a swing within a predetermined range. In general, a swing of the output voltage VDC in the active or passive PFC may be reduced by increasing capacitance of a voltage stabilizing capacitor connected to an output terminal of the PFC. Here, structures and operations of the PFC vary, so a detailed description thereof will be omitted.

Figure 29:
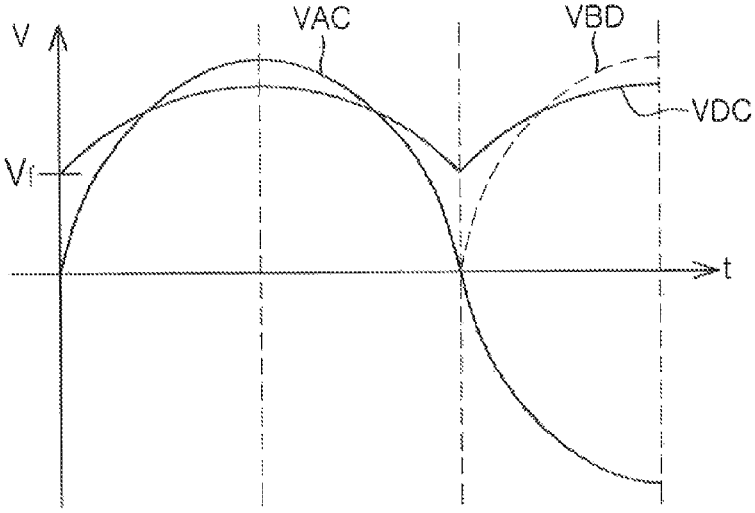
FIG. 29 is a view schematically illustrating input and output voltages from a rectifying unit and an output voltage from a source voltage regulating unit in the LED driving device according to the embodiment illustrated in FIG. 28.

FIG. 29 is a view schematically illustrating input and output voltages of the rectifying unit and an output voltage of the source voltage regulating unit 80 in the LED driving device according to an embodiment of the present invention. Referring to FIG. 29, the voltage VAC of AC power input from the outside has a form of sine wave and a very large voltage swing, and the DC source voltage VBD obtained by full-wave rectifying the external AC source voltage VAC through the rectifying unit 10 also has a large voltage swing. However, as illustrated in FIG. 29, when the source voltage regulating unit 80 such as a PFC circuit is applied to an output terminal of the rectifying unit 10, a swing of the DC source voltage VDC input to the light source unit 30 may be significantly reduced, and by maintaining the source voltage input to the light source unit 30 at a level equal to or higher than a predetermined value, at least a portion (e.g., G1 and G2) of the LED groups G1, G2, . . . , Gn positioned to be adjacent to the output terminal of the source voltage regulating unit 80 may be constantly driven. In FIG. 29, it is illustrated that a peak voltage of the source voltage regulating unit 80 is lower than the external AC source voltage VAC or the output voltage VBD of the rectifying element, but the present invention is not limited thereto and the output voltage VDC of the source voltage regulating unit 80 may have a peak voltage higher than the output voltage VBD of the rectifying element.

If a capacitor having high capacitance is disposed in an output terminal of the source voltage regulating unit 80 in order to reduce a swing of the DC source voltage VDC input to the light source unit 30, the large volume of the capacitor having high capacitance may increase an overall volume of the driving device and costs thereof. However, in the present embodiment, since the light source unit 30 and the driving control unit 20 appropriately applied to a case in which the DC source voltage VDC input to the light source unit 30 is significantly fluctuated are provided, capacitance of a capacitor for smoothing the output voltage VDC from the source voltage regulating unit 80 can be minimized, and the source voltage regulating unit 80 may detect the output voltage VDC to increase or decrease a current input to the light source unit 30. Also, in order to allow a portion of the LED groups adjacent to the source voltage regulating unit 80 to be constantly driven, the DC source voltage VDC input to the light source unit 30 may be maintained at a level equal to or higher than a predetermined value Vf.

Meanwhile, when a PFC is applied to the source voltage regulating unit 80, the light source unit 30 and the driving control unit 20 do not need to consider a power factor and harmonic distortion of an input current. Thus, a current input to the light source unit 30 and the driving control unit 20 does not need to be maintained to close to a sine wave. Here, the driving control unit 20 may need only to provide control to make a current flow through as many LED groups as possible operable according to fluctuations in the voltage output from the power source regulating unit 80, and thus, the LED driving current $I_G$ may have a certain form, other than a rectified sinusoidal waveform.

In the present embodiment, as the DC source voltage VDC output from the rectifying unit 10 and the source voltage regulating unit 80 is less fluctuated, the amount of LED groups required for maintaining high efficiency of the LED driving device may be reduced. Namely, when a DC source voltage input to the light source unit 30 is maintained at a level equal to or higher than a predetermined voltage Vf, all LED groups driven at a level equal to or lower than the predetermined voltage Vf may be grouped and driven. For example, when the predetermined voltage Vf is higher than a voltage able to drive the second LED group G2 and lower than a voltage able to drive the third LED group G3, the first and second LED groups G1 and G2 may operate as a single group. Here, as the amount of driven LED groups is smaller, the structure of the driving control unit 20 is simplified and components and wirings required for driving LEDs can be simplified to reduce costs for implementing the driving device.

Figure 30A:
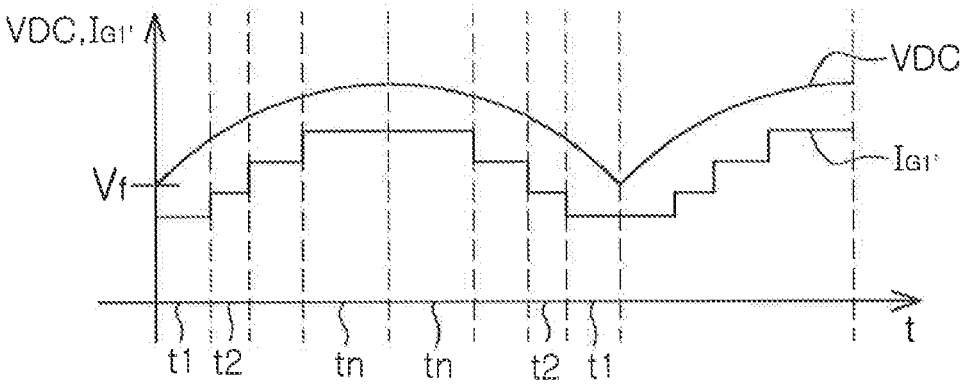
FIG. 30 is a view schematically illustrating examples of other current waveforms applicable to the LED driving device illustrated in FIG. 28.
Figure 30B:
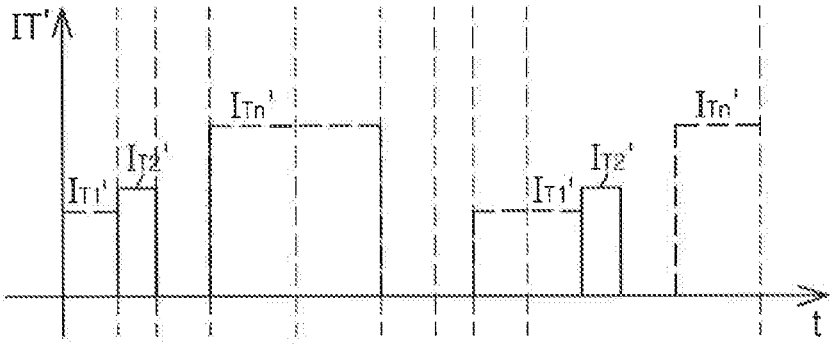

FIG. 30 is a view schematically illustrating waveforms of driving currents applicable to the LED driving device illustrated in FIG. 28. In detail, FIG. 30A is a view illustrating waveforms of the DC source voltage VDC input to the light source unit 30 through the source voltage regulating unit 80 and a first current $I_{G1}'$ flowing in the first LED group G1', FIG.

Figure 30C:
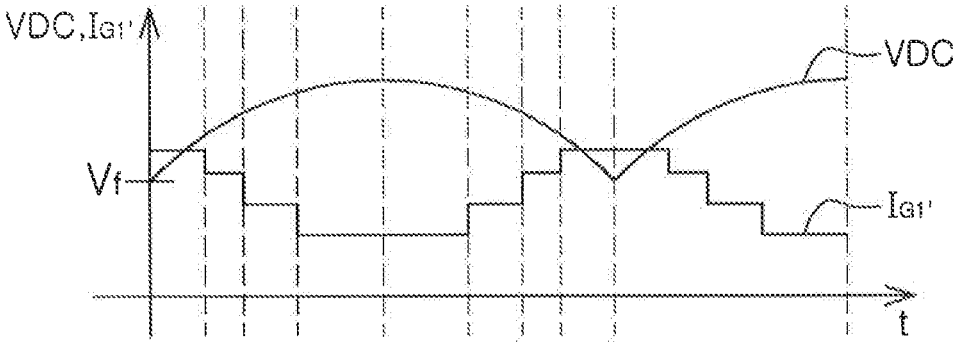

30B is a view schematically illustrating waveforms of the first to nth input currents $I_{T1}'$, $I_{T2}'$, . . . , $I_{Tn}'$ input to the driving control unit 20 to obtain the waveform of the first current $I_{G1}'$ flowing in the first LED group as illustrated in FIG. 30A. Also, FIG. 30C is a view schematically illustrating a different waveform of the first current $I_{G1}'$ flowing in the first LED group G1'. Details thereof will be described below.

FIG. 28 does not specifically illustrates respective input terminals of the first to nth LED groups G1', G2', . . . , Gn' and the driving control unit 20, but it may be understood that the other configurations excluding the source voltage regulating unit 80 are similar to those of FIG. 3.

Referring to FIG. 30, the DC source voltage VDC input to the light source unit 30 through the source voltage regulating unit 80 is maintained at a value equal to or higher than the predetermined voltage Vf, and accordingly, the first LED group G1' may be driven to have the current waveform $I_{G1}'$ illustrated in FIG. 30A. In the present embodiment, the first LED group G1' may be understood as being different from the first LED group G1 illustrated in FIGS. 3 and 4. In detail, it may refer to a group grouping LED groups (e.g., G1 and G2 in FIG. 3) that may be driven at a level equal to or lower than the predetermined voltage Vf. In the present embodiment, unlike the embodiment illustrated in FIG. 4, a non-driving section t0 in which the input DC source voltage VDC is so low that any LED group that cannot be driven does not exist, and at least one LED group G1' may be driven in every driving section. % Flicker (or a modulation index), one of indices indicating blinking of the lighting device, is a value obtained by dividing a difference between a maximum value and a minimum value of optical power emitted during one period in the lighting device by an average thereof.

Recently, demand for lowering % Flicker of lighting devices to below 50% has been increased, and in the case of the present embodiment, by maintaining the DC source voltage VDC input to the light source unit 30 at a value equal to or higher than a predetermined level, blinking of the LED lighting device can be effectively restrained.

FIG. 30C is a view illustrating the waveforms of the DC source voltage VDC input to the light source unit 30 and the first current $I_{G1}'$ flowing in the first LED group. In order to further restrain fluctuations in optical power according to fluctuations in the DC source voltage VDC input to the light source unit 30, the light source unit 30 may be driven such that the first current $I_{G1}'$ flowing in the first LED group to have the waveform illustrated in FIG. 30C. Referring to FIG. 30C, the driving control unit 20 may drive the light source unit 30 such that a magnitude of the DC source voltage VDC input to the light source unit 30 and a magnitude of the first current $I_{G1}'$ passing through the first LED group are in inverse proportion. Namely, when the amount of driven LED groups is small because the DC source voltage VDC is low, the driving control unit 20 controls more currents to flow, and when the amount of driven LED groups is increased as the DC source voltage VDC is gradually increased, the driving control unit 20 may gradually reduce currents flowing in the LED groups, to thereby drive the light source unit 30 such that almost constant optical power can be maintained. Here, when the magnitude of the DC source voltage VDC input to the light source unit 20 and the magnitude of the current $I_{G1}'$ passing through the first LED group are in inverse proportion, it does not mean that they are perfectly in inverse proportion mathematically but they have tendency of inverse proportion as illustrated in FIG. 30C. Also, since the DC source voltage VDC input to the light source unit 30 is in proportion to the magnitudes of the DC source voltage VBD converted by the rectifying unit 10 and the external AC source voltage VAC, it may also be expressed, in the driving method, that the first current $I_{G1}'$ passing through the first LED group is driven to be in inverse proportion to the magnitude of the DC source voltage VBD converted by the rectifying unit 10 or the magnitude of the external AC source voltage VAC.

Meanwhile, if a large amount of current flows in a portion of the LED groups to substantially uniformly maintain optical power in every driving section, lifespan of the LED groups in which a large amount of current flows may be shortened. Thus, a driving current may be reduced in a portion of driving sections in which the DC source voltage VDC is high as the amount of driven LED groups is increased, to thereby substantially uniformly maintain optical power. The waveform of the driving current, i.e., the first current $I_{G1}'$, according to the LED driving method may be understood as being similar to the current waveform illustrated in FIG. 16. However, when the source voltage regulating unit 80 is provided, a non-driving section t0 in which all of the LED groups are not driven does not exist, and thus, the current $I_{F1}$ having a predetermined magnitude may continuously flow through the first LED group G1' in the first driving section t1 in which the DC source voltage VDC is the lowest.

According to the LED driving method of reducing a driving current in some driving sections according to an increase in the DC source voltage VDC input to the light source unit 30, power consumed in the lighting device and heat generated by the lighting device can be constantly maintained, in addition to the effect of constantly maintain optical power. Thus, it may be utilized for increasing safety of the lighting device. In general, when the AC source voltage input from the outside is increased, the DC source voltage VDC input to the light source unit 30 may be increased, and in this case, power consumed in the lighting device is increased to increase a temperature of the lighting device. Thus, by employing the LED driving method of substantially constantly maintaining optical power by reducing the current flowing in the LED groups, while increasing the amount of driven LED groups according to the increase in the DC source voltage VDC, an increase in power consumption in the lighting device when the AC source voltage input from the outside is increased, and a rapid increase in a temperature of the lighting device according to an increase in the external AC source voltage can be prevented.

Figure 31:
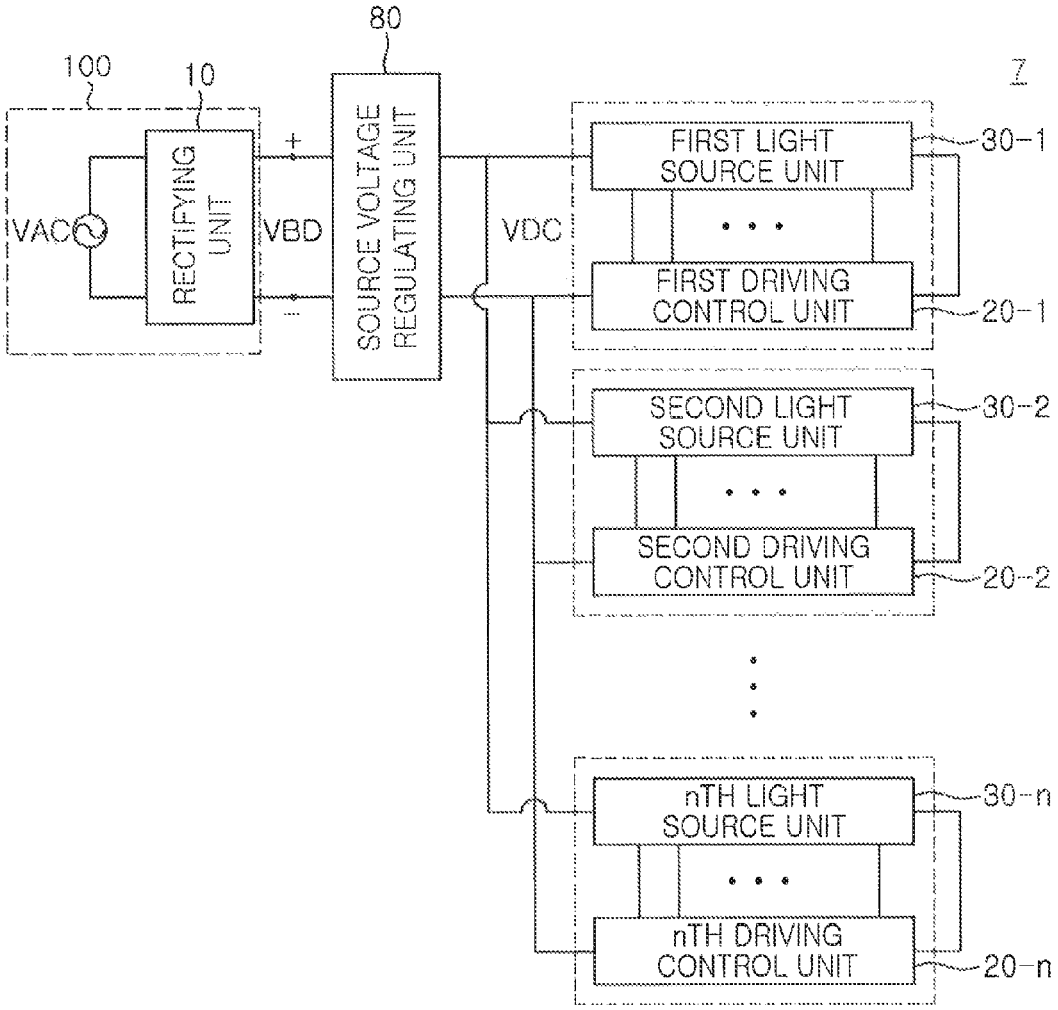
FIG. 31 is a view schematically illustrating an LED driving device according to another embodiment of the present invention in which components, excluding a power source unit and a driving control unit, are shared.

Besides, in an embodiment of the present invention, a plurality of amounts of components may be disposed in a single lighting device so as to be used. Here, components, other than the light source unit 30 and the driving control unit 20, may be shared. Namely, a plurality of light source units and a plurality of driving control units driving each light source unit may be configured to share a single power source unit 100. FIG. 31 is a view schematically illustrating an LED driving device in which components, excluding a light source unit and a driving control unit, are shared according to another embodiment of the present invention. Referring to FIG. 31, the LED driving device according to the present embodiment may include first to nth light source units 30-1, 30-2, . . . , **30-*n* connected to an output terminal of the source voltage regulating unit 80 and first to nth driving control units 20-1, 20-2, . . . , 20-*n* for driving the first to nth light source units 30-1, 30-2, . . . , 30-*n*. When the LED driving device includes the source voltage regulating unit 80 that receives the DC source VBD output from the rectifying unit 10, regulates a voltage range, and outputs a corresponding voltage, the function and configuration of the driving control unit are simplified. Thus, it can be effectively applied to the case including a plurality of light source units and a plurality of driving control units as illustrated in FIG. 31**. However, the present invention is not limited thereto.

The present invention may be variously modified by using a plurality of light source units and a plurality of driving control units. As illustrated in FIG. 31, when the plurality of driving control units 20-1, 20-2, . . . , **20-*n* drive the light source units 30-1, 30-2, . . . , 30-*n*, separately, the input terminals having the same degree in the driving control unit are crossed, they can be operable. In implementing the lighting device, crossing of the input terminals having the same degree may facilitate wiring. Thus, when the embodiment illustrated in FIG. 31 is obtained by crossing the input terminals having the same degree, it should be regarded as being the same as the embodiment of FIG. 31**.

Although not specifically shown, in a modification including a plurality of light source units and a plurality of driving control units, a single light source unit may be driven by a plurality of driving control units. Here, input terminals of respective driving control units may be connected by sharing LED groups having the same degree constituting the light source unit. In a case in which a magnitude of a current that can be driven by a single driving control unit has already been determined, a higher current may be driven by using a plurality of driving control units. Here, forms of currents driven by the respective driving control units may be different. Waveforms of the currents driven by the plurality of driving control units may be equal to the sum of the currents driven by the respective driving control units in respective driving sections.

Also, in a modification in which a plurality of driving control units share a single light source unit, a portion of input terminals of a portion of driving control units may not be connected to LED groups of the light source unit. Accordingly, the light source unit may be driven by a current having a different magnitude, rather than by the sum of all of the input currents of the respective driving control units sharing the light source unit in the respective driving sections, and more various waveforms and paths of currents flowing in the light source unit can be obtained.

In another modification of FIG. 31, a plurality of light source units may be configured to share a portion of LED groups. Here, sharing may refer to connecting input terminals and output terminals of LED groups having the same degree constituting different light source units such that a portion or the entirety of the plurality of LED groups connected in parallel are left resultantly. Also, it may also include a case in which output terminals of a plurality of LED groups having the same degree are connected. In this case, output terminals of the shared LED groups may be connected to a plurality of driving control units so as to be driven. According to the present embodiment, the amount of components constituting the light source units may be reduced by sharing a portion of LED groups, and in a case in which a disconnection occurs in a portion of LED groups, different shared LED groups may be operated, increasing durability of the lighting device.

As another method of increasing durability of the lighting device, a new current path may be added to the light source unit. Two output terminals having different degrees may be connected by an LED group having the same current-voltage relationship as that of an LED group existing between the two output terminals. In this case, a new current path may be generated, and the new current path may be secured as a substitute path along which a current may flow when a disconnection occurs in an existing current path in a parallel connection relationship.

In this manner, in the lighting device employing a plurality of light source units and the driving control unit driving the plurality of light source units, although the light source units are variously modified such that a portion of input terminals or output terminals having the same degree are connected to allow a portion of LED groups to be shared, terminals having the same degree are connected to make a portion of LED groups to be connected in parallel, the amount of LED groups in a parallel connection relationship is reduced, or a new current path is added by adding a new LED group between output terminals having different degrees, and the like, if there is no change in driving sections and the respective driving control units may be able to drive currents having the same magnitude by the same input terminals in the respective driving sections, the light source units should be regarded as being the same in the scope of the present invention.

Namely, in the view point of the present invention, even in the case that there is a change in light source units, if it does not affect electrical characteristics of the light sources, these light source units are regarded as having the same form. This is because, when electrical characteristics of two light source units are the same, a driving section set according to the DC source voltage VDC and a magnitude and path of a current flowing in each driving control unit in each driving section are not affected, and thus, there is no substantial difference in the view of driving the two light source units.

Figure 32:
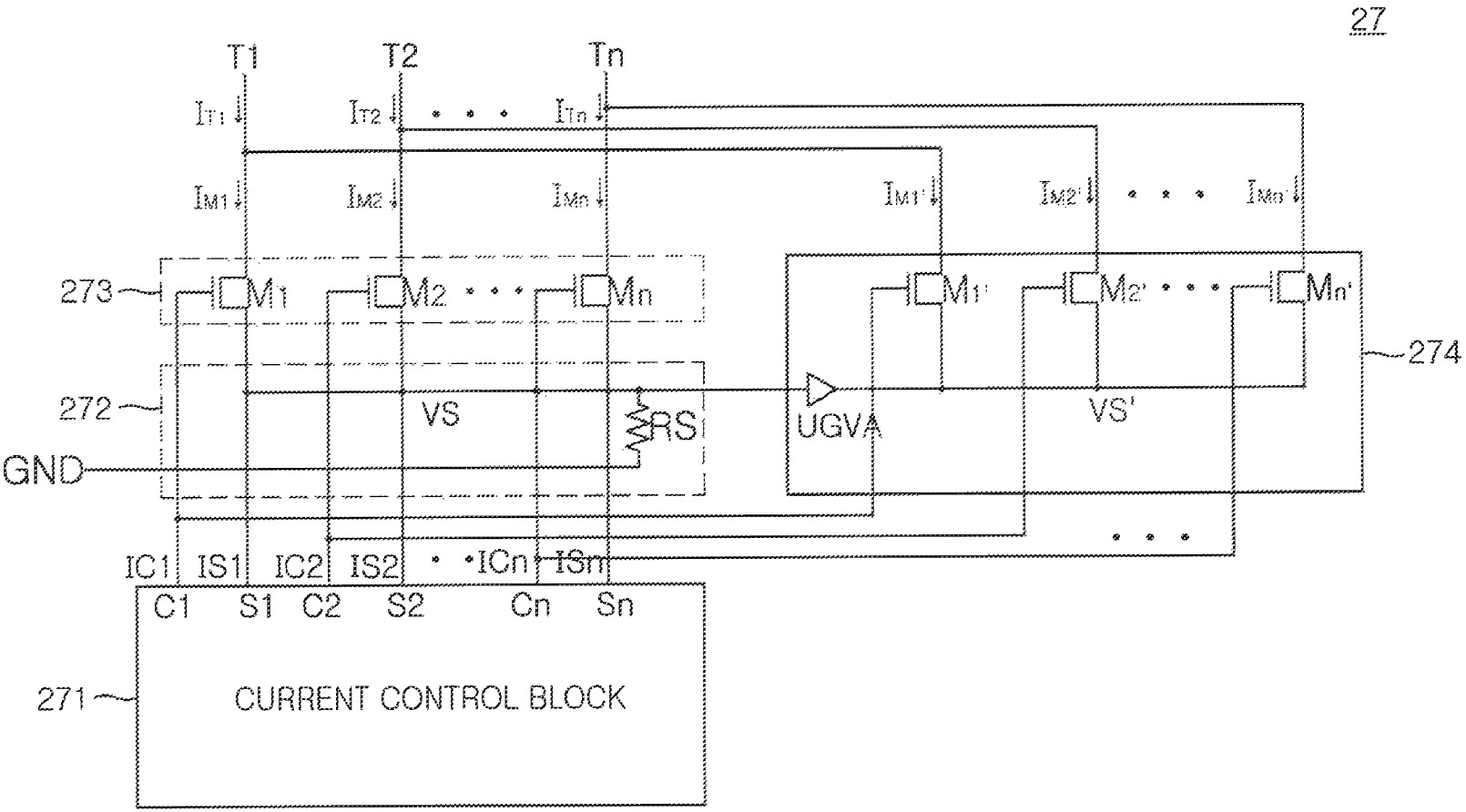
FIG. 32 is a view schematically illustrating a modification of the driving control unit according to an embodiment of the present invention.

FIG. 32 is a view schematically illustrating a driving control unit according to another embodiment of the present invention. A driving control unit 27 according to the present embodiment may include a current control block 271, a current sensing block 272, a current control unit 273, and a current duplication block 274. The current sensing block 272 may generate first to nth current sensing signals IS1, IS2, . . . , ISn reflecting reference currents IM1, IM2, . . . , IMn input through the current control unit 273, among input currents $I_{T1}$, $I_{T2}$, . . . , $I_{Tn}$ input from the respective output terminals of the first to nth LED groups, in predetermined proportions. The current control block 271 may receive first to nth current sensing signals IS1, IS2, . . . , ISn generated by the current sensing block 272, and output control signals IC1, IC2, . . . , ICn for controlling the respective currents $I_{M1}$, $I_{M2}$, . . . , $I_{Mn}$ input to the current control unit 273. The current control unit 273 may regulate magnitudes of currents input to the current control unit 273 from the first to nth LED groups G1, G2, . . . , Gn according to the control signals output from the current control block 271. The current duplication block 274 may receive duplication currents $I_{M1}'$, $I_{M2}'$, . . . , $I_{Mn}'$ obtained by duplicating the respective reference currents $I_{M1}$, $I_{M2}$, . . . , $I_{Mn}$ flowing through the current control unit 273 in predetermined ratios.

The duplication currents $I_{M1}'$, $I_{M2}'$, . . . , $I_{Mn}'$ input to the current duplication block 274 may maintain predetermined ratios with respect to the respective reference currents $I_{M1}$, $I_{M2}$, . . . , $I_{Mn}$ input from the first to nth input terminals T1, T2, . . . , Tn of the driving control unit 27 to the current control unit 273 and the input currents $I_{T1}$, $I_{T2}$, . . . $I_{Tn}$. The duplication currents $I_{M1}'$, $I_{M2}'$, . . . , $I_{Mn}'$ may have a magnitude the same as that of the reference currents $I_{M1}$, $I_{M2}$, . . . , $I_{Mn}$ or may have a magnitude of the reference currents $I_{M1}$, $I_{M2}$, . . . , $I_{Mn}$ duplicated in predetermined ratios. The duplication currents $I_{M1}'$, $I_{M2}'$, . . . , $I_{Mn}'$ may have magnitudes duplicated in different ratios for the respective input terminals T1, T2, . . . , Tn.

In the present embodiment, when the first reference current $I_{M1}$ having a first current level $I_{F1}$ is input to the first current control unit M1 connected to the first input terminal T1 of the driving control unit 27, the first current sensing voltage Vs1 sensed by the current sensing block 272 is Vs1=VS=$I_{F1}$×Rs, and in this case, the first current sensing voltage Vs1 may be adjusted to be equal to the first reference voltage VR1 by the controller (not shown) of the current control block 271. Thus, a magnitude, i.e., the first current level $I_{F1}$, of a current flowing through the first current control unit M1 connected to the first input terminal T1 is determined as $I_{F1}$=VR1/Rs.

In a case in which trans-conductance of the first current duplication unit M1' connected to the first input terminal T1 of the driving control unit 27 is the same as that of the first current control unit M1 connected to the first input terminal T1 of the driving control unit 27 and voltages applied to all of the terminals, i.e., sources, gates, and drains, of the current control unit M1 and the current duplication unit M1' are the same, the first duplication current $I_{M1}'$ flowing through the first current duplication unit M1' is substantially the same as the first reference current $I_{M1}$ flowing through the first current control unit M1. Meanwhile, in a state in which the same terminal voltage is applied, when the trans-conductance $gm_{M1}'$ of the first current duplication unit M1' is greater than that of the first current control unit M1, a current ($I_{M1}'=I_{M1}\times gm_{M1}'/gm_{M1}$) greater by a predetermined ratio may be input to the first current duplication unit M1'. Thus, the magnitude of the first duplication current $I_{M1}'$ may be changed by adjusting the trans-conductance $gm_{M1}'$ of the first current duplication unit M1'.

In this case, a unit gain voltage amplifier (UGVA) within the current duplication block 274 may be regarded as a voltage buffer and deliver a voltage having a magnitude the same as that of a current sensing voltage VS generated by the current sensing block 272 to the current duplication block 274 to allow output terminals of the first to nth current duplication units M1', M2', . . . , Mn' constituting the current duplication block 274 to be connected to a source voltage the same as that of the output terminals of the first to nth current control units M1, M2, . . . , Mn corresponding thereto. A voltage VS' delivered to the current duplication block 274 may be maintained to have a magnitude the same as that of the current sensing voltage VS, without affecting the current sensing voltage VS according to an operation of the UGVA. In this case, the first to nth current duplication units M1', M2', . . . , Mn' constituting the current duplication block 274 have source and drain voltages the same as those of the first to nth current control units M1, M2, . . . , Mn controlling the reference currents $I_{M1}$, $I_{M2}$, . . . , $I_{Mn}$ input to the driving control unit 27, and have a gate voltage the same as those of the corresponding first to nth current control units M1, M2, . . . , Mn because the first to nth control signals IC1, IC2, . . . , ICn are shared. Thus, the ratio between the currents flowing in the corresponding two current control unit and the current duplication unit (e.g., M1 and M1') may be obtained to be equal to the ratio between the trans-conductances (e.g., $gm_{M1}$ and $gm_{M1}'$) thereof.

In a case in which the current control units M1, M2, . . . , Mn controlling the respective reference currents $I_{M1}$, $I_{M2}$, . . . , $I_{Mn}$ are not connected to the same source voltage VS, source voltages of the respective current control units M1, M2, . . . , Mn are duplicated by using a plurality of UGVAs and delivered to the sources of the corresponding current duplication units M1', M2', . . . , Mn', so that the current duplication units M1', M2', . . . , Mn' may be connected to the same source voltages as those of the current control units M1, M2, . . . , Mn constantly. The current control units M1, M2, . . . , Mn and the current duplication units M1', M2', . . . , Mn' according to an embodiment are illustrated as n-type metal oxide semiconductor field effect transistor (nMOSFET), so a side to which a current is input is a drain, and a side from which a current is output is a source. Namely, a side connected to the input terminals T1, T2, . . . , Tn is a drain and a side connected to the current sensing block is a source.

In the LED driving device according to an embodiment of the present invention, in a case in which a higher current is driven as first to nth input terminals T1, T2, . . . , Tn of the driving control unit has priority sequentially (e.g., a higher current is input to T3 than T2 ($I_{F2}<I_{F3}$), exclusive priority may be easily set, but in a case in which a ratio between the lowest current level $I_{F1}$ and the highest current level $I_{Fn}$ is very large or when an input terminal having higher priority drives a very low input current, it may be difficult to implement the driving control unit 20. In detail, when an input current (e.g., $I_{Tn}$) having higher priority has a level equal to or higher than a predetermined level, currents $I_{T1}$, $I_{T2}$, . . . , $I_{Tn-1}$ flowing to the input terminals having lower priority are completely cut off. In this case, a current level of an input terminal having higher priority is very low, relative to that of an input terminal having lower priority ($I_{Fn}<<I_{F1}$, . . . , $I_{Fn-1}$), it may be difficult for the input terminal having higher priority to completely cut off the current of the input terminal having lower priority.

However, according to the present embodiment, as illustrated in FIG. 32, a portion of currents input to the respective input terminals T1, T2, . . . , Tn of the driving control unit 27 is input though a different path, i.e., the current duplication block 274 and flows to a ground. Thus, exclusive priority may be easily set among the input terminals T1, T2, . . . , Tn, regardless of the first to nth input currents $I_{T1}$, $I_{T2}$, . . . , $I_{Tn}$ input to the first to nth input terminals T1, T2, . . . , Tn of the driving control unit 27.

Here, the first to nth input currents $I_{T1}$, $I_{T2}$, . . . , $I_{Tn}$ are equal to the sum of the first to nth reference currents $I_{M1}$, $I_{M2}$, . . . , $I_{Mn}$ and the first to nth duplication currents $I_{M1}'$, $I_{M2}'$, . . . , $I_{Mn}'$ ($I_{T1}=I_{M1}+I_{Mn}'$, $I_{T2}=I_{M2}+I_{M2}'$, . . . , $I_{Tn}=I_{Mn}+I_{Mn}'$), respectively. Thus, the first to nth input currents $I_{T1}$, $I_{T2}$, . . . , $I_{Tn}$ may be set through the magnitudes or ratios of currents divided by the current duplication block 274, and in this case, the input terminals may have new first to nth input currents $I_{T1}$, $I_{T2}$, . . . , $I_{Tn}$ and without changing reference voltages of the respective controller (not shown) included in the current control block 271 and the current sensing unit RS of the current sensing block 272, and exclusive priority among the input terminals may be maintained as is. Thus, a new driving control unit may be easily implemented according to a change in the input currents. Meanwhile, in the case of the present embodiment, it is illustrated that the current duplication block 274 duplicates currents with respect to all of the input terminals T1, T2, . . . , Tn and the duplicated currents flow to the ground GND, but the present invention is not limited thereto and the current duplication block 274 may duplicate currents with respect only to a portion of the input terminals.

According to an embodiment of the present invention, the output signals IS1, IS2, . . . , ISn, i.e., the current sensing voltages Vs1, Vs2, . . . , Vsn, from the current sensing block 272 generated upon receiving the reference currents $I_{M1}$, $I_{M2}$, . . . , $I_{Mn}$ input through the current control unit 273 may be represented by Equation (34) to Equation (36) by using the reference currents IM1, IM2, . . . , IMn. Here, R11 to Rnn are values uniquely determined according to a configuration of the current sensing block 272, which correspond to the predetermined proportions.

$$Vs1=I_{M1}\times R11+I_{M2}\times R12 \ldots +I_{Mn}\times R1n \quad (34)$$

$$Vs2=I_{M1}\times R21+I_{M2}\times R22 \ldots +I_{Mn}\times R2n \quad (35)$$

...

$$Vsn=I_{M1}\times Rn1+I_{M2}\times Rn2 \ldots +I_{Mn}\times Rnn \quad (36)$$

Meanwhile, the reference currents $I_{M1}, I_{M2}, \ldots, I_{Mn}$ are a portion of the input currents $I_{T1}, I_{T2}, \ldots, I_{Tn}$ input to the driving control unit 27, which may be expressed as values obtained by multiplying predetermined proportions to the input currents $I_{T1}, I_{T2}, \ldots, I_{Tn}$. Namely, when proportions of the reference currents $I_{M1}, I_{M2}, \ldots, I_{Mn}$ to the input currents $I_{T1}, I_{T2}, \ldots, I_{Tn}$ are expressed as a1, a2, and an, $I_{M1}$=a1×$I_{T1}$, $I_{M2}$=a2×$I_{T2}$, $I_{Mn}$=an×$I_{Tn}$. Here, a1, a2, and an are values greater than 0 and smaller than or equal to 1. Here, the current sensing voltages Vs1, Vs2, . . . , Vsn may be expressed by using the input currents $I_{T1}, I_{T2}, \ldots, I_{Tn}$ by Equation (37) to Equation (39).

$$Vs1=I_{T1}\times a1\times R11+I_{T2}\times a2\times R12 \ldots +I_{Tn}\times an\times R1n \quad (37)$$

$$Vs2=I_{T1}\times a1\times R21+I_{T2}\times a2\times R22 \ldots +I_{Tn}\times an\times R2n \quad (38)$$

...

$$Vsn=I_{T1}\times a1\times Rn1+I_{T2}\times a2\times Rn2 \ldots +I_{Tn}\times an\times Rnn \quad (39)$$

As shown in Equation (37) to Equation (39), even in the case in which a portion of input currents flows to the ground GND by using the current duplication block 274 without passing through the current sensing block 272, the current sensing voltages Vs1, Vs2, . . . , Vsn generated by the current sensing block 272 may be expressed to be similar to the previous case generated by reflecting the first to nth input currents $I_{T1}, I_{T2}, \ldots, I_{Tn}$ input to the driving control unit 27 in predetermined proportions. In other words, a1×R11 to an×Rnn in Equation (37) to Equation (39) may be regarded as newly set predetermined proportions.

Meanwhile, the current sensing voltages Vs1, Vs2, . . . , Vsn in Equation (37) to Equation (39) may be generated by reflecting new input currents ($I_{T1}$×a1, $I_{T2}$×a2 . . . $I_{Tn}$×an) obtained by multiplying the input currents $I_{T1}, I_{T2}, \ldots, I_{Tn}$ by certain proportions a1, a2, . . . , an greater than 0 and smaller than or equal to 1, in predetermined proportions.

Thus, according to this method, exclusive priority may be easily given to the input currents $I_{T1}, I_{T2}, \ldots, I_{Tn}$ having various magnitudes input to the driving control unit 27. Also, when the input currents $I_{T1}, I_{T2}, \ldots, I_{Tn}$ are intended to be changed into different values, the driving control unit 27 implemented to include the current duplication block 274 may change the input currents by simply changing trans-conductance of the corresponding current duplication units M1', M2', . . . , Mn' without changing the current sensing block 272 and the current control block 271, and thus, it can be advantageously utilized.

In order to implement the current duplication block 274, various methods may be applied in addition to the embodiment illustrated in FIG. 32. Namely, the method of changing currents to the current duplication block 274 is not limited to the changing of the trans-conductance of the current duplication unit, but various other known methods may be applied.

Figure 33:
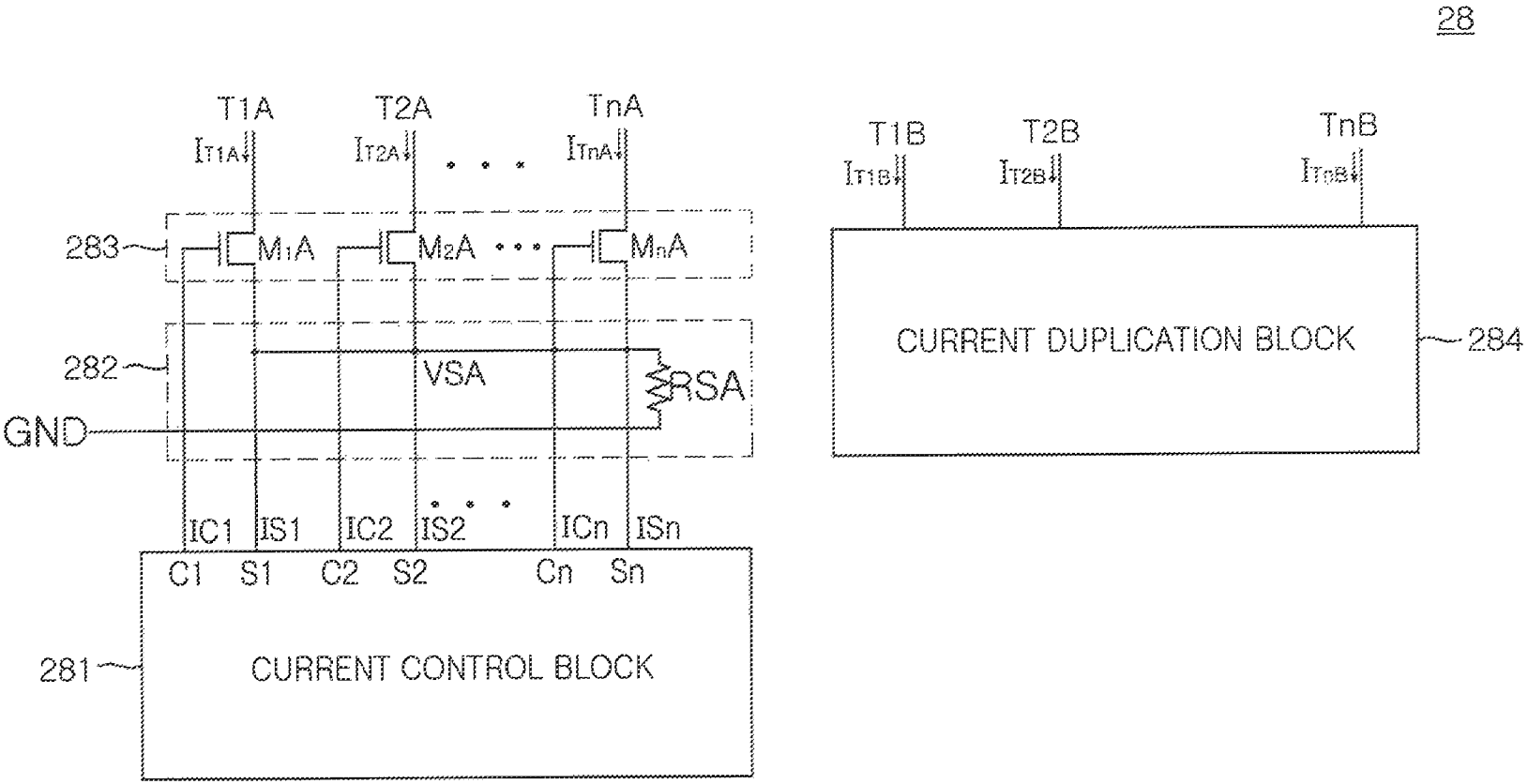
FIG. 33 is a view schematically illustrating another modification of the driving control unit applicable to the LED driving device according to another embodiment of the present invention illustrated in FIG. 31.

FIG. 33 is a view schematically illustrating an LED driving device according to another embodiment of the present invention. A driving control unit 28 according to the present embodiment may include a current control block 281, a current sensing block 282, and a current control unit 283, and may further include a current duplication block 284 receiving first to nth duplication currents $I_{T1B}, I_{T2B}, \ldots, I_{TnB}$ the same as the first to nth input currents $I_{T1A}, I_{T2A}, \ldots, I_{TnA}$ input to the current control unit 283. In this case, the current duplication block 284 may drive a separate light source unit, while sharing control signals IC1, IC2, . . . , ICn output from the current control block 281 with the current control unit 283. Namely, as illustrated in FIG. 31, in a case in which a lighting device includes a plurality of light source units 30-1, 30-2, . . . , **30-*n*, a plurality of current duplication blocks 284 to which currents having the same magnitudes as those of the current control unit 283 of the driving control unit may be provided, whereby the plurality of light source units 30 can be further driven by the single driving control unit 28, and in this case, all of the light source units 30-1, 30-2, . . . , 30-*n*** may be configured to have the same electrical characteristics.

The current duplication block 284 may include a current duplication unit (not shown) and a current sensing unit (not shown) in order to generate duplication currents $I_{T1B}, I_{T2B}, \ldots, I_{TnB}$ input to the current duplication block 284. The current sensing unit may be configured to be similar to the current sensing block 282, and generate current sensing voltages reflecting the duplication currents $I_{T1B}, I_{T2B}, \ldots, I_{TnB}$ delivered through the current duplication units (not shown) connected to the respective input terminals T1B, T2B, . . . , TnB in predetermined proportions and deliver the same to the respective output terminals, so that the respective output terminals of the current duplication units may receive the same current sensing voltages as those of the respective output terminals of the current control units M1A, M2A, . . . , MnA. In this case, the current duplication block may generate by itself a current sensing voltage having the same magnitude as that of the current sensing voltage generated by the current sensing block and may not receive the current sensing voltage generated by the current sensing block through a voltage buffer. The current control unit and the current duplication unit may be implemented as MOSFETs M1, M2, . . . , Mn and M1', M2', . . . , Mn' such that they may change a driving current according to a control signal input from the current control block 281, but the present invention is not limited thereto and the current control unit and the current duplication unit may be implemented as BJTs, IGBTs, JFETs, DMOSFETs, or combinations thereof.

In order to generate duplication currents, besides the method of maintaining respective terminal voltages of the current duplication units (not shown) constituting the current duplication block 284 to be equal to the respective terminal voltages of the current control units 283 corresponding thereto, various other methods may be applied. In other words, besides the method of duplicating respective terminal voltages of the corresponding current control unit and delivering the same to the current duplication unit by using the UGVA, a method of generating a corresponding signal and delivering the same to the current flowing in each current control unit may also be used. In this case, in a case in which an input signal is a current, a duplicated current may be easily generated by using a current mirror. In a case in which signals corresponding to currents flowing in the respective current control units 283 are delivered to the current duplication block 284, the current duplication block may not share the control signals IC1, IC2, . . . , ICn output from the current control block 281. In this manner, the method of generating a duplicated current upon receiving a signal corresponding to a current flowing in the current control unit may also be applied to implementation of the current duplication block 274 illustrated in FIG. 32 in a similar manner.

Figure 34:
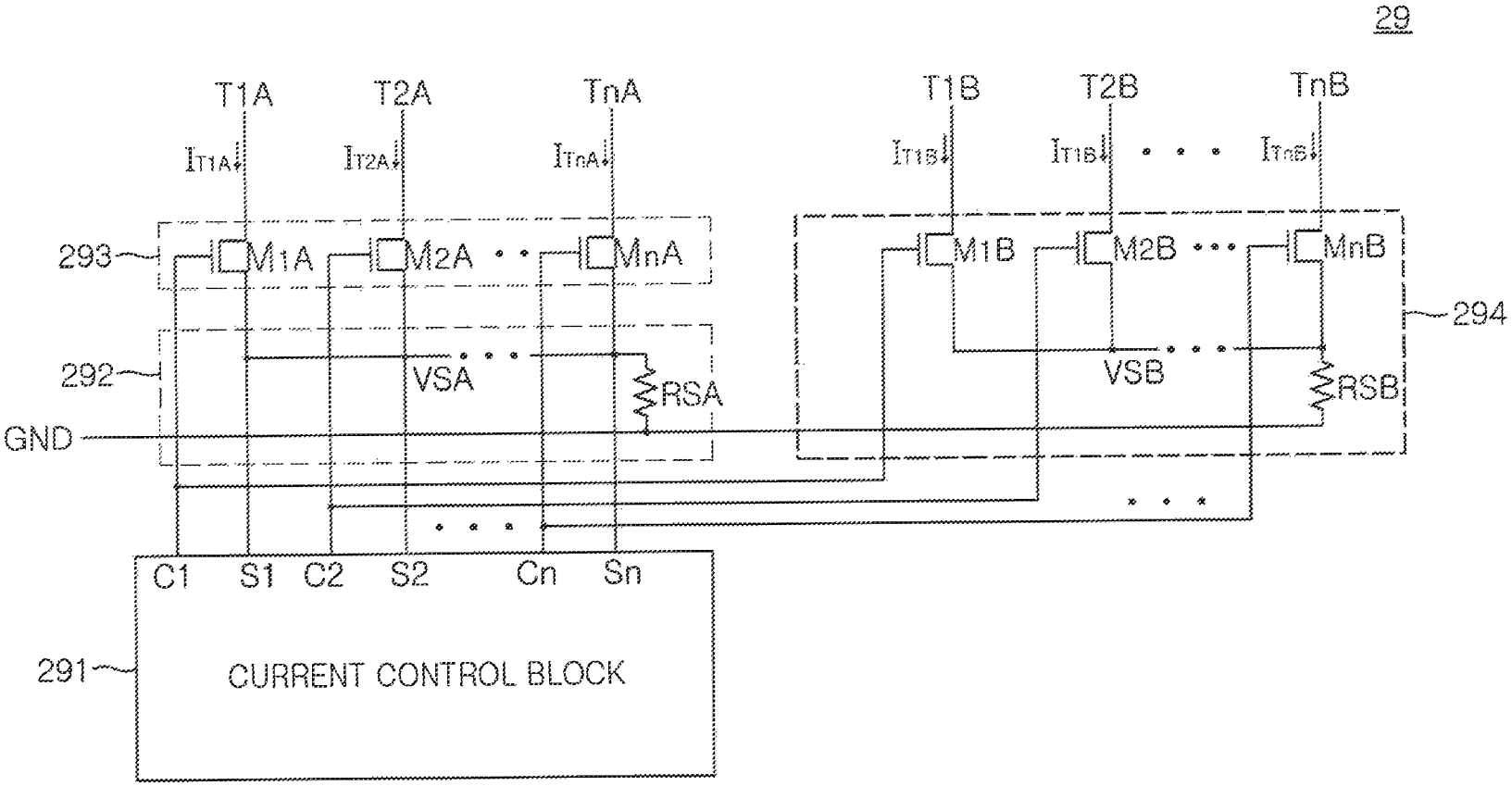
FIG. 34 is a view schematically illustrating an embodiment of a current duplication block illustrated in FIG. 33.

FIG. 34 is a view schematically illustrating an embodiment of the current duplication block 284 illustrated in FIG. 33. First to nth current duplication units M1B, M2B, . . . , MnB of a current duplication block may have trans-conductance the same as that of the first to nth current control units M1A, M2A, . . . , MnA, respectively, and resistance values of current sensing resistors RSA and RSB may also be equal. In this case, LED driving currents flowing in the current control units M1A, M2A, . . . , MnA and the current duplication units M1B, M2B, . . . , MnB sharing control signals output from a current control block 291 are equal, and thus, current sensing voltages VSA and VSB applied to the current sensing resistors RSA and RSB may also be equal. In the present embodiment, the current duplication block may not receive the current sensing voltages generated by the current sensing block through a voltage buffer (UGVA). Thus, FIG. 34 schematically illustrates an example of the driving control unit 29 including an embodiment of the current duplication block 294 applicable when the duplication currents $I_{T1B}$, $I_{T2B}$, . . . , $I_{TnB}$ input to the input terminals of the current duplication block are equal to the input currents $I_{T1A}$, $I_{T2A}$, . . . , $I_{TnA}$ input to the current control unit 293.

The driving control unit 27 illustrated in FIG. 32 may also be an embodiment of the current duplication block 284 in which the same duplication currents as those input to the current control units are driven by using the UGVA, i.e., the voltage buffer, when the respective input terminals of the current duplication block 274 are separated from the respective input terminals T1, T2, . . . , Tn of the driving control unit 27 and utilized as separate input terminals. The current duplication block 284 may be implemented to various embodiments according to a configuration of the current sensing block 283 or according to a method of generating a duplication current, besides the one embodiment 294 illustrated in the present embodiment. An embodiment of the current duplication block generating a duplicated current upon receiving a signal corresponding to a current flowing in the current control unit is not specifically illustrated, but detailed descriptions thereof may not be required for a person skilled in the art.

FIGS. 33 and 34 illustrate that the single driving control units 28 and 29 include the single current duplication blocks 284 and 294, respectively, but the single driving control units 28 and 29 may include a plurality of current duplication blocks 284 and 294, respectively, so as to be applied to the lighting device including a plurality of light source units as illustrated in FIG. 31. Also, in a case in which a plurality of current duplication blocks are applied, one of the current duplication blocks may divide input currents input to the respective input terminals T1, T2, . . . , Tn of the driving control unit and allow a portion of the currents to flow to a ground, and while the other current duplication blocks may be used to drive different light source units. In this case, the configurations of the current duplication block that divides currents input to the respective input terminals T1, T2, . . . , Tn of the driving control unit and allow a portion thereof to flow to a ground and the current duplication blocks driving the different light source units, and magnitudes of driving currents thereof may be different. Also, at least portions of the control signals output from the current control blocks 271, 281, and 291 may correspond to magnitudes of reference signals. In another example of the present embodiment, the first to nth control signals output from the current control block may correspond to the reference signals of the same magnitudes. In this case, since all of the plurality of current duplication blocks share a single control signal, the LED driving device that drives a plurality of light source units may be very easily implemented.

The present invention is not limited to the foregoing embodiments and may be defined by the appended claims. Thus, it will be apparent to those skilled in the art that modifications and variations can be made without departing from the spirit and scope of the invention as defined by the appended claims, and may belong to the scope of the present invention.

The invention claimed is:

1. An LED driving device comprising:

a light source unit including a plurality of first to nth LED groups sequentially connected in series; and a driving control unit having first to nth input terminals connected to output terminals of the first to nth LED groups, respectively, and controlling first to nth input currents input to the first to nth input terminals, through first to nth current sensing signals generated by reflecting the first to nth input currents in predetermined proportions, wherein the driving control unit generates the first to nth current sensing signals by reflecting the first input current in the lowest proportion among the first to nth input currents, and the driving control unit generates each of the first to nth current sensing signals by reflecting all of the first to nth input currents.

2. The LED driving device of claim 1, wherein the driving control unit controlling a current to be exclusively input preferentially to an input terminal having higher degree among the first to nth input terminals.

3. The LED driving device of claim 2, wherein the driving control unit comprises:

a current control block outputting first to nth reference signals;

a current sensing block generating first to nth current sensing signals by reflecting respective currents input from output terminals of the first to nth LED groups to first to nth input terminals of the driving control unit, in predetermined proportions; and first to nth current control units controlling the first to nth input currents by comparing the first to nth current sensing signals with the first to nth reference signals.

4. The LED driving device of claim 3, wherein at least a portion of the first to nth current control units comprise a bipolar junction transistor (BJT) having a base terminal to which the reference signals are input and an emitter terminal to which the current sensing signals are input.

5. The LED driving device of claim 2, wherein the driving control unit comprises: a current sensing block generating first to nth current sensing signals reflecting the first to nth input currents in predetermined proportions;

a current control block receiving the first to nth current sensing signals and outputting first to nth control signals for controlling respective currents input to the first to nth input terminals; and first to nth current control units regulating magnitudes of the first to nth input currents according to the first to nth control signals, respectively.

6. The LED driving device of claim 5, wherein degrees of at least a portion of the first to nth current sensing signals are sequential and magnitudes thereof are equal.

7. The LED driving device of claim 5, wherein the first to nth current sensing signals generated by the current sensing block are output in the form of voltages, and wherein the current sensing block comprises one or more resistors connected between the current control units and a ground and generating the first to nth current sensing signals reflecting all currents flowing from the current control units to the ground in predetermined proportions.

8. The LED driving device of claim 7, wherein the current sensing block comprises a plurality of resistors connected between the current control units and a ground, and the plurality of resistors connect adjacent output terminals of the first to nth current control units connected to the first to nth input terminals, respectively, and connect an output terminal of the first current control unit and a ground, to allow first to nth input currents input to the first to nth input terminals to flow to the ground through the plurality of resistors.

9. The LED driving device of claim 7, wherein, in the current sensing block, the resistance of a resistor connected between an input terminal driving the largest current, among the first to nth input terminals, and a ground, is the smallest.

10. The LED driving device of claim 5, wherein the current control block generates first to nth control signals for controlling magnitudes of the first to nth input currents by reflecting the first to nth current sensing signals and first to nth reference signals.

11. The LED driving device of claim 10, wherein the first to nth reference signals have a greater value to control a current of an input terminal having higher priority among the first to nth input terminals.

12. The LED driving device of claim 10, wherein magnitudes of at least a portion of the first to nth reference signals are changed by an external signal.

13. The LED driving device of claim 5, wherein a plurality of light source units are provided, and the driving control unit further comprises a current duplication block driving other remaining light source units which are not driven by the current control units, among the plurality of light source units, upon receiving a control signal, the same as those of the current control units, from the current control block.

14. The LED driving device of claim 1, wherein the driving control unit further comprises a dimming signal generator changing magnitudes of first to nth input currents according to a signal input from the outside.

15. The LED driving device of claim 1, wherein the driving control unit changes levels of currents input to the first to nth input terminals of the driving control unit, upon receiving voltages from the output terminals of the first to nth LED groups.

16. The LED driving device of claim 1, wherein at least a portion of the currents input from the output terminals of the first to nth LED groups to the first to nth input terminals of the driving control unit are transferred through a current buffer.

17. The LED driving device of claim 1, further comprising a power source unit supplying DC power to the light source unit, wherein one end of the first LED group is connected to the power source unit and the other end thereof is connected sequentially in series to the second to nth LED groups.

18. The LED driving device of claim 17, wherein the driving control unit drives such that a voltage, of the DC power and a current passing through the first LED group are in inverse proportion in as portion of at least one driving section.

19. An LED driving device comprising:

a light source unit including a plurality of first to nth LED groups sequentially connected in series; and a driving control unit having first to nth input terminals connected to output terminals of the first to nth LED groups, respectively, and controlling first to nth input currents to be input to the first to nth input terminals according to pre-set priority by allowing a current input to an input terminal having higher priority among the first to nth input terminals to reduce or cut off a current input to an input terminal having lower priority, regardless of a relative magnitude of each of the first to nth input currents.

20. An LED driving device comprising:

a light source unit including a plurality of first to nth LED groups sequentially connected in series; and a driving control unit having first to nth input terminals connected to output terminals of the first to nth LED groups, respectively, and controlling first to nth input currents input to the first to nth input terminals, through first to nth current sensing signals generated by reflecting the first to nth input currents in predetermined proportions, wherein the driving control unit generates the first to nth current sensing signals by reflecting the first to nth input currents in different proportions to each other, and magnitudes of the first to nth current sensing signals are equal to each other.

* * * * *